US008137756B2

(12) United States Patent
Hori

(10) Patent No.: US 8,137,756 B2
(45) Date of Patent: Mar. 20, 2012

(54) LIQUID APPLICATION METHOD, LIQUID APPLICATION APPARATUS AND IMAGE FORMING APPARATUS

(75) Inventor: Hisamitsu Hori, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 394 days.

(21) Appl. No.: 12/490,151

(22) Filed: Jun. 23, 2009

(65) Prior Publication Data

US 2009/0317555 A1 Dec. 24, 2009

(30) Foreign Application Priority Data

Jun. 24, 2008 (JP) ..... 2008-164933

(51) Int. Cl.
*B05D 5/00* (2006.01)

(52) U.S. Cl. ..... 427/428.06; 427/428.14; 118/261; 101/167; 101/169; 101/425

(58) Field of Classification Search ..... 427/428.06, 427/428.14; 118/261; 101/167, 169, 425
See application file for complete search history.

(56) References Cited

U.S. PATENT DOCUMENTS 1,981,912 A * 11/1934 Fankboner ..... 101/350.5
3,832,213 A * 8/1974 Bremer ..... 427/207.1
4,077,317 A * 3/1978 Kiesewetter et al. ..... 101/37
5,003,876 A * 4/1991 Harrison et al. ..... 101/350.5
5,046,416 A * 9/1991 Freyer et al. ..... 101/148
5,842,416 A * 12/1998 Olawsky et al. ..... 101/350.1
6,276,270 B1 * 8/2001 Leanna ..... 101/350.6

FOREIGN PATENT DOCUMENTS

JP 4-64488 A 2/1992
JP 5-293580 A 11/1993
JP 10-230201 A 9/1998

* cited by examiner

*Primary Examiner* — Nathan Empie
(74) *Attorney, Agent, or Firm* — Birch, Stewart, Kolasch & Birch, LLP

(57) ABSTRACT

A liquid application method includes: an application liquid supplying step of supplying an application liquid to an outer circumferential surface of a roller member which is driven to rotate; a blade abutting step of abutting a blade member against the outer circumferential surface of the roller member so as to remove the application liquid supplied in the application liquid supplying step; and a blade abutment and separation control step of controlling an operation of abutting and an operation of separating the blade member in the blade abutting step.

9 Claims, 51 Drawing Sheets

FIG.27

| | | AIR SPRAY NOZZLE | | |
|---|---|---|---|---|
| | | LARGE VOLUME SPRAY | MEDIUM VOLUME SPRAY | SMALL VOLUME SPRAY |
| MIST SPRAY NOZZLE | AIR | 80% OR MORE AND 100% OR LESS (SOLID IMAGE, ETC.) | 60% OR MORE AND LESS THAN 80% (MEDIUM TONE IMAGE) | 40% OR MORE AND LESS THAN 60% (MEDIUM TONE IMAGE) |
| | MIST | - | 20% OR MORE AND LESS THAN 40% (MEDIUM TONE IMAGE) | 0% OR MORE AND LESS THAN 20% (BLANK IMAGE, ETC.) |

LIQUID APPLICATION METHOD, LIQUID APPLICATION APPARATUS AND IMAGE FORMING APPARATUS

BACKGROUND OF THE INVENTION

1. Field of the Invention

The present invention relates to a liquid application method, a liquid application apparatus and an image forming apparatus, and more particularly to a liquid application method and a liquid application apparatus having a composition in which liquid is deposited onto the outer circumferential surface of a cylindrical member, such as a spiral roller, which has spiral grooves formed in the outer circumference thereof by form rolling or the like, and to an image forming apparatus which applies a treatment liquid (undercoating liquid) by using this liquid application apparatus.

2. Description of the Related Art

Japanese Patent Application Publication No. 4-64488 discloses technology for stabilizing an application process, by separating a ductor blade from a gravure roller, each time application onto one substrate has been performed, and cleaning the remaining application liquid left between the blade and the roller, by means of a fluid.

Japanese Patent Application Publication No. 10-230201 discloses technology for preventing an application liquid from drying out and becoming affixed to the outer circumferential surface of an application roller, by separating a pressing roller and application liquid tank, when application liquid is not being applied to a receiving body.

Japanese Patent Application Publication No. 5-293580 discloses technology which enables the application of a thin layer, by application onto an application receiving body using an application roller in which spiral grooves of small pitch and small volume are formed by rotating a dice having a large number of grooves.

However, the invention described in Japanese Patent Application Publication No. 4-64488 seeks to stabilize application by removing remaining liquid by means of air or liquid, but it is not suitable for high-speed processing since the separation of the blade is a complicated operation. Furthermore, it is also difficult to control application in the conveyance direction and the breadthways direction.

In the invention disclosed in Japanese Patent Application Publication No. 10-230201, although it is possible to reduce affixation onto the outer circumferential surface of a roller, there is a possibility that application non-uniformities are liable to occur due to the effects of residual fixed material. Furthermore, if the application liquid in the application liquid tank is separated, then it is possible to control application in the conveyance direction, but liquid trails are liable to occur and the response is not satisfactory.

The invention disclosed in Japanese Patent Application Publication No. 5-293580 describes a method of forming an application roller which is capable of applying a thin film, and an application method using this roller, but it does not make any mention in regard of controlling application in the conveyance direction or breadthways direction.

Moreover, in the field of inkjet recording, intermediate transfer methods have been investigated in the related art, with the object of achieving good image formation onto media of various types, and in particular, a method which applies an undercoating liquid (treatment liquid) such as an ink aggregating agent, to an intermediate transfer body is suitable for forming images. When an image is formed on cut paper by means of this method, then although application by reverse rotation of a roller member is beneficial in terms of forming a uniform thin layer, it is difficult to control the application range and there are cases where the undercoating liquid adhering to portions outside the paper becomes attached to the transfer roller, and the intermediate transfer body becomes soiled by retransfer of this liquid. Furthermore, in cases where the undercoating liquid is acidic, then corrosion of the structural members, such as the transfer roller, may be caused by the liquid. In order to resolve these problems, a liquid application apparatus using a roller member in which the application range can be controlled by means of a simple composition has been investigated.

SUMMARY OF THE INVENTION

The present invention has been contrived in view of these circumstances, an object thereof being to provide a liquid application method, a liquid application apparatus and an image forming apparatus using same, whereby the control performance of the application range can be improved in a liquid application apparatus using a roller member.

In order to attain an object described above, one aspect of the present invention is directed to a liquid application method comprising: an application liquid supplying step of supplying an application liquid to an outer circumferential surface of a roller member which is driven to rotate; a blade abutting step of abutting a blade member against the outer circumferential surface of the roller member so as to remove the application liquid supplied in the application liquid supplying step; and a blade abutment and separation control step of controlling an operation of abutting and an operation of separating the blade member in the blade abutting step.

According to this aspect of the invention, it is possible to stabilize the amount of liquid applied to a roller member by means of the blade member, and furthermore, since the application liquid can be removed selectively in portions where a blade member is abutted, then it is possible to form selectively, on the circumferential surface of the roller, an application region where the application liquid is present, and a non-application region where the application liquid is not present. Furthermore, by controlling the abutting operation of the blade member, it is possible to control the application region (the application surface area), and therefore excellent control response is achieved.

A liquid application apparatus of this aspect of the present invention is suitable for an intermediate transfer system, but can also be applied to the application of liquid to media in cases where recording is carried out directly onto media. It is especially desirable if a coated paper, such as art paper, is used, or if a permeation suppression agent, or the like, is deposited before application of the treatment liquid, since the contact friction is reduced by the subsequent lubricating effects.

Desirably, the outer circumferential surface of the roller member comprises a groove formed approximately in a direction in which the roller member rotates, and the blade member is made of an elastic body.

According to this aspect, the blade member is able to adapt to the grooves of the roller member and remove the application liquid in a satisfactory manner. Furthermore, forming grooves in a spiral shape is particularly beneficial in terms of productivity.

Desirably, in the blade abutment and separation control step, control is performed for switching, in at least two stages, a biasing force of the blade member against the outer circumferential surface of the roller member during abutment of the blade member.

According to this aspect, it is possible to control application by means of one blade member. Furthermore, if a film thickness sensor, such as a moisture meter, is provided on the application roller or the application receiving medium, then even further beneficial effects are obtained in being able to maintain a stable application thickness.

Desirably, in the blade abutting step, the roller member is separated from an application receiving medium by a biasing force of the blade member.

According to this aspect, it is possible to avoid friction between the roller member and the application receiving medium, for instance, when the liquid cleaning of the application receiving medium is halted. Furthermore, it is also possible to avoid contact between the roller member and the step difference at the joint section of the application receiving medium.

Desirably, the liquid application method comprises a squeegee step of scraping, by the blade member, a surplus of the application liquid which has been deposited on the outer circumferential surface of the roller member in the application liquid supplying step.

According to this aspect, it is possible to scrape surplus application liquid from the outer circumferential surface of the roller member.

Desirably, in the application liquid supplying step, a width of the outer circumferential surface of the roller member at which the application liquid is supplied is controlled by a supply width control device which controls the width of the outer circumferential surface of the roller member at which the application liquid is supplied.

According to this aspect, it is possible to control the application width of the application liquid in accordance with the width of the application receiving medium. To give a specific example, supposing that the application liquid is supplied to the outer circumferential surface of the roller member by spraying, then the width at which the application liquid is supplied to the outer circumferential surface of the roller member can be controlled by controlling the spray pressure and the number of spraying nozzles, and hence the application width of the application liquid onto the application receiving medium can be controlled. Furthermore, if grooves are formed in substantially the direction of rotation, for example, as spiral grooves, in the outer circumferential surface of the roller member, then it is possible to reduce leaking of liquid in the breadthways direction.

Desirably, an intermediate transfer body of an intermediate transfer type of inkjet recording apparatus is employed as an application receiving medium, and tension of the intermediate transfer body is adjusted by a tensioner member provided in a vicinity of the roller member.

According to this aspect, it is possible to prevent image distortion by absorbing any speed fluctuations during image formation in an intermediate transfer type of inkjet recording apparatus.

Desirably, at least one of an intermediate transfer body which has undergone liquid cleaning, a recording medium having a coating layer formed on the surface thereof and a recording medium on which a liquid containing a lubricating component has been deposited is employed as an application receiving medium.

According to this aspect, the contact friction between the roller member and the application receiving medium in the non-application portions is reduced by the residual component of the solvent, such as water or glycerine, and surfactant, or the like, and therefore highly reliable application can be achieved in a stable fashion.

Desirably, an intermediate transfer body of an intermediate transfer type of inkjet recording apparatus is employed as an application receiving medium, and hardness of a surface of the intermediate transfer body is 20° to 80°, and surface energy of the surface of the intermediate transfer body is 10 mN/m to 40 mN/m.

According to this aspect, the contact of the roller member is stabilized and uniform application is achieved. Furthermore, the surface of the intermediate transfer body has liquid-repelling properties and has excellent cleaning characteristics. More specifically, desirably, the material of the intermediate transfer body is any one of: fluorine rubber, urethane rubber, silicone rubber or fluorine elastomer.

Desirably, a recording medium for a direct drawing type of inkjet recording apparatus is employed as an application receiving medium, and hardness of the surface of a conveyance device of the recording medium is 20° to 80°, and surface energy of the surface of the conveyance device for the recording medium is 10 mN/m to 40 mN/m.

According to this aspect, the contact of the roller member is stabilized and uniform application is achieved. Furthermore, the surface of the conveyance device has liquid-repelling properties and has excellent cleaning characteristics. More specifically, as the surface material of the recording medium conveyance device, it is desirable to use fluorine rubber, urethane rubber, silicone rubber, fluorine elastomer, or a material coated with PFA, or the like.

Another aspect of the present invention is directed to a liquid application apparatus comprising: a roller member which is driven to rotate; an application liquid supply device which supplies an application liquid to a portion of the roller member while the roller member rotates; a blade member which is provided at a position to a downstream side of the application liquid supply device in terms of a direction in which the roller member rotates, and abuts against a partial range of an outer circumferential surface of the roller member so as to remove the application liquid from the outer circumferential surface of the roller member; and a blade member control device which controls an abutting and separating operation of the blade member.

Another aspect of the present invention is directed to an image forming apparatus comprising: a liquid deposition device which deposits a liquid onto an application receiving medium by one of the liquid application apparatuses as above; an ink ejection device which deposits an ink onto the application receiving medium onto which the liquid has been deposited by the liquid deposition device; and a transfer device which transfers the ink deposited by the ink ejection device, onto a recording medium, wherein the blade member control device performs control, according to image data, so as to abut the blade member against a region corresponding to a non-image forming region, of the outer circumferential surface of the roller member.

Another aspect of the present invention is directed to an image forming apparatus comprising: a liquid deposition device which deposits a liquid onto a recording medium by one of the liquid application apparatuses as above; a conveyance device which conveys the recording medium; and an ink ejection device which ejects droplets of ink onto the recording medium onto which the liquid has been deposited by the liquid deposition device, wherein the blade member control device performs control, according to image data, so as to abut the blade member against a region corresponding to a non-image forming region, of the outer circumferential surface of the roller member.

Desirably, the application liquid supply device is a liquid spraying device which sprays the application liquid so as to apply the application liquid to the outer circumferential surface of the roller member, and the image forming apparatus further comprises a liquid spray control device which performs control such that a liquid that is different from the application liquid is sprayed from the liquid spraying device when an image is not being formed.

According to this aspect, it is possible to clean the roller member by spraying a cleaning liquid by means of a simple composition.

According to the present invention, it is possible to improve control performance of the application range in an application system using a roller member.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 11 is a perspective diagram illustrating a general view of the movement mechanism (abutment/separation mechanism) and rotational drive device of the spiral roller, the rotational mechanism of the squeegee blade and main blade, and so on;

FIG. 27 shows an example of control relating to the gas spray nozzle and the mist spray nozzle;

DETAILED DESCRIPTION OF THE PREFERRED EMBODIMENTS

Figure 1:
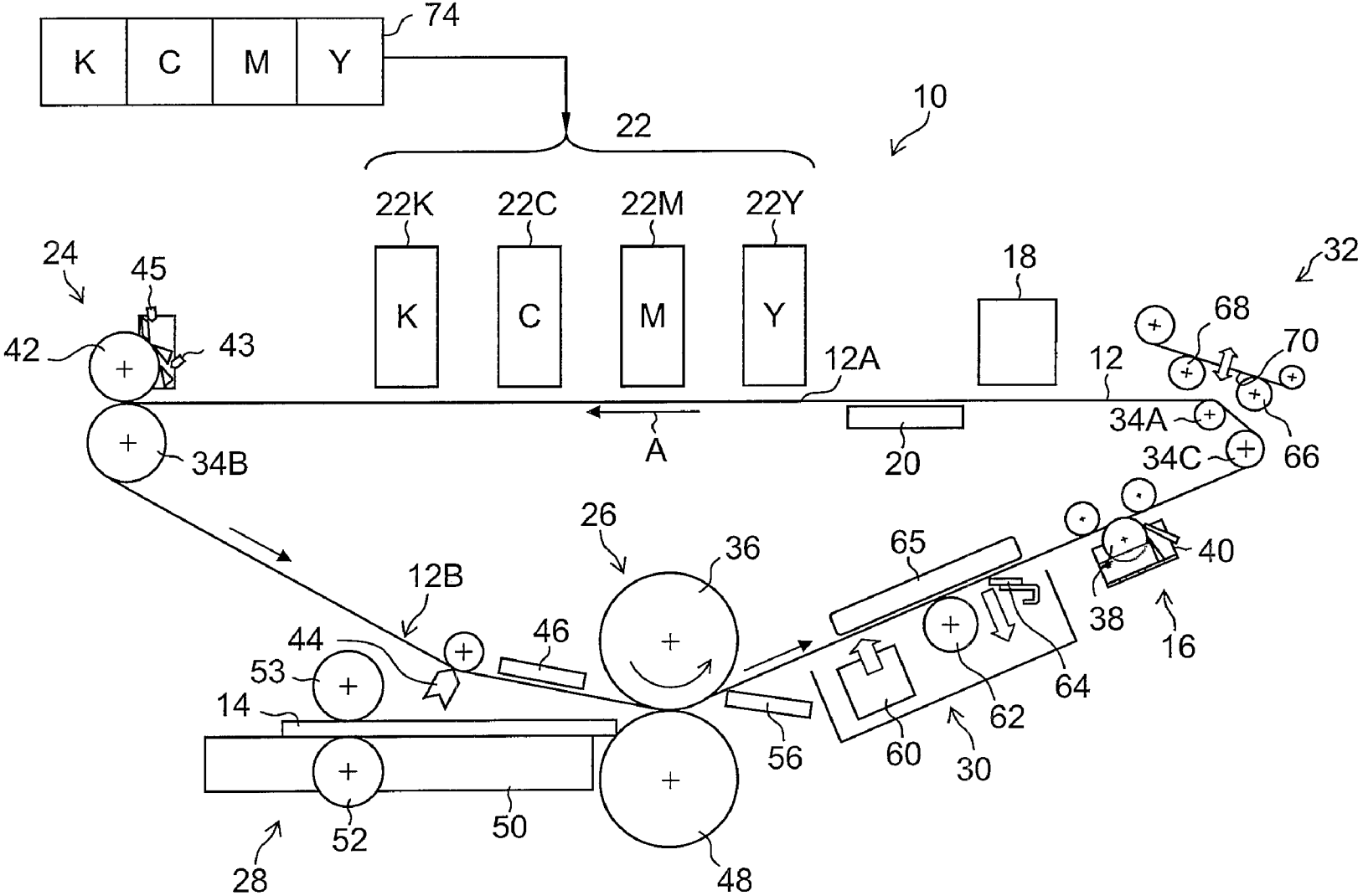
FIG. 1 is a general schematic drawing of an inkjet recording apparatus according to a first embodiment of the present invention.

General Composition of Inkjet Recording Apparatus According to First Embodiment Firstly, an inkjet recording apparatus which forms an image forming apparatus according to an embodiment of the present invention will be described. FIG. 1 is a diagram of the general composition of an inkjet recording apparatus according to a first embodiment. As illustrated in FIG. 1, the inkjet recording apparatus 10 according to the present embodiment is a recording apparatus using a transfer method which records an image (primary image) on an intermediate transfer body 12, which is a non-permeable body, and then forms a main image (secondary image) by transferring this image to a recording medium 14, such as a normal paper. The principle compositional elements of this inkjet recording apparatus 10 are: a treatment liquid application unit 16 (corresponding to the "liquid application apparatus" according to the present invention) which applies an aggregation treatment agent (hereinafter, also referred to simply as "treatment liquid" in the present specification) onto an intermediate transfer body 12; a heating unit 18 and a cooler 20 for drying and cooling the treatment liquid which has been applied on the intermediate transfer body 12; a print unit 22 which deposits inks of a plurality of colors onto the intermediate transfer body 12; a solvent removal unit 24 which removes liquid solvent (excess solvent) on the intermediate transfer body 12 after ejection of ink droplets; a transfer unit 26 which transfers the ink image formed on the intermediate transfer body 12, onto a recording medium 14; a paper supply unit 28 which supplies a recording medium 14 to the transfer unit 26; and cleaning units (first cleaning unit 30 and second cleaning unit 32) which clean the intermediate transfer body 12 after transfer.

The treatment liquid is an acidic liquid which has the action of aggregating the coloring material which is contained in the ink, and the inks are colored inks which contain a coloring material (pigment) of the respective colors of yellow (Y), magenta (M), cyan (C) and black (K). The composition of the treatment liquid and the ink used in the present embodiment are described in detail hereinafter.

An endless belt is used for the intermediate transfer body 12. This intermediate transfer body (endless belt) 12 has a structure whereby it is wound about a plurality of rollers (three tensioning rollers 34A through 34C and a transfer roller 36 are depicted in FIG. 1, but the winding mode of the belt is not limited to this example), and the drive power of a motor (not illustrated in FIG. 1 and indicated by reference numeral 288 in FIG. 40) is transmitted to at least one of the tensioning rollers 34A through 34C or the transfer roller 36, thereby driving the intermediate transfer body 12 in a counter-clockwise direction in FIG. 1 (the direction indicated by the arrow A). The tensioning roller indicated by reference numeral 34C is a tensioner member which serves to correct serpentine travel of the belt and to apply tension to the belt.

The intermediate transfer body 12 is formed of resin, metal, rubber, or the like, which has non-permeable properties that prevent permeation of liquid droplets of ink, in at least the image forming region (not illustrated) where the primary image is formed, of the surface (the image forming surface) 12A opposing the print unit 22. Furthermore, at least the image forming region of the intermediate transfer body 12 is composed so as to have a smooth surface which has a prescribed flatness.

Desirable materials for use as the surface layer which includes the image forming surface 12A of the intermediate transfer body 12 are, for example, commonly known materials such as: a polyimide resin, a silicone resin, a polyurethane resin, a polyester resin, a polystyrene resin, a polyolefin resin, a polybutadiene resin, a polyamide resin, a polyvinyl chloride resin, a polyethylene resin, a fluorine resin, and the like.

The surface tension of the surface layer of the intermediate transfer body 12 is desirably set to be not less than 10 mN/m and not more than 40 mN/m. If the surface tension of the surface layer of the intermediate transfer body 12 is more than 40 mN/m, then the surface tension differential with respect to the recording medium 14 onto which the primary image is to be transferred disappears (or becomes extremely low), and the transfer properties of the ink aggregating body worsen. If, on the other hand, the surface tension of the surface layer of the intermediate transfer body 12 is less than 10 mN/m, then the design freedom (range of selection) of the intermediate transfer body 12 and the treatment liquid is restricted. This is because if the wetting properties of the treatment liquid are taken into account, it is necessary to set the surface tension of the treatment liquid to be lower than the surface tension of the surface layer on the intermediate transfer body 12, and it is difficult to make the surface tension of the treatment liquid not more than 10 mN/m.

From the viewpoint of the durability and transfer characteristics onto a normal paper, the intermediate transfer body 12 according to the present embodiment is desirably a body in which an elastic material having a surface energy approximately of 15 mN/m (=mJ/m$^2$) through 30 mN/m, has been formed to a thickness of approximately 30 μm through 150 μm on the base material, such as polyimide, and it is desirable to provide a coating of urethane rubber, silicone rubber, fluorine rubber, a fluorine elastomer, or the like as the elastic material.

The treatment liquid application unit 16 applies a treatment liquid (aggregation treatment agent) which forms an undercoating liquid, on the intermediate transfer body 12 after a cleaning step by a first cleaning unit 30, which is described below. The treatment liquid application unit 16 is disposed to the upstream side of the print unit 22, with respect to the direction of conveyance of the intermediate transfer body. Desirably, the application of the treatment liquid onto the intermediate transfer body 12 involves selective application onto the image forming section by means of reverse coating by a spiral roller 38. The detailed structure of the liquid application apparatus used in the treatment liquid application unit 16 is described later.

In other words, the treatment liquid application unit 16 is constituted of a spiral roller which forms an application roller (which corresponds to a "roller member") 38, and a treatment liquid container 40. By rotating the spiral roller 38 onto which the treatment liquid has been supplied in a direction opposite to the direction of conveyance of the intermediate transfer body 12, while the spiral roller 38 is in contact with the intermediate transfer body 12, the treatment liquid is applied onto the image forming surface 12A of the intermediate transfer body 12. Although the details are described later, the spiral roller 38 is also used as a wiping device to perform the maintenance cleaning for the intermediate transfer body 12.

Furthermore, a desirable mode is one where the treatment liquid contains 1 wt % through 5 wt % of polymer particles (latex) with the object of enhancing the transfer characteristics and the coloring material fixing properties when depositing droplets of ink. Although the details are described later, in the maintenance cleaning of the intermediate transfer body 12, it is possible to use a washing liquid containing a surfactant or polishing particles for the maintenance cleaning.

The heating unit 18 is disposed to the downstream side of the treatment liquid application unit 16 and to the upstream side of the print unit 22. The heating unit 18 according to the present embodiment uses a heater whose temperature can be adjusted in a range of 50° C. through 100° C. The treatment liquid applied on the intermediate transfer body 12 by means of the treatment liquid application unit 16 is heated by passing through this heating unit 18 and the solvent component evaporates, thereby drying the liquid. Consequently, an aggregation treatment agent layer (namely, a thin film layer formed by drying the treatment liquid) which is in a solid state or a semi-solid state is formed on the surface of the intermediate transfer body 12.

The "aggregation treatment agent layer in a solid state or a semi-solid state" referred to here includes a layer of which the percentage of water content as defined below is 0% through 70%:

$$\text{percentage of water content} = \frac{A}{B} \times 100$$

where A is weight of water contained in the treatment liquid after drying per unit surface area (g/m$^2$), and B is weight of the treatment liquid after drying per unit surface area (g/m$^2$).

A cooler 20 is disposed on the downstream side of the heating unit 18 in the conveyance direction of the intermediate transfer body, and to the upstream side of the print unit 22. This cooler 20 is disposed on the rear surface side of the intermediate transfer body 12. The cooler 20 can be controlled within a prescribed temperature range, and in the present embodiment, for example, it is controlled to 40° C. By cooling the intermediate transfer body 12 on which the aggregation treatment agent layer has been formed by heating and drying by the heating unit 18, to approximately 40° C. by means of the cooler 20, the radiated heat from the intermediate transfer body 12 is reduced, and the drying of the ink in the nozzles of the head in the print unit 22 is suppressed.

The print unit 22 disposed after the cooler 20 includes liquid ejection heads (hereinafter, referred to as "heads") 22Y, 22M, 22C and 22K of an inkjet type which correspond to the respective ink colors of yellow (Y), magenta (M), cyan (C) and black (K).

The pigment-based inks of respective colors (C, M, Y, K) are ejected from the respective heads 22Y, 22M, 22C and 22K of the print unit 22 onto the aggregation treatment agent layer on the intermediate transfer body 12 which has passed through the cooler 20, in accordance with the image signal, thereby depositing droplets of the inks onto the aggregation treatment agent layer. In the case of the present embodiment, the ink ejection volume achieved by the respective heads 22Y, 22M, 22C and 22K is approximately 2 pl, and the recording density is 1200 dpi in both the main scanning direction (the breadthways direction of the intermediate transfer body 12) and the sub-scanning direction (the conveyance direction of the intermediate transfer body 12). The ink can also contain polymer particles (latex) having film forming properties, and in the case of this mode, the rub resistance and storage stability are improved in the transfer step and the fixing step.

When ink droplets are deposited onto the aggregation treatment agent layer, then the contact surface between the ink and the aggregation treatment agent layer has a prescribed surface area when the ink deposits, due to a balance between the propulsion energy and the surface energy. An aggregating reaction starts immediately after the ink has deposited on the aggregation treatment agent, and the aggregating reaction starts from the contact surface between the ink and the aggregation treatment agent layer, Since the aggregating reaction occurs only in the vicinity of the contact surface, and the coloring material in the ink aggregates while receiving an adhesive force in the prescribed contact surface area upon deposition of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregation treatment agent is formed on the intermediate transfer body 12.

As described above, an aggregate of the pigment is formed due to an aggregating reaction of the ink deposited onto the aggregation treatment agent layer, and this aggregate separates from the solvent. The solvent (residual solvent) component which has separated from the pigment aggregate is removed from the intermediate transfer body 12 by a solvent removal roller 42 of a solvent removal unit 24 which is disposed to the downstream side of the print unit 22.

The solvent removal roller 42 used here is desirably a roller which traps liquid in the cells on the outer circumferential surface, or a roller which traps liquid in the grooves on the outer circumferential surface having a similar shape to the spiral roller used for application. The liquid collected by the solvent removal roller 42 is removed from the solvent removal roller 42 by means of an air blower or liquid spraying action, or the like.

In this way, in a mode where solvent on the image forming surface 12A of the intermediate transfer body 12 is removed by means of a solvent removal roller 42, since the solvent on the intermediate transfer body 12 is removed appropriately, then there is no transfer of large quantities of solvent (dispersion medium) onto the recording medium 14 in the transfer unit 26. Hence, even in a case where a normal paper, or the like, is used as the recording medium 14, it is possible to prevent problems which are characteristic of water-based solvents, such as curling, cockling, or the like.

Moreover, by removing excess solvent from the ink aggregate by means of the solvent removal unit 24, the ink aggregate is condensed and the internal aggregating force is enhanced yet further. Consequently, adhesion of the resin particles contained in the ink aggregate is promoted effectively, and a stronger internal aggregating force can be applied to the ink aggregate, up until the transfer step carried out by the transfer unit 26. Moreover, by achieving effective condensation of the ink aggregate by removal of the solvent, it is possible to apply good fixing properties and good luster to the image, even after transfer of the image to the recording medium 14.

It is not absolutely necessary to remove all of the solvent on the intermediate transfer body 12 by means of this solvent removal unit 24. If the ink aggregate is condensed excessively by removing an excessive amount of solvent, then the aggregating force between the ink aggregate and the transfer body becomes too strong, and therefore a very large pressure is needed for transfer, which is not desirable. Rather, in order to maintain a viscous elasticity which is suitable for transfer, it is desirable to leave a small amount of solvent.

Moreover, the following beneficial effects are obtained by leaving a small amount of solvent on the intermediate transfer body 12. Specifically, since the ink aggregate is hydrophobic, and the non-volatile solvent component (principally, the organic solvent, such as glycerine) is hydrophilic, then the ink aggregate and the residual solvent component separate after carrying out solvent removal, and a thin layer of liquid composed of the residual solvent component is formed between the ink aggregate and the intermediate transfer body. Consequently, the adhesive force of the ink aggregate on the intermediate transfer body 12 becomes weak, which is beneficial for improving transfer characteristics.

Since the volume of ink ejected as droplets onto the intermediate transfer body 12 varies in accordance with the image to be printed, then in the case of an image having a large white area (an image having a low ink volume), a mist spray is emitted from a mist spray nozzle 43 in order to supplement the low ink volume, in such a manner that the amount of water on the intermediate transfer body 12 is stabilized within a prescribed tolerable range.

A soiling determination unit 44 for determining the soiling of the intermediate transfer body 12, and a pre-heater 46 forming a preliminary heating device are provided to the downstream side of the solvent removal unit 24 and before the transfer unit 26, in terms of the conveyance direction of the intermediate transfer body. The pre-heater 46 according to the present embodiment is disposed on the rear surface 12B side of the intermediate transfer body 12, and hence the intermediate transfer body 12 on which the primary image has been formed is heated from the rear surface 12B side.

The heating temperature range of the pre-heater 46 is 90° C. through 130° C., and thus it is set to be not less than the heating temperature of the transfer unit 26 during transfer (in the present embodiment, 90° C.). Since the image formed on the intermediate transfer body 12 is transferred to the recording medium 14 in the transfer unit 26 after preliminarily heating the image forming region of the intermediate transfer body 12, then it is possible to set the heating temperature of the transfer unit 26 to a lower temperature than in a case where preliminary heating is not carried out, and furthermore, it is possible to shorten the transfer time of the transfer unit 26.

The transfer unit 26 is constituted of a transfer roller 36 including a heater (not illustrated in FIG. 1, and indicated by reference numeral 289 which represents a plurality of heaters, in FIG. 40), and a heating roller 48 performing a heating and pressurization nip, which is disposed opposing the transfer roller 36. In this way, a composition is achieved in which the intermediate transfer body 12 and the recording medium 14 are taken up in between the transfer roller 36 and the pressurization roller 48, and are pressurized at a prescribed pressure (nip pressure) while heating to a prescribed temperature, thereby transferring the primary image formed on the intermediate transfer body 12 to the recording medium 14.

The device for adjusting the nip pressure during transfer in the transfer unit 26 is, for example, a mechanism (drive device) which moves the transfer roller 36 or the pressurization roller 48, or both, in the vertical direction in FIG. 1.

A desirable nip pressure during transfer is 1.0 MPa through 2.0 MPa, and a desirable heating temperature (roller temperature) is 80° C. through 120° C. In the present embodiment, the transfer roller 36 and the pressurization roller 48 are both set to 90° C. If the heating temperature during transfer by the transfer roller is set too high, then there may be a problem of deformation of the intermediate transfer body 12, and the like, whereas if, on the other hand, the heating temperature is too low, then there may be a problem of poor transfer characteristics.

Furthermore, if the recording medium 14 is heated in advance (pre-heated) to a temperature of 70° C. through 100° C. in the paper supply unit 28 before transfer, then the transfer characteristics are further improved, which is desirable. In the case of the present embodiment, a heater 50 is provided in the paper supply unit 28 as a preliminary heating device for the recording medium 14. The recording medium 14 which has been preliminarily heated by the heater 50 is conveyed by the nip of the paper supply rollers formed by the pair of adhesive rollers 52 and 53, and is thereby supplied to the transfer unit 26.

The composition of the paper supply unit 28 may be based on a mode using a magazine for rolled paper (continuous paper), or a mode in which paper is supplied by means of a cassette in which cut paper is stacked and loaded, instead of or in combination with magazine for rolled paper. In the case of a configuration in which rolled paper is used, a cutter is provided and the rolled paper is cut to a desired size by the cutter. Alternatively, it is also possible to provide a plurality of magazines and cassettes having different paper widths, paper qualities, and the like.

In the case of a configuration in which a plurality of types of recording medium can be used, it is desirable that an information recording medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

Concrete examples of the recording medium 14 used in the present embodiment are: normal paper (including high-grade paper and recycled paper), permeable media, such as special inkjet paper, non-permeable media or low-permeability media, such as coated paper, sealed paper having adhesive or a detachable label on the rear surface thereof, a resin film, such as an OHP sheet, or a metal sheet, cloth, wood or other types of media.

The recording medium 14 supplied to the transfer unit 26 is heated and pressurized at a prescribed temperature and a prescribed nip pressure by means of the transfer roller 36 and the pressurization roller 48, and the primary image on the intermediate transfer body 12 is transferred onto the recording medium 14. The recording medium 14 (printed object) which has passed through the transfer unit 26 is separated from the intermediate transfer body 12 by means of a separating hook 56, and is output to the exterior of the apparatus by means of a conveyance device (not illustrated). Although not illustrated in FIG. 1, a sorter which accumulates the printed objects separately according to print orders, is provided in the printed object output unit.

The recording medium 14 (printed object) which has been separated from the intermediate transfer body 12 may undergo a fixing step (not illustrated) before being output from the apparatus. The fixing unit is, for example, constituted by a heating roller pair in which the temperature and pressing force can be adjusted. By adding a fixing step of this kind, the polymer micro-particles contained in the ink form a film (namely, a thin film is formed by the polymer micro-particles fusing on the outermost surface of the image), and therefore the rub resistance and storage properties are increased yet further. The heating temperature in the fixing step is 80° C. through 130° C., the pressing force is desirably 1.0 MPa through 3.0 MPa, and these values are optimized in accordance with the temperature characteristics of the added polymer particles (e.g., the film forming temperature:MFT), and the like. Of course, since not only transfer characteristics but also film forming characteristics can be achieved in the transfer step in the transfer unit 26, then it is also possible to adopt a mode in which the fixing unit is omitted.

After the transfer step by the transfer unit 26, the intermediate transfer body 12 which has passed through the detachment unit formed by the separation hook 56 arrives at the first cleaning unit 30.

The first cleaning unit 30 is a device which cleans the intermediate transfer body 12 by using a cleaning liquid obtained by adding a surfactant, or the like, to water, such as distilled water or purified water, or solvent collected by the solvent removal unit 24. The first cleaning unit 30 is constituted by a cleaning liquid spraying unit 60 which sprays the cleaning liquid, a rotation brush 62 which rotates in a reverse direction with respect to the direction of conveyance of the intermediate transfer body while making contact with the image forming surface 12A of the intermediate transfer body 12, and a blade 64 which slides and wipes the surface of the intermediate transfer body 12. Furthermore, the heater 65 is disposed on the rear surface side of the intermediate transfer body 12 in the first cleaning unit 30. The first cleaning unit 30 principally functions as a device which cleans the intermediate transfer body 12 after completing image transfer to the recording medium 14.

Although the liquid cleaning step performed by using the cleaning liquid in the first cleaning unit 30 is appropriate for high-speed continuous processing, a small amount of residual material is liable to remain on the intermediate transfer body 12, and there are limits on the stable cleaning which can be achieved in the edge portions of the intermediate transfer body 12. Consequently, due to the accumulation of residual material with operation over a long period of time, then problems may occur, such as deterioration in the transfer characteristics and sensitivity, soiling of the apparatus, operational defects, and the like.

Otherwise, if hard dust particles, such as grit particles, become attached to the intermediate transfer body due to the inflow of external air used for cooling the interior of the apparatus, the generation of dust inside the apparatus, or the performance of maintenance work or the like, then this dust may enter in between the wiping members (the rotation brush 62 and the blade 64) during liquid cleaning by the first cleaning unit 30, and it may give rise to damage, such as scratch marks on the intermediate transfer body 12.

From the viewpoint of solving these problems, in the present embodiment, a second cleaning unit 32 is provided which uses an adhesive member (adhesive rollers 66 and 68 for removing dust). The second cleaning unit 32 is constituted by adhesive rollers 66 and 68 which can be moved to control the contact state and the separation state with respect to the surface (12A) of the intermediate transfer body 12, and a cleaning web (or adhesive belt) 70 which is able to make contact with these adhesive rollers 66 and 68. As illustrated in FIG. 1, this second cleaning unit 32 is disposed at a position opposing the tensioning roller 34A.

Either during non-image forming state (e.g., when the apparatus is started up, at standby or carrying out batch processing) or before liquid cleaning during image formation, the adhesive rollers 66 and 68 are rotated while making contact with the intermediate transfer body 12, and therefore the foreign material on the intermediate transfer body 12 becomes attached to the adhesive rollers 66 and 68, thereby removing the foreign material (dust) from the intermediate transfer body and thus cleaning the surface of the intermediate transfer body.

The foreign material which has become attached to the surface of the adhesive rollers 66 and 68 can be moved to the cleaning web (or the adhesive belt) 70, by separating the adhesive rollers 66 and 68 from the intermediate transfer body 12 and rotating the adhesive rollers 66 and 68 in contact with the cleaning web (or adhesive belt) 70. Consequently, it is possible to clean the surface of the adhesive rollers 66 and 68.

Furthermore, the composition of the principal part of the inkjet recording apparatus 10 will be described in more detail.

Compositional Example of Print Unit

As illustrated in FIG. 1, the print unit 22 comprises heads 22Y, 22M, 22C, 22K corresponding to the respective colors, provided in the sequence of yellow (Y), magenta (M), cyan (C), black (K), from the upstream side following the conveyance direction of the intermediate transfer body.

The ink storing and loading unit 74 is constituted by an ink tank which stores respective ink liquids which are supplied respectively to the heads 22Y, 22M, 22C and 22K. The ink tanks are connected to the respectively corresponding heads, via prescribed flow channels, and hence the respectively corresponding ink liquids are supplied to the respective heads. The ink storing and loading unit 74 comprises a warning device (for example, a display device or an alarm sound generator) for warning when the remaining amount of any liquid in the tank is low, and has a mechanism for preventing loading errors between different colors.

The inks are supplied from the respective ink tanks of the ink storing and loading unit 74 to the respective heads 22Y, 22M, 22C and 22K, and droplets of the respectively corresponding colored inks are ejected respectively onto the image forming surface 12A of the intermediate transfer body 12, from the respective heads 22Y, 22M, 22C and 22K.

Figure 2:
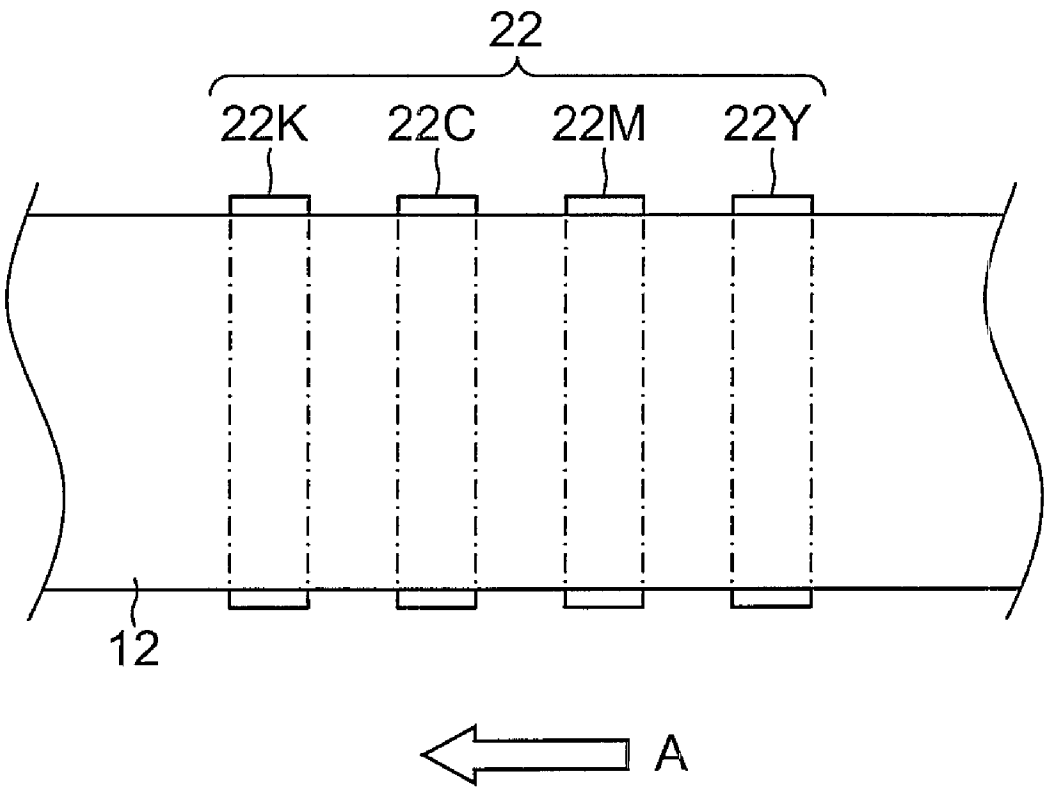
FIG. 2 is a principal plan diagram of the periphery of the print unit.

FIG. 2 is a diagram illustrating a plan diagram of the print unit 22. As illustrated in FIG. 2, the respective heads 22Y, 22M, 22C, 22K are each formed as full line type heads, which have a length corresponding to the maximum width of the image forming range of the intermediate transfer body 12, and comprises a nozzle row in which a plurality of nozzles for ejecting ink (not illustrated in FIG. 1, indicated by reference numeral 81 in FIGS. 3A and 3B) arranged through the full width of the image forming region, provided in the ink ejection surface of the head. The respective heads 22Y, 22M, 22C and 22K are disposed in a fixed position so as to extend in the direction perpendicular to the conveyance direction of the intermediate transfer body.

According to a composition where a full line head having a nozzle row covering the whole width of the intermediate transfer body 12 is provided for each type of ejection liquid, it is possible to form an image (primary image) on the image forming region of the intermediate transfer body 12, by performing just one operation of moving the intermediate transfer body 12 and the print unit 22 relatively in the conveyance direction of the intermediate transfer body 12 (the sub-scanning direction), (in other words, by means of one sub-scanning action). Therefore, it is possible to achieve a higher printing speed compared to a case which uses a serial (shuttle) type of head which moves back and forth reciprocally in the direction perpendicular to the conveyance direction of the intermediate transfer body (main scanning direction; see FIG. 2), and hence it is possible to improve the print productivity.

Although a configuration with the four standard colors of C, M, Y and K is described in the present embodiment, the combinations of the ink colors and the number of colors are not limited to those. Light and/or dark inks and special color inks can be added as required.

For example, a configuration is possible in which ink heads for ejecting light-colored inks, such as light cyan and light magenta, are added, and there is no particular restriction on the arrangement sequence of the heads of the respective colors.

Structure of the Head

Next, the structure of respective heads will be described. The heads 22Y, 22M, 22C and 22K of the respective ink colors have the same structure, and a reference numeral 80 is hereinafter designated to any of the heads.

Figure 3A:
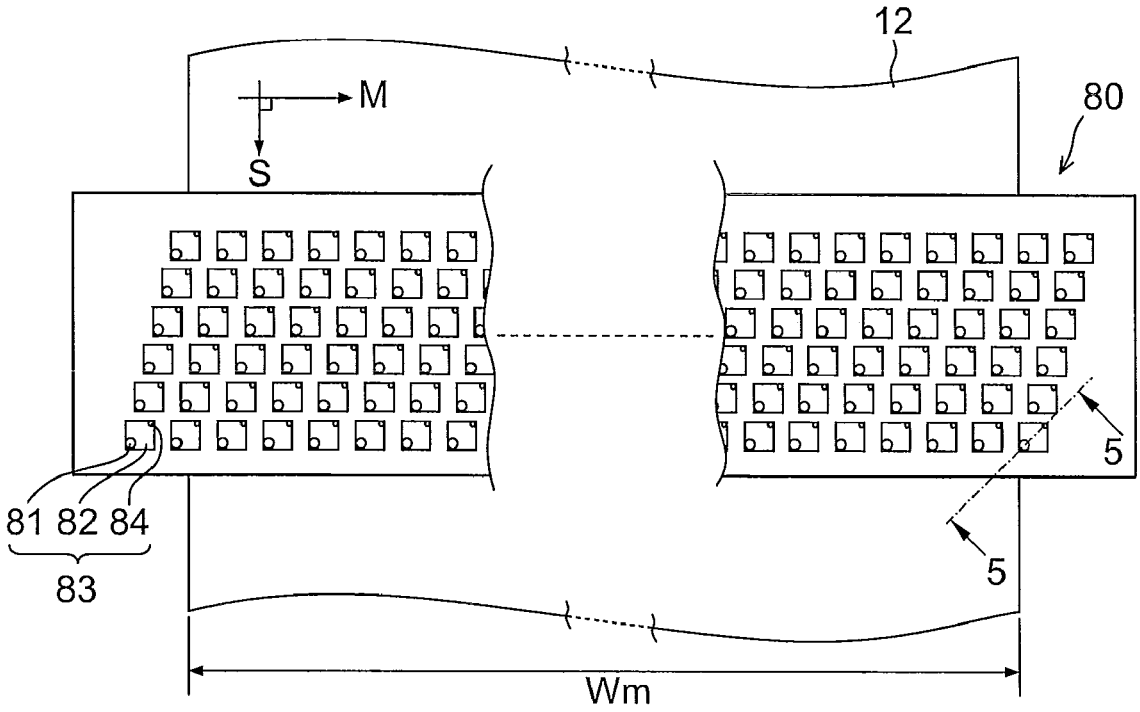
FIGS. 3A and 3B are plan view perspective diagrams illustrating the internal structure of a head.
Figure 3B:
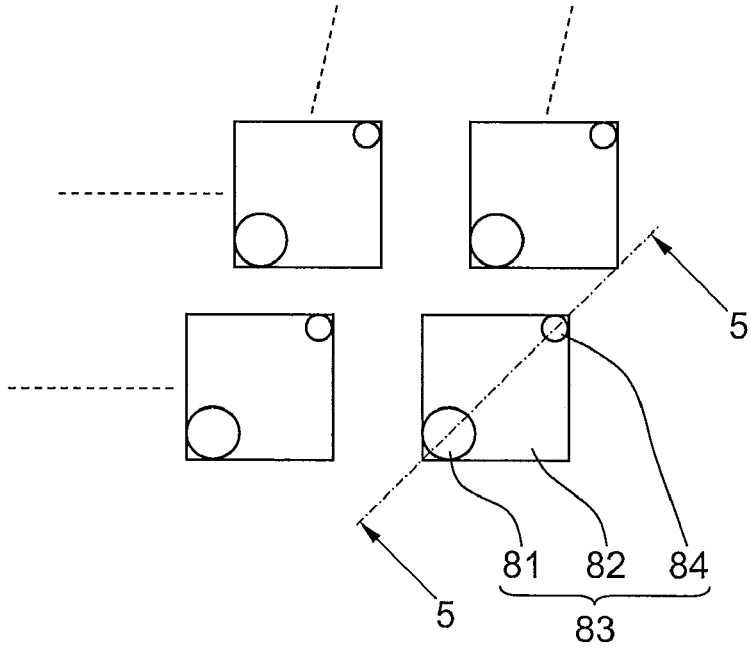

FIG. 3A is a plan view perspective diagram illustrating an example of the composition of a head 80, and FIG. 3B is an enlarged diagram of a portion of same. In order to achieve a high density of the dot pitch printed onto the surface of the recording medium 14, it is necessary to achieve a high density of the nozzle pitch in the head 80. As illustrated in FIGS. 3A and 3B, the head 80 according to the present embodiment has a structure in which a plurality of ink chamber units (liquid droplet ejection elements forming recording element units) 83, each including a nozzle 81 forming an ink ejection port, a pressure chamber 82 corresponding to the nozzle 81, and the like, are disposed (two-dimensionally) in the form of a staggered matrix, and hence the effective nozzle interval (the projected nozzle pitch) as projected in the lengthwise direction of the head (the direction perpendicular to the conveyance direction of the intermediate transfer body 12) is reduced (high nozzle density is achieved).

Figure 4:
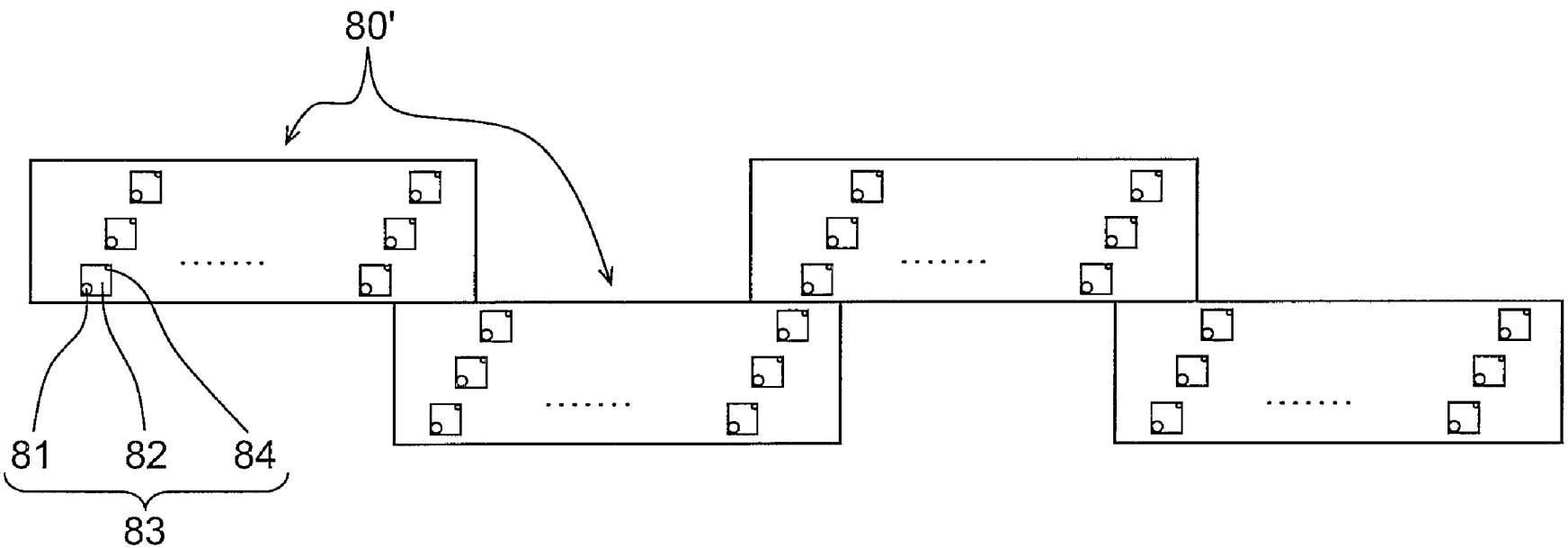
FIG. 4 is a plan diagram illustrating a further example of the composition of a head.

The mode of composing one or more nozzle rows through a length corresponding to the full width of the image forming region of the intermediate transfer body 12 in the direction, (in other words, in the direction indicated by arrow M in FIGS. 3A and 3B), substantially perpendicular to conveyance direction (arrow S in FIGS. 3A and 3B) of the intermediate transfer body 12, is not limited to the example illustrated in FIGS. 3A and 3B. For example, instead of the composition in FIG. 3A, as illustrated in FIG. 4, a line head having nozzle rows of a length corresponding to the entire width of the image forming region of the intermediate transfer body 12 can be formed by arranging and combining, in a staggered matrix, short head modules 80' each having a plurality of nozzles 81 arrayed in a two-dimensional fashion.

As illustrated in FIGS. 3A and 3B, the planar shape of the pressure chamber 82 provided corresponding to each nozzle 81 is substantially a square shape, and an outlet port to the nozzle 81 is provided at one of the ends of a diagonal line of the planar shape, while an inlet port (supply port) 84 for supplying ink is provided at the other end thereof. The shape of the pressure chamber 82 is not limited to that of the present embodiment and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 5:
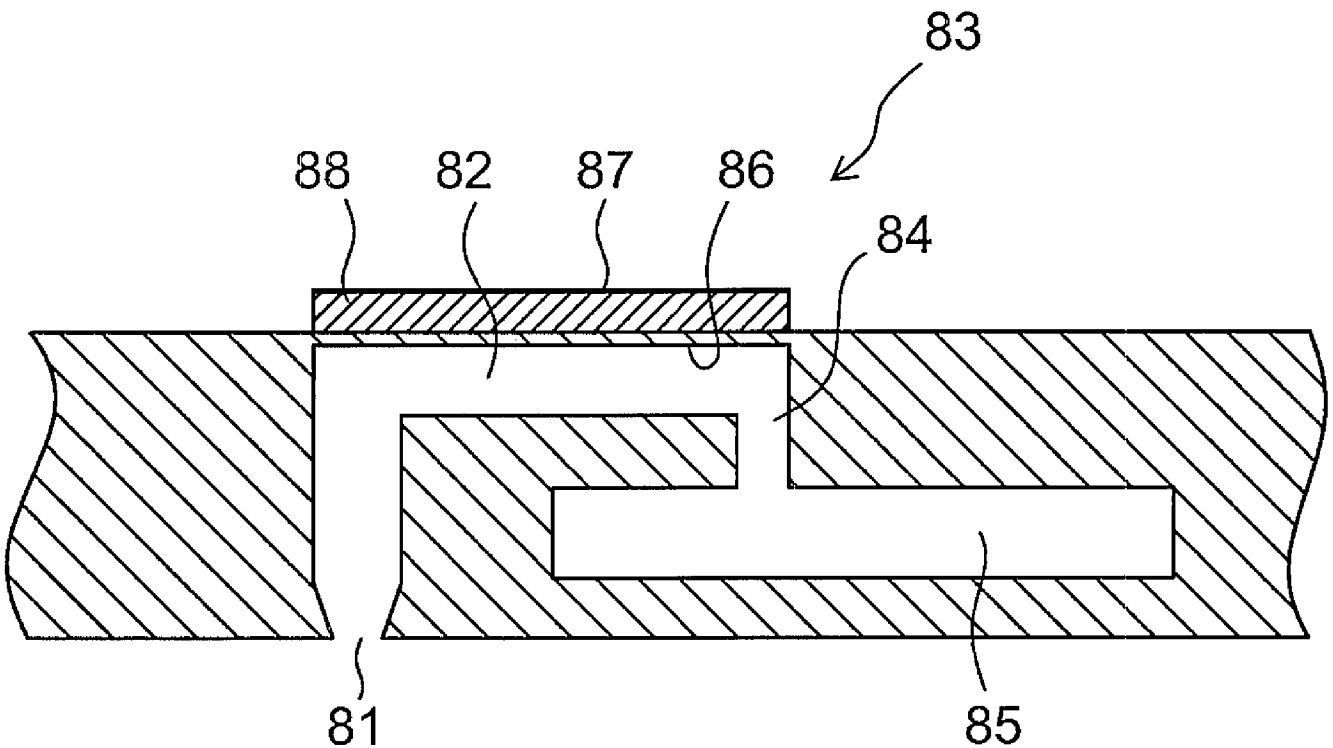
FIG. 5 is a cross-sectional diagram along line 5-5 in FIGS. 3A and 3B.

FIG. 5 is a cross-sectional diagram (along line 5-5 in FIGS. 3A and 3B) illustrating the three-dimensional composition of the liquid droplet ejection element of one channel which forms a recording element unit in the head 80 (an ink chamber unit corresponding to one nozzle 81).

As illustrated in FIG. 5, each pressure chamber 82 is connected to a common flow passage 84 via the supply port 85. The common flow channel 85 is connected to an ink tank (not illustrated in FIG. 5, but equivalent to reference numeral 74 in FIG. 1), which is a base tank that supplies ink, and the ink supplied from the ink tank is supplied through the common flow channel 85 to the pressure chambers 82.

An actuator 88 provided with an individual electrode 87 is bonded onto a pressure plate (a diaphragm that also serves as a common electrode) 86 which forms the surface of one portion (in FIG. 5, the ceiling) of the pressure chambers 82. When a drive voltage is applied to the individual electrode 87 and the common electrode, the actuator 88 deforms, thereby changing the volume of the pressure chamber 82. This causes a pressure change which results in the ink being ejected from the nozzle 81. For the actuator 88, it is possible to adopt a piezoelectric element using a piezoelectric body, such as lead zirconate titanate, barium titanate, or the like. When the displacement of the actuator 88 returns to its original position after ejecting ink, the pressure chamber 85 is replenished with new ink from the common flow channel 84, via the supply port 82.

By controlling the driving of the actuators 88 corresponding to the nozzles 81 in accordance with the dot data generated from the input image by a digital half-toning process, it is possible to eject ink droplets from the nozzles 81. By controlling the ink ejection timing from the nozzles 81 in accordance with the speed of conveyance of the intermediate transfer body 12, while conveying the intermediate transfer body 12 in the sub-scanning direction at a uniform speed, it is possible to record a desired image (here, a primary image before transfer) onto the intermediate transfer body 12.

Figure 6:
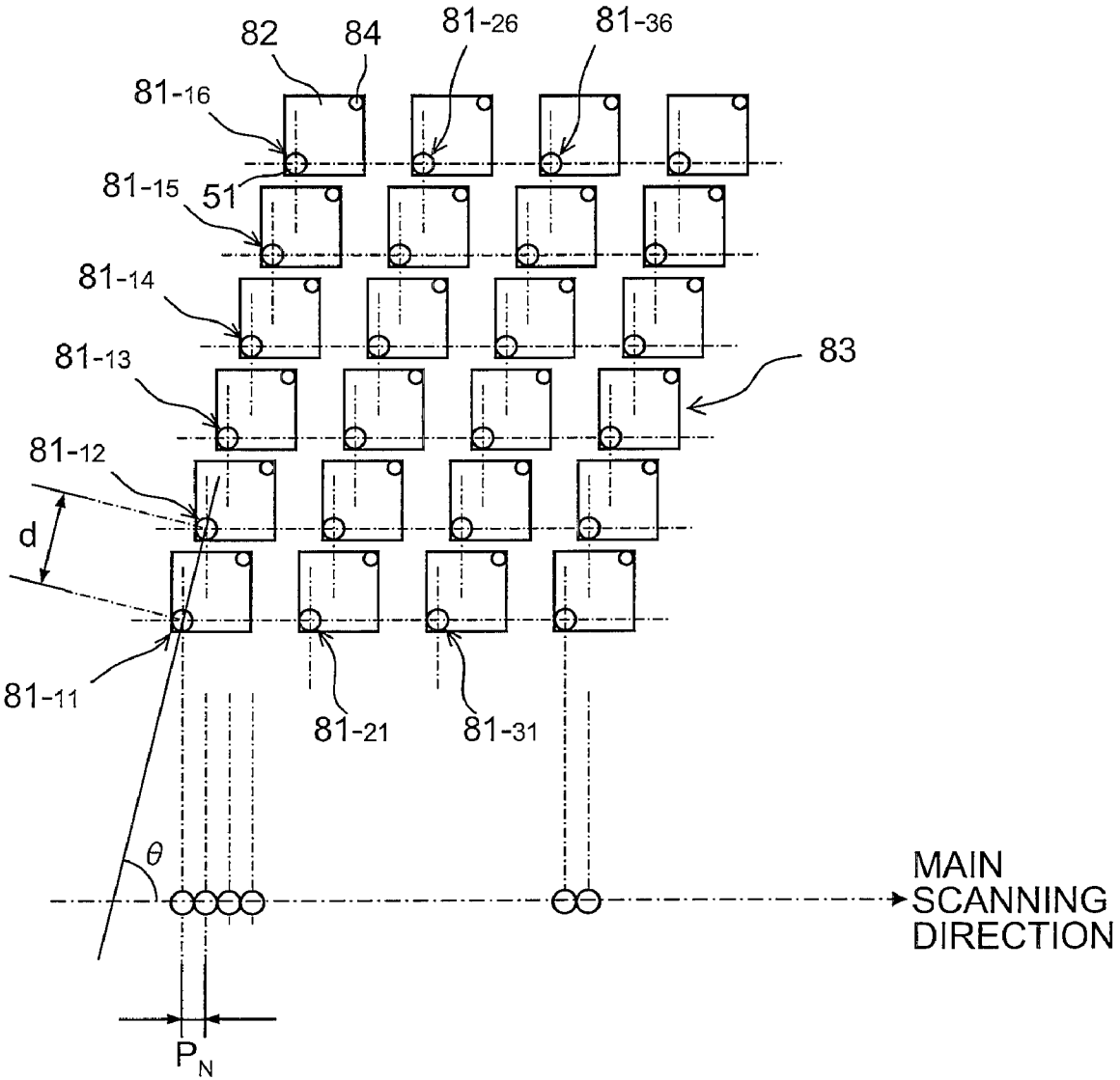
FIG. 6 is a plan diagram illustrating an example of the arrangement of nozzles in a head.

As illustrated in FIG. 6, the high-density nozzle head according to the present embodiment is achieved by arranging a plurality of ink chamber units 83 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 83 are arranged at a uniform pitch d in line with a direction forming an angle of θ with respect to the main scanning direction, the pitch P of the nozzles projected (normally) to an alignment in the main scanning direction is $d \times \cos\theta$, and hence it is possible to treat the nozzles 81 as if they are arranged linearly at a uniform pitch of P. By adopting a composition of this kind, it is possible to achieve higher density of the effective nozzle rows when projected to an alignment in the main scanning direction.

In a full-line head comprising rows of nozzles that have a length corresponding to the entire width of the image record-able width, the "main scanning" is defined as printing one line (a line formed of a row of dots, or a line formed of a plurality of rows of dots) in the width direction of the intermediate transfer body 12 (the direction perpendicular to the conveyance direction of the intermediate transfer body 12) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 81 arranged in a matrix such as that illustrated in FIG. 6 are driven, the main scanning according to the above-described (3) is preferred. More specifically, the nozzles 81-11, 81-12, 81-13, 81-14, 81-15 and 81-16 are treated as a block (additionally; the nozzles 81-21, . . . , 81-26 are treated as another block; the nozzles 81-31, . . . , 81-36 are treated as another block; . . . ); and one line is printed in the width direction of the intermediate transfer body 12 by sequentially driving the nozzles 81-11, 81-12, . . . , 81-16 in accordance with the conveyance velocity of the intermediate transfer body 12.

On the other hand, "sub-scanning" is defined as to repeatedly perform printing of one line (a line formed of a row of dots, or a line formed of a plurality of rows of dots) formed by the main scanning, while moving the fill-line head and the intermediate transfer body 12 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the intermediate transfer body 12 is called the sub-scanning direction and the direction perpendicular to same is called the main scanning direction. In implementing the present invention, the arrangement of the nozzles is not limited to that of the example illustrated.

Moreover, a method is employed in the present embodiment where an ink droplet is ejected by means of the deformation of the actuator 88, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Preparation of Aggregation Treatment Agent

<Treatment Liquid Example 1>

A treatment liquid (Example 1) is prepared according to the composition illustrated in Table 1. Thereupon, the physical properties of the treatment liquid (Example 1) thus obtained were measured, and the pH was 3.6, the surface tension was 28.0 mN/m, and the viscosity was 3.1 mPa·s.

TABLE 1

| Material | Weight % |
|---|---|
| 2-pyrrolidone-5-carboxylic acid (made by Tokyo Chemical Industry Co., Ltd.) | 10 |
| Lithium hydroxide-hydride (made by Wako Pure Chemical Industries, Ltd.) | 2 |
| Olfine E1010 (made by Nissin Chemical Industry Co., Ltd.) | 1 |
| Deionized water | 87 |

<Treatment Liquid Example 2>

Moreover, a treatment liquid (Example 2) containing a surfactant is prepared according to the composition illustrated in Table 2. Thereupon, the physical properties of the treatment liquid (Example 2) thus obtained were measured, and the pH was 3.5, the surface tension was 18.0 mN/m, and the viscosity was 10.1 mPa·s.

TABLE 2

| Material | Weight % |
|---|---|
| 2-pyrrolidone-5-carboxylic acid (made by Tokyo Chemical Industry Co., Ltd.) | 10 |
| Lithium hydroxide-hydride (made by Wako Pure Chemical Industries, Ltd.) | 2 |
| Olfine E1010 (made by Nissin Chemical Industry Co., Ltd.) | 1 |
| Fluorine surfactant 1 | 3 |
| Deionized water | 84 |

The chemical formula of the fluorine surfactant 1 used in Table 2 is as follows.

Chemical Formula 1

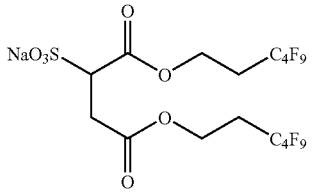

Moreover, when the viscosity of the treatment liquid (Example 2) was investigated after leaving the treatment liquid for three days, the viscosity rose from 10.1 mPa·s to 39.2 mPa·s, and the liquid could be applied without the occurrence of a beading effect, even onto a silicone rubber, fluorine rubber or a fluorine elastomer (SIFEL 600 series, or the like, made by Shin-etsu Chemical Co., Ltd.) In an additional trial, the temperature/viscosity characteristics were investigated. Although the viscosity declined when the liquid was heated, if cooled straight away, the viscosity only rose by about 10 mPa·s, but when measured again after three days, the viscosity had returned to a high viscosity similar to that before heating.

Although the mechanism of this effect is not fully clear, it is thought to be due to the occurrence of entanglement with the surfactant due to temporal change in the state of dispersion after preparation of the liquid. When the temperature rises, the entanglement is released and the viscosity declines, and even when the temperature falls again, entanglement does not occur immediately, but rather progresses over time, causing the viscosity to rise again.

By utilizing these characteristics, it is possible to achieve an inkjet recording apparatus of an intermediate transfer type which has excellent material manufacturability, such as filtering properties, excellent applicability of liquid onto the intermediate transfer body 12, and excellent aggregation reactivity, transferability and cleaning properties, due to reduction in the viscosity of the liquid as a result of heating during the process.

Preparation of Ink

An example of the preparation of an ink used in the present embodiment is described below.

<Preparation of (Polymer Dispersion) Cyan Ink>

A solution comprising 6 parts by weight of styrene, 11 parts by weight of stearyl methacrylate, 4 parts by weight of styrene macromer AS-6 (made by Toa Gosei Co., Ltd.), 5 parts by weight of "Premmer" PP-500 (made by NOF Corp.), 5 parts by weight of methacrylic acid, 0.05 parts by weight of 2-mercaptoethanol, and 24 parts by weight of methylethyl ketone was prepared in a reaction vessel.

On the other hand, a mixed solution was prepared by introducing, into a titration funnel, 14 parts by weight of styrene, 24 parts by weight of stearyl methacrylate, 9 parts by weight of styrene macromer AS-6 (made by Toa Gosei), 9 parts by weight of "Premmer" PP-500 (made by NOF Corp.), 10 parts by weight of methacrylic acid, 0.13 parts by weight of 2-mercapotoethanol, 56 parts by weight of methylethyl ketone, and 1.2 parts by weight of 2,2'-azobis(2,4-dimethyl valeronitrile).

Thereupon, the mixed solution inside the reaction vessel was raised to a temperature of 75° C. while being agitated, in a nitrogen atmosphere, and the mixed solution in the titration funnel was gradually added by titration over a period of one hour. When two hours had passed after the end of titration, a solution obtained by dissolving 1.2 parts by weight of 2,2'-azobis(2,4-dimethyl valeronitrile) in 12 parts by weight of methylethyl ketone was added by titration over a period of 3 hours, and the mixture was matured for a further two hours at 75° C. and two hours at 80° C., thereby yielding a polymer dispersant solution.

A portion of the polymer dispersant solution thus obtained was separated by removing the solvent, and the resulting solid component was diluted to 0.1 wt % with tetrahydrofuran, and then measured with a high-speed GPC (gel permeation chromatography) apparatus HLC-8220GPC, using three sequential columns: TSKgel Super HZM-H, TSKgel Super HZ4000, TSKgel Super HZ2000. The weight-average molecular weight was 25,000, when indicated as the weight of a polystyrene molecule.

5.0 g, by solid conversion, of the obtained polymer dispersant, 10.0 g of the cyan pigment, Pigment Blue 15:3 (made by Dainichiseika Color and Chemicals Mfg.), 40.0 g of methylethyl ketone, 8.0 g of 1 mol/L sodium hydroxide, 82.0 g of deionized water, and 300 g of 0.1 mm zirconia beads were supplied to a vessel, and dispersed for 6 hours at 1000 rpm in a "Ready Mill" dispersion machine (made by IMEX Co., Ltd.). The dispersion thus obtained was condensed at reduced pressure in an evaporator until the methyl ethyl ketone had been sufficiently removed, and the pigment density becomes 10%. The pigment particle size of the cyan dispersion liquid thus obtained was 77 nm.

Using this cyan dispersion, an ink was prepared to achieve the composition illustrated in Table 3, and the prepared ink was then passed through a 5 μm filter to remove coarse particles, thereby obtaining a cyan ink (C1-1). Thereupon, the physical properties of the cyan ink C1-1 thus obtained were measured, and the pH was 9.0, the surface tension was 32.9 mN/m, and the viscosity was 3.9 mPa·s.

TABLE 3

| Material | Weight % |
|---|---|
| Cyan pigment (Pigment Blue 15:3) made by Dainichiseika Color and Chemicals Mfg Co., Ltd. | 4 |
| Polymer dispersant | 2 |
| Latex LX-2 | 8 |
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 65 |

Magenta, yellow and black inks were also prepared in a similar fashion to the above.

Additional Polymer

Particles of a polymer resin or the like (polymer particles, latex), are added to the treatment liquid (aggregation treatment liquid) and ink described above, as appropriate. In the treatment liquid, it is desirable to introduce particles having a particle size of 1 μm through 5 μm and a melting point of 60° C. through 120° C., in order to stabilize the coloring material and improve transfer performance, whereas in the ink, it is desirable to introduce particles having a particle size of 1 μm or less and a glass transition temperature of 40° C. through 60° C., at a ratio of 1% through 5%, in order to fix the image. A compositional example is illustrated in Table 4.

TABLE 4

| Category | Composition | Particle diameter [μm] | Tg [° C.] | MFT [° C.] | Tm [° C.] |
|---|---|---|---|---|---|
| Aggregation treatment agent (LX-1) | Low-molecular-weight ethylene | 4 | — | — | 110 |
| | Low-molecular-weight ethylene | 1 | — | — | 110 |
| | Paraffin wax | 0.3 | — | — | 66 |
| Ink (LX-2) | Acrylic | 0.12 | 47 | 65 | — |
| | Styrene acrylic | 0.07 | 49 | 46 | — |

Tg: glass transition temperature;
Tm: melting point

Composition of Treatment Liquid Application Unit

<First Compositional Example of Liquid Application Apparatus>

Figure 7:
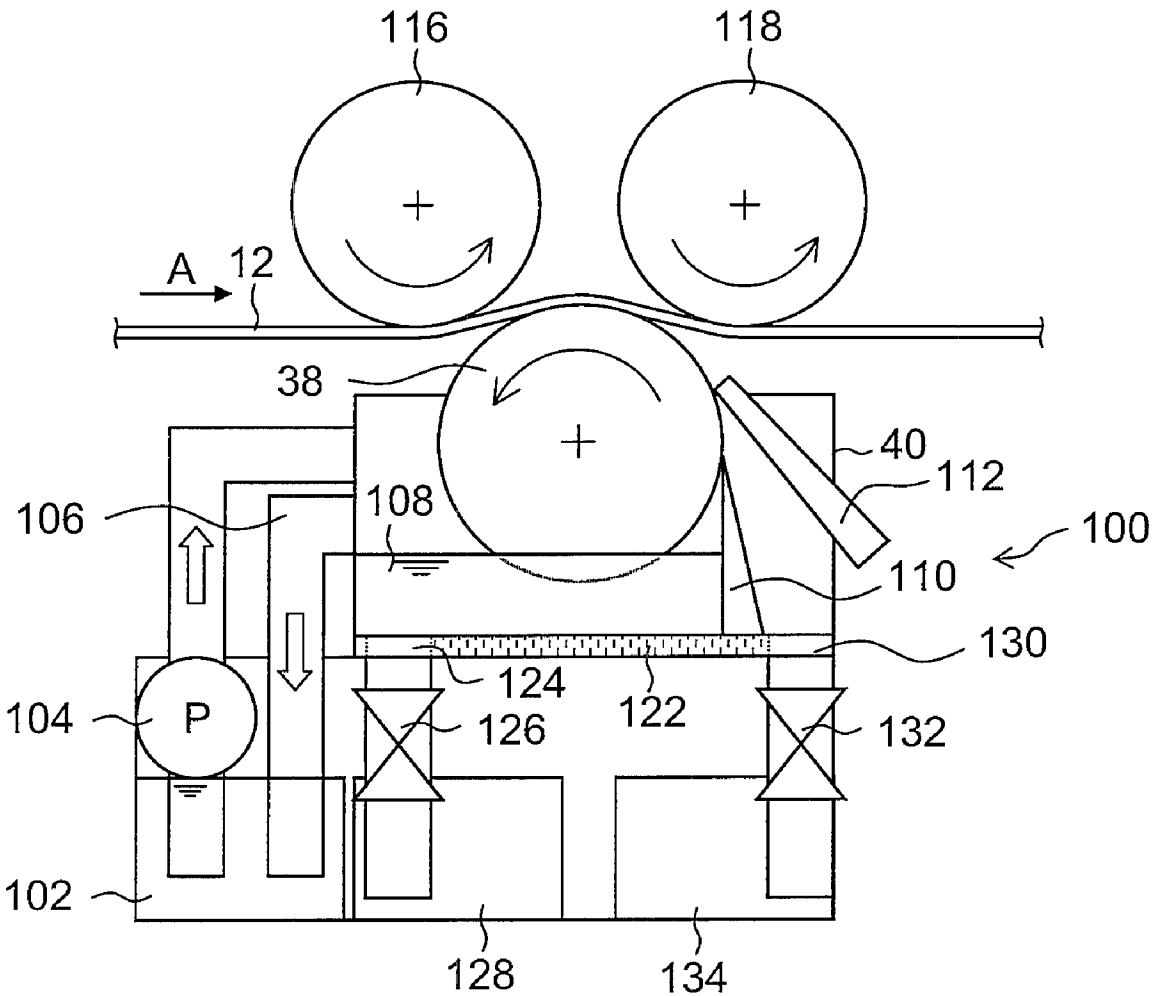
FIG. 7 is a compositional diagram illustrating a first embodiment of a liquid application apparatus used in a treatment liquid application unit.

FIG. 7 is a compositional diagram illustrating a liquid application apparatus according to a first compositional example used in the treatment liquid coating unit 16. In FIG. 7, the intermediate transfer body 12 is conveyed from the left-hand side toward the right-hand side (in the direction indicated by the arrow A in FIG. 7). The liquid application apparatus 100 illustrated in FIG. 7 is an apparatus which applies treatment liquid selectively to a prescribed region of the intermediate transfer body 12, by pressing the spiral roller 38 formed with spiral grooves against the intermediate transfer body 12 which is being conveyed, and driving the spiral roller 38 to rotate at a prescribed uniform speed in the opposite direction (namely, in the counter-clockwise direction in FIG. 7) of the direction of conveyance of the intermediate transfer body 12. In the present embodiment, the liquid application apparatus 100 controls the application region in conveyance direction of the intermediate transfer body.

In the liquid application apparatus 100 according to the present embodiment, the treatment liquid is suctioned up by a supply pump 104 from a treatment liquid supply tank 102 which stores the treatment liquid, and the treatment liquid is introduced into a treatment liquid container 40. A drain flow channel 106 is provided at a prescribed height above the lower surface of the treatment liquid container 40, and since overflowing liquid is returned to the treatment liquid supply tank 102 via the drain flow channel 106, then the height of the liquid surface of the treatment liquid 108 in the treatment liquid container 40 is kept at a uniform height.

Figure 8:
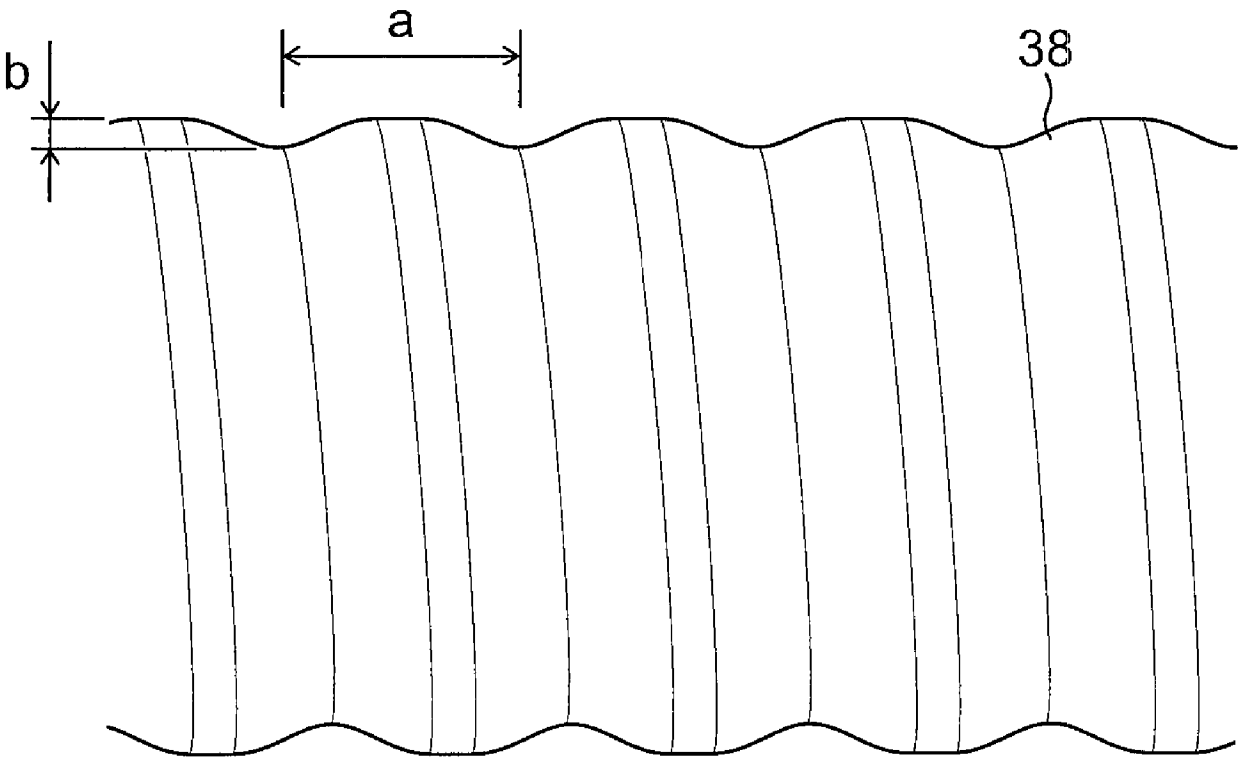
FIG. 8 is an enlarged diagram of the outer circumferential surface of a spiral roller.

The spiral roller 38 is an application roller having grooves (depressions) formed on the outer circumferential surface thereof substantially following the direction of rotation (see FIG. 8), by form rolling using a die or by wrapping a wire about the roller, and the spiral roller 38 has a length (width direction) equal to or greater than the width dimension of the application receiving surface of the intermediate transfer body 12. For the spiral roller 38, it is also possible to use an application bar or a commonly known wire bar, such as a "D-Bar" (tradename) made by OSG Corporation, for example. The shape, pitch a and depth b of the grooves, and the like (see FIG. 8) in the spiral roller 38 are selected appropriately in accordance with the amount of liquid that is to be applied (the thickness of the liquid film after application). For example, in the case of the liquid application apparatus 100 according to the present embodiment, a suitable spiral roller is one having a pitch of a=0.08 mm through 0.2 mm, and a groove depth of b=5 μm through 20 μm.

Figure 9A:
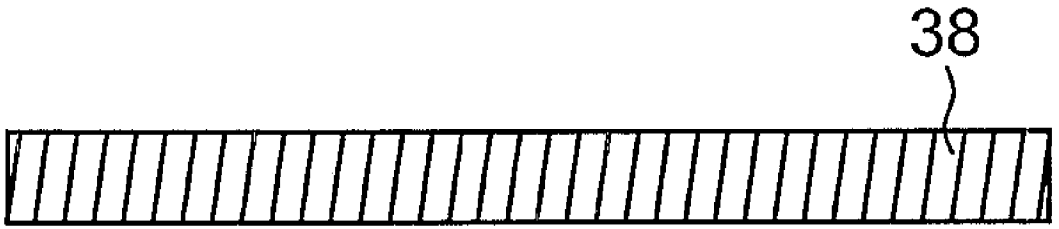
FIGS. 9A through 9C are general schematic drawings illustrating the shape of grooves formed in the outer circumferential surface of a spiral roller.
Figure 9B:
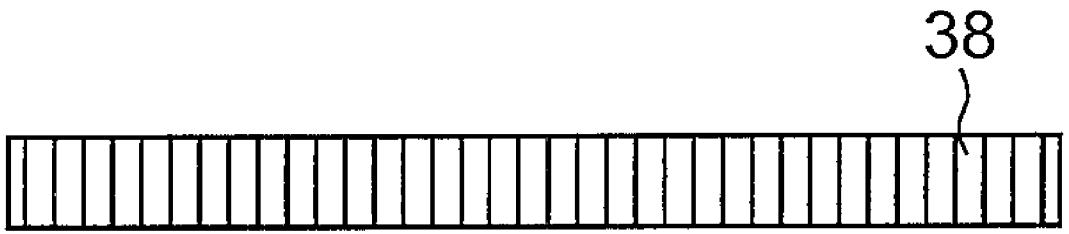
Figure 9C:
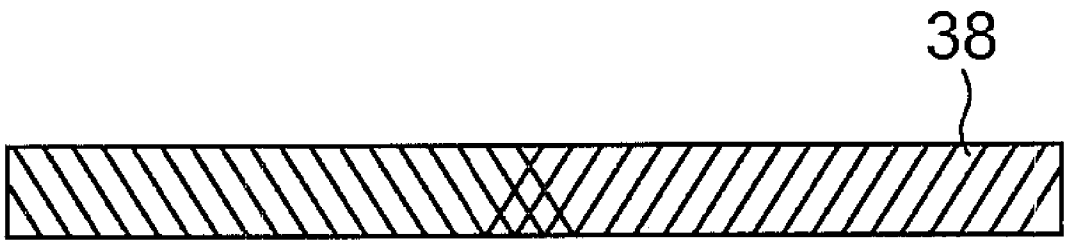
Figure 10A:
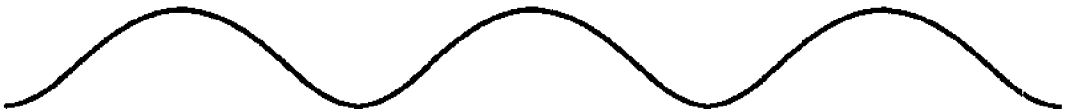
FIGS. 10A through 10D are general schematic drawings illustrating the cross-sectional shape of the outer circumferential surface of a spiral roller.
Figure 10B:
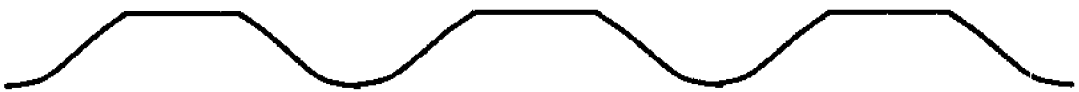
Figure 10C:
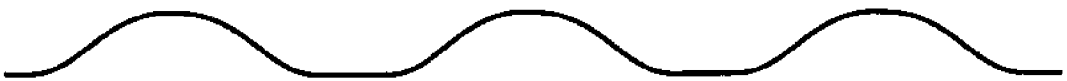
Figure 10D:
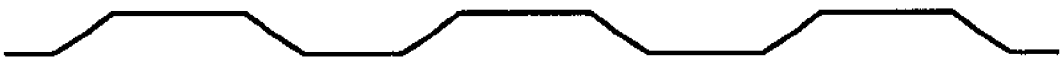

FIGS. 9A through 9C are schematic drawings illustrating the shape of the grooves of the spiral roller 38. In FIGS. 9A through 9C, in order to aid understanding of the shape of the grooves, the groove shape and the groove pitch, and the like, are depicted in a simplified fashion. As illustrated in FIGS. 9A through 9C, the groove shape may be, apart from a spiral shape as illustrated in FIG. 9A, an independent groove configuration (FIG. 9B), a left/right groove configuration (FIG. 9C), or a multi-column spiral configuration (not illustrated), or the like. In particular, if independent grooves are used, then it is possible to suppress flow of liquid in the breadthways direction of the application receiving medium (intermediate transfer body 12), and furthermore, if left/right grooves are used, then it is possible to suppress wrinkling of the application receiving medium (intermediate transfer body 12). A conceivable modification of a left/right spiral configuration is an example where one spiral roller 38 is divided into a spiral roller having a leftward spiral shape formed in the outer circumferential surface and a spiral roller having a rightward spiral shape formed in the outer circumferential surface.

FIGS. 10A through 10D are schematic drawings illustrating the cross-sectional shape of the outer circumferential surface of the spiral roller 38. As illustrated in FIGS. 10A through 10D, possible examples of the cross-sectional shape of the outer circumferential surface are, apart from the S-shaped curved surface illustrated in FIG. 10A, a shape with flattened peaks (FIG. 10B), a shape with flattened troughs (FIG. 10C), or a shape which has flattened peaks and flattened troughs (FIG. 10D), or the like. In particular, if the peak sections are flattened, then the wear resistance properties are improved, and furthermore, if the trough sections are flattened, then a large amount of liquid enters into the grooves and hence a large amount of liquid can be made to adhere to the outer circumferential surface of the roller.

As indicated in FIG. 7, a portion of the spiral roller 38 (the portion on the lower side in FIG. 7) is immersed into the treatment liquid 108 inside the treatment liquid container 40, and therefore the treatment liquid enters inside the grooves and treatment liquid adheres to the outer circumferential surface of the roller (application liquid supply step).

A squeegee blade 110, which is a squeegee member, is erected inside the treatment liquid container 40 as a device for scraping surplus treatment liquid from the outer circumferential surface of the spiral roller 38. Here, the surplus amount of treatment liquid is the portion of the treatment liquid adhering to the outer circumferential surface of the spiral roller 38 which is attached to portions outside the grooves formed in the spiral roller 38. The front end portion of the squeegee blade 110 is disposed so as to contact the spiral roller 38, and this front end portion is biased in a direction which presses against the circumferential surface of the spiral roller 38. This biasing force may be caused by the elastic deformation of the squeegee blade 110 itself, or it may be applied from an external source by using a spring or other biasing member (not illustrated).

By scraping the surplus treatment liquid with the squeegee blade 110, while rotating the spiral roller 38 which has been immersed in the treatment liquid 108, only the treatment liquid which is held inside the grooves escapes the action of the squeegee blade 110 (squeegee step).

Furthermore, in the present embodiment, from the viewpoint of controlling the range of application of the treatment liquid in the direction of conveyance of the intermediate transfer body 12, in the liquid application apparatus 100, a main blade 112 forming a blade member is disposed on the downstream side of the squeegee blade 110 in terms of the direction of rotation of the spiral roller 38, and is controlled so as to abut against and separate from the outer circumferential surface of the spiral roller 38. By abutting the main blade 112 against a partial range of the outer circumferential surface of the spiral roller 38, it is possible to remove treatment liquid that has been applied to the outer circumferential surface including the treatment liquid inside the grooves of the spiral roller 38 (blade abutting step).

By controlling the range in which the treatment liquid is removed from the spiral roller 38 by the main blade 112, it is possible to control the range of application of the treatment liquid to the intermediate transfer body 12 (the range in the conveyance direction of the intermediate transfer body) (blade abutting and separation control step). More specifically, the main blade 112 is abutted against the outer circumferential surface of the spiral roller 38 in the region corresponding to the non-image forming portion on the intermediate transfer body 12, and the main blade 112 is separated from the outer circumferential surface of the spiral roller 38 in the region corresponding to the image forming portion on the intermediate transfer body 12. In this way, treatment liquid is not applied to the non-image forming portion on the intermediate transfer body 12, and it is possible to apply treatment liquid selectively, to the image forming portion only (see (a) of FIG. 21).

According to this mode, it is possible to control application of the treatment liquid onto unwanted regions, and even when the image is transferred onto the cut paper, for example, in a non-continuous fashion, it is possible to prevent the aggregation treatment liquid from adhering on the pressurization roller 48. Consequently, the operation of the apparatus is stabilized, and the reliability over time in terms of soiling and corrosion is improved.

If the outer circumferential surface of the spiral roller 38 is processed by a form rolling dice having an S-shaped cross-section, it is possible to form smoother grooves compared to wire wrapping. A form rolling process has excellent productivity and also makes it possible to achieve wide-ranging cost reductions in comparison with an engraving process for a gravure roller (also called an anilox roller or precision roller).

The material of the spiral roller 38 is generally a steel material which has been subjected to a hardening treatment, such as a hard chrome plating, but if the treatment liquid is a corrosive liquid, such as an acidic liquid, then desirably a hard acid-resistant material, such as SUS304 or SUS316, or the like, is used. Furthermore, a material such as SUS304 or SUS316, or the like, is desirable from the viewpoint of ensuring the wetting properties of the liquid, such as the treatment liquid (Example 2) illustrated in Table 2 described above.

Moreover, if the main blade 112 is made of an elastic body having a hardness of approximately 30° through 80°, such as urethane rubber or fluorine rubber, and if the main blade is applied at a pressure of 300 gf through 1500 gf (=2.9 N through 14.7 N)/300 mm, then since the outer circumference of the spiral roller 38 has fine grooves following the direction of rotation formed at a pitch a=0.08 mm through 0.2 mm and a groove depth b=5 μm through 20 μm, the main blade 112 can be abutted so as to adapt to the grooves of the spiral roller 38. By this means, it is possible to remove the liquid on the outer circumferential surface of the spiral roller 38 in a reliable fashion, and since the main blade 112 which forms a movable part is light in weight, then high-speed response is possible.

Liquid having a viscosity of approximately 20 mPa·s through 100 mPa·s including a surfactant, such as the treatment liquid (Example 2) illustrated in Table 2, has good lubricating effects and good applicability with respect to the spiral roller 38, the squeegee blade 110 and the main blade 112. Furthermore, in the present embodiment, such liquid is desirable since it does not produce a beading effect, even on the silicone rubber, fluorine rubber or fluorine elastomer (SIFEL 600 series, or the like, made by Shin-etsu Chemical Co., Ltd.) which coats the intermediate transfer body 12, and therefore the liquid can be applied to the intermediate transfer body 12 in a reliable fashion.

Employing the liquid application apparatus 100 according to the present embodiment for the application of treatment liquid to an intermediate transfer body 12 which is undergoing liquid cleaning such as that described below is desirable in that it enables the contact friction between the spiral roller 38 and the intermediate transfer body 12 to be reduced, due to the residual component of liquid cleaning, even in cases where the treatment liquid is removed by the main blade 112.

Furthermore, even in cases where a treatment liquid or permeation suppression agent, or the like, is applied to the intermediate transfer body 12, it is possible to reduce the contact friction between the spiral roller 38 and the intermediate transfer body 12 to be reduced by means of a lubricating effect, similarly to the residual component of the liquid cleaning described above.

Figure 11:
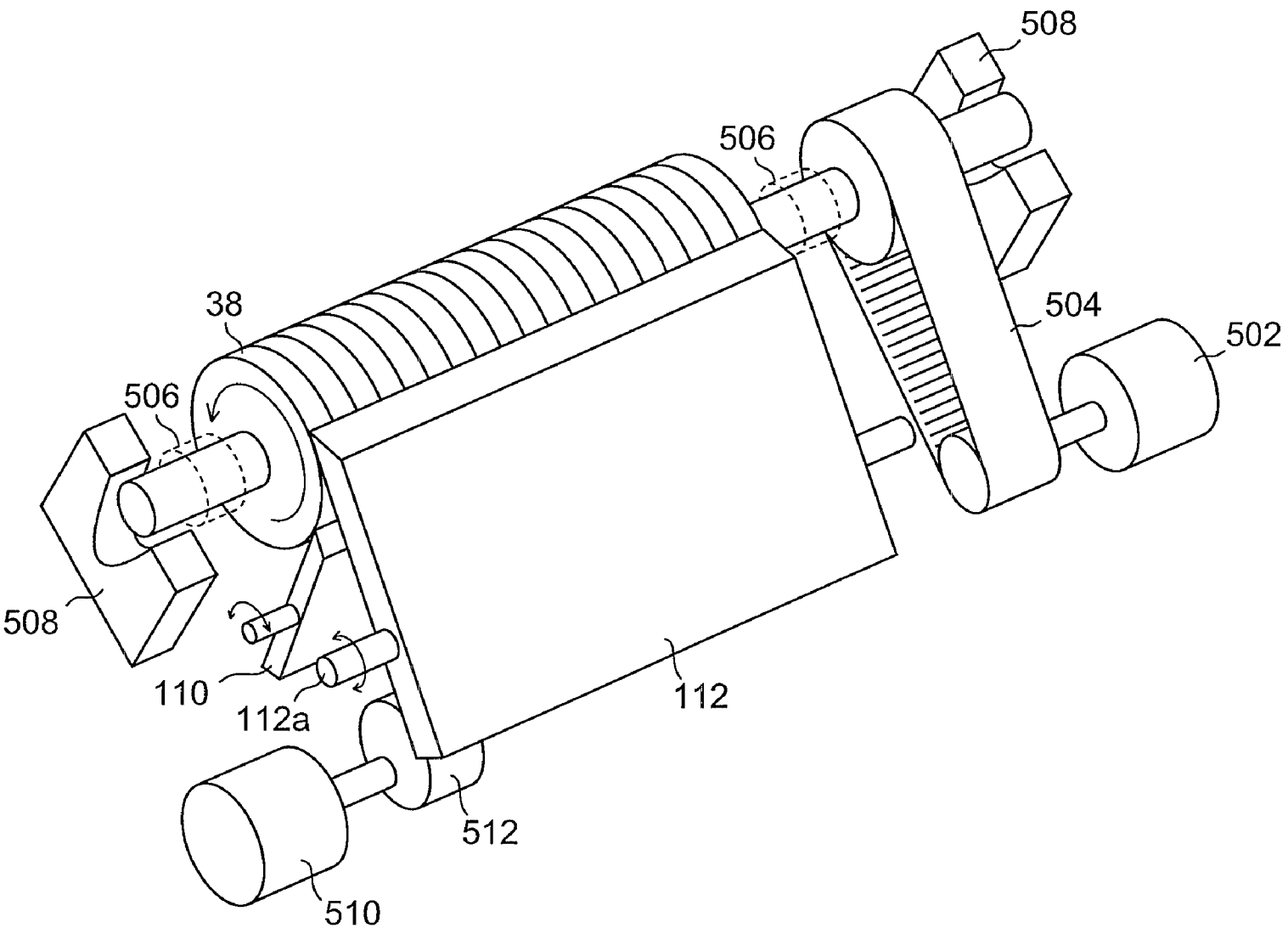

Moreover, FIG. 11 is a perspective diagram illustrating an approximate view of a movement mechanism (abutment/separation mechanism) and a rotational drive device of the spiral roller 38 which constitutes the liquid application apparatus 100, and the rotational mechanisms of the squeegee blade 110 and main blade 112, and the like.

As illustrated in FIG. 11, one possible mode of a rotational drive device of the spiral roller 38 is a combination of a motor 502 and a wound transmission device, such as a timing belt 504, or the like. However, the composition is not limited to this, and it is also possible to use direct drive by an inverter motor (coupled axle), or a combination of motors of various types and a reducing gear device, or the like. Axle bearings 506 are provided on the rotating axle of the spiral roller 38.

As illustrated in FIG. 11, the spiral roller 38 is supported movably in the vertical direction in FIG. 7 by means of a movement mechanism (abutment/separation mechanism), such as a push latch 508, or the like. Consequently, it is possible to perform control for switching between a state where the spiral roller 38 is pushed against the intermediate transfer body 12 (the abutted (nipped) state illustrated in FIG. 7), and a state where the spiral roller is separated (withdrawn) from the intermediate transfer body 12 (the separated state illustrated in FIG. 12).

As illustrated in FIG. 11, the main blade 112 is able to rotate about the rotating axle 112*a* by causing an eccentric cam 512 to rotate by means of a cam motor 510. By this means, it is possible to control switching between a state of abutment against the spiral roller 38, and a state of separation from the spiral roller 38.

It is desirable if a lyophobic treatment is provided on the outer circumferential surface of the spiral roller 38 (and in particular, the groove sections thereof), such as an electroless PTFE (polytetrafluoroethylene) eutectic plating or PFA (paraformaldehyde) coating, thereby setting the surface energy to approximately 25 mN/m through 40 mN/m (=mJ/m$^2$), since this improves the mold separating characteristics of the aggregating treatment agent, and furthermore since the surface tension of the aggregating treatment agent is a low value of 18 mN/m through 28 mN/m (=mJ/m$^2$) (see Table 1 and Table 2), then it is also possible to ensure good application characteristics.

The pressing rollers 116 and 118 are disposed on the opposite side of the spiral roller 38 (the upper side in FIG. 7), via the intermediate transfer body 12. The two pressing rollers 116 and 118 are disposed in parallel alignment at a prescribed interval apart in the conveyance direction of the intermediate transfer body 12, and the spiral roller 38 is disposed approximately at the midpoint between the two pressing rollers 116 and 118 in the direction of conveyance of the intermediate transfer body 12.

As illustrated in FIG. 7, during application, the spiral roller 38 is pressed against the intermediate transfer body 12, and the intermediate transfer body 12 is pressed up between the pressing rollers 116 and 118. The intermediate transfer body 12 which is sandwiched between the pressing rollers 116, 118 and the spiral roller 38 is bent so as to following the upper circumferential surface of the spiral roller 38, and hence the adhesion with respect to the spiral roller 38 is raised and the contact surface area can also be guaranteed. By controlling the amount by which the spiral roller 38 is pressed against the intermediate transfer body 12, it is possible to adjust the angle of wrapping of the intermediate transfer body 12 with respect to the spiral roller 38.

By conveying the intermediate transfer body 12 at a uniform speed in this nipped state and causing the spiral roller 38 to rotate in reverse with respect to the direction of conveyance of the intermediate transfer body, a thin film having a uniform film thickness can be applied to the image forming surface 12A of the intermediate transfer body 12 which forms the member receiving liquid application. In this case, the pressing rollers 116 and 118 rotate in a direction of rotation which follows the direction of conveyance, in accordance with the conveyance of the intermediate transfer body 12.

Figure 12:
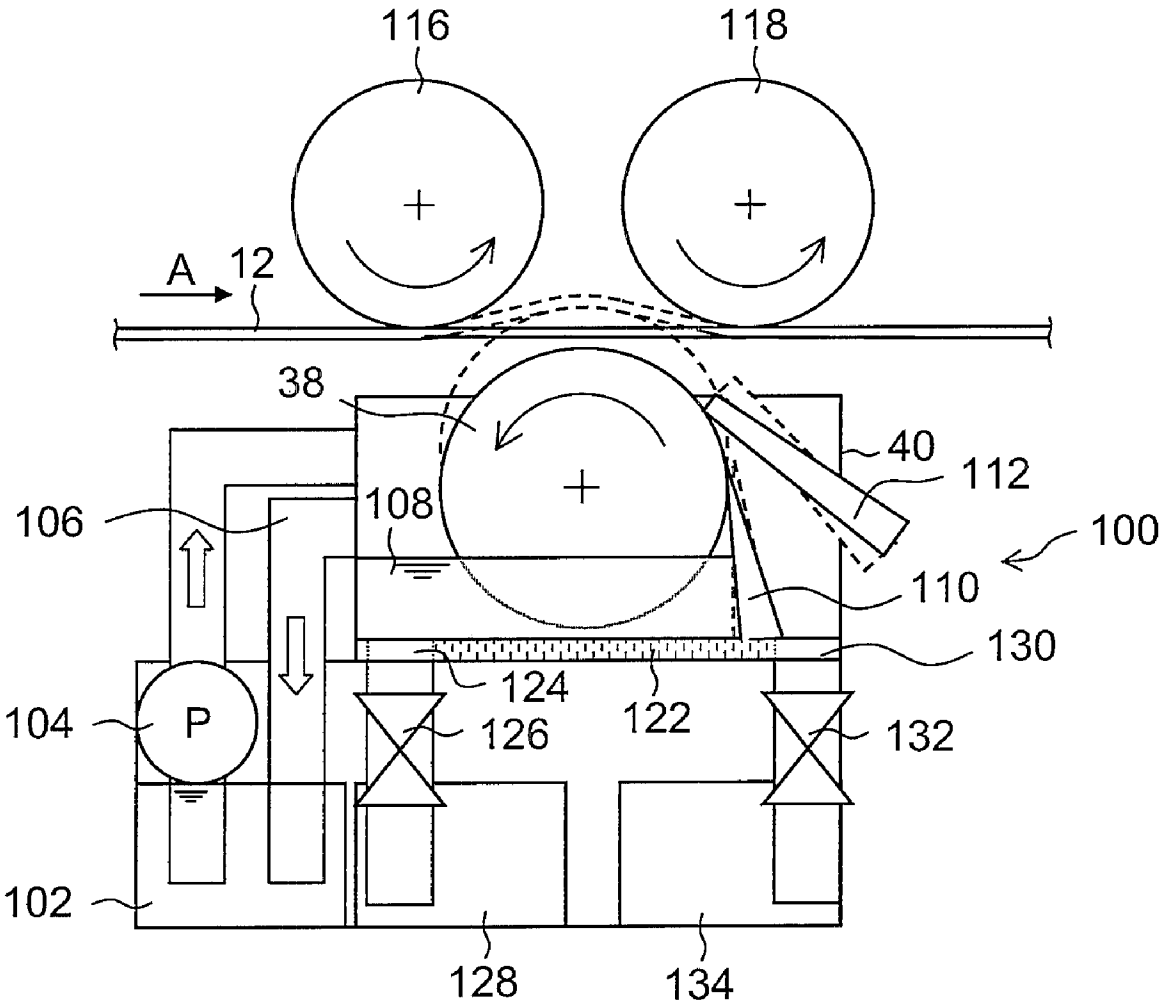
FIG. 12 is a diagram illustrating a state where the spiral roller has been separated (withdrawn) from the intermediate transfer body.

Furthermore, as indicated in FIG. 12, it is also possible to increase the biasing force of the main blade 112 and to separate the spiral roller 38 from the intermediate transfer body 12. By this means, it is possible to avoid friction between the spiral roller 38 and the application receiving medium when liquid is not being applied, for instance, during standby, or when liquid cleaning is halted, and furthermore, it is also possible to avoid contact between the spiral roller 38 and the step difference section in the joint portion of the intermediate transfer body 12, or the step difference section of the gripper (not illustrated) which is provided in the pressure drum 826*a* (see FIG. 47), described hereinafter. The reliability of the apparatus is further improved if the spiral roller 38 is fixed and supported by the push latch 508 (see FIG. 11) when separated from the intermediate transfer body 12.

In the liquid application apparatus 100 according to the present example, in particular, if the number of grooves in the spiral roller 38 is set to 100 through 250 lines per inch, then the visibility of the application pattern is low, and a thin film can be applied at a uniform application thickness of approximately 0.5 μm through 25 μm. Moreover, if the number of grooves is set to 150 lines/inch through 200 lines/inch, then it is possible to form a uniform liquid film approximately 2 μm through 10 μm thick, and there is no flow of liquid on the intermediate transfer body, which is even more desirable in terms of achieving good fixing properties of the coloring material when ink droplets are ejected.

Figure 13:
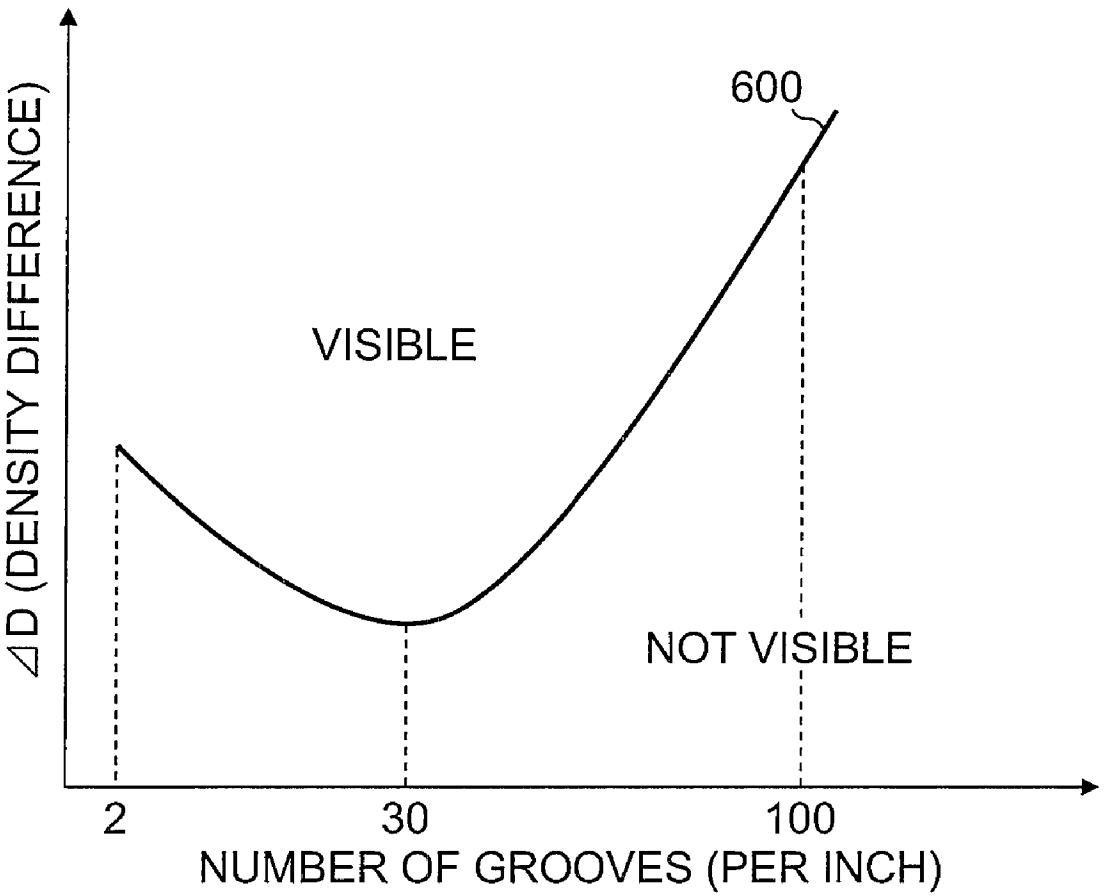
FIG. 13 is a diagram showing visibility in relation to the number of grooves and the density differential $\Delta D$.

FIG. 13 is a diagram illustrating a visibility curve. In FIG. 13, the horizontal axis represents the spatial frequency and the vertical axis represents the density differential (ΔD) at the spatial frequency cycle. The visibility curve 600 illustrated in FIG. 13 is a curve which illustrates the boundary at or above which a density non-uniformity is perceived. In the region above the visibility curve 600, the density non-uniformity is readily visible, and on the other hand, in the region below the visibility curve 600, the density non-uniformity is not readily visible. According to this visibility curve 600, the density non-uniformities are readily visible at 30 through 50 lines (per inch), and visibility is especially marked in the medium density region. Therefore, it is desirable that the spiral roller 38 described above has the grooves of 100 through 200 lines per inch. By this means, the trace of the cells becomes greater than the human visual frequency range, and it is therefore possible to maintain good image quality on the recording medium 14 due to the decline in the visibility.

Furthermore, the squeegee blade 110 according to the present example, also serves as a dividing member (partitioning member) which demarcates the interior of the treatment liquid container 40. In FIG. 7, the region to the left-hand side of the squeegee blade 110 is a region where treatment liquid 108 is stored (a portion which functions as an application liquid receptacle), and the region to the right-hand side of the squeegee blade 110 is a recovery region for recovering the liquid which has been removed by means of the main blade 112. A heater 112 for heating the treatment liquid is provided in the bottom portion of the region of the treatment liquid container 40 where the treatment liquid 108 is stored, and a treatment liquid outlet port 124 is also formed in this region. The treatment liquid outlet port 124 is connected via a treatment liquid discharge valve 126 to a treatment liquid recovery tank 128.

When the treatment liquid discharge valve 126 is opened, it is possible to remove the treatment liquid 108 from the treatment liquid container 40, and by driving the liquid supply pump 104 with the treatment liquid discharge valve 126 closed, it is possible to incorporate the treatment liquid 108 into the treatment liquid container 40.

On the other hand, a removed liquid outlet port 130 is formed in the bottom portion of the collection region for the removed liquid, which is demarcated by the squeegee blade 110, and this removed liquid outlet port 130 is connected via a removed liquid discharge valve 132 to a removed liquid collection tank 134.

In this way, by forming a partition by means of the actual squeegee blade 110, it is possible to separate the aggregating treatment liquid from the removed liquid, as well as independently recovering the removed liquid. Moreover, it is also possible to take the liquid recovered as removed liquid, and to reuse it as a treatment liquid for application.

According to the inkjet recording apparatus 10 which comprises the liquid application apparatus 100 of the present embodiment, when the apparatus is halted or at standby, by introducing a washing liquid instead of a treatment liquid 108 into the treatment liquid container 40 and rotating the spiral roller 38, the treatment liquid can be removed reliably from the outer circumferential surface of the roller, affixation of residual treatment liquid or modification in the outer circumferential surface of the roller due to residue of the acidic treatment liquid can be prevented, and stable operation of the apparatus can be achieved.

Figure 14:
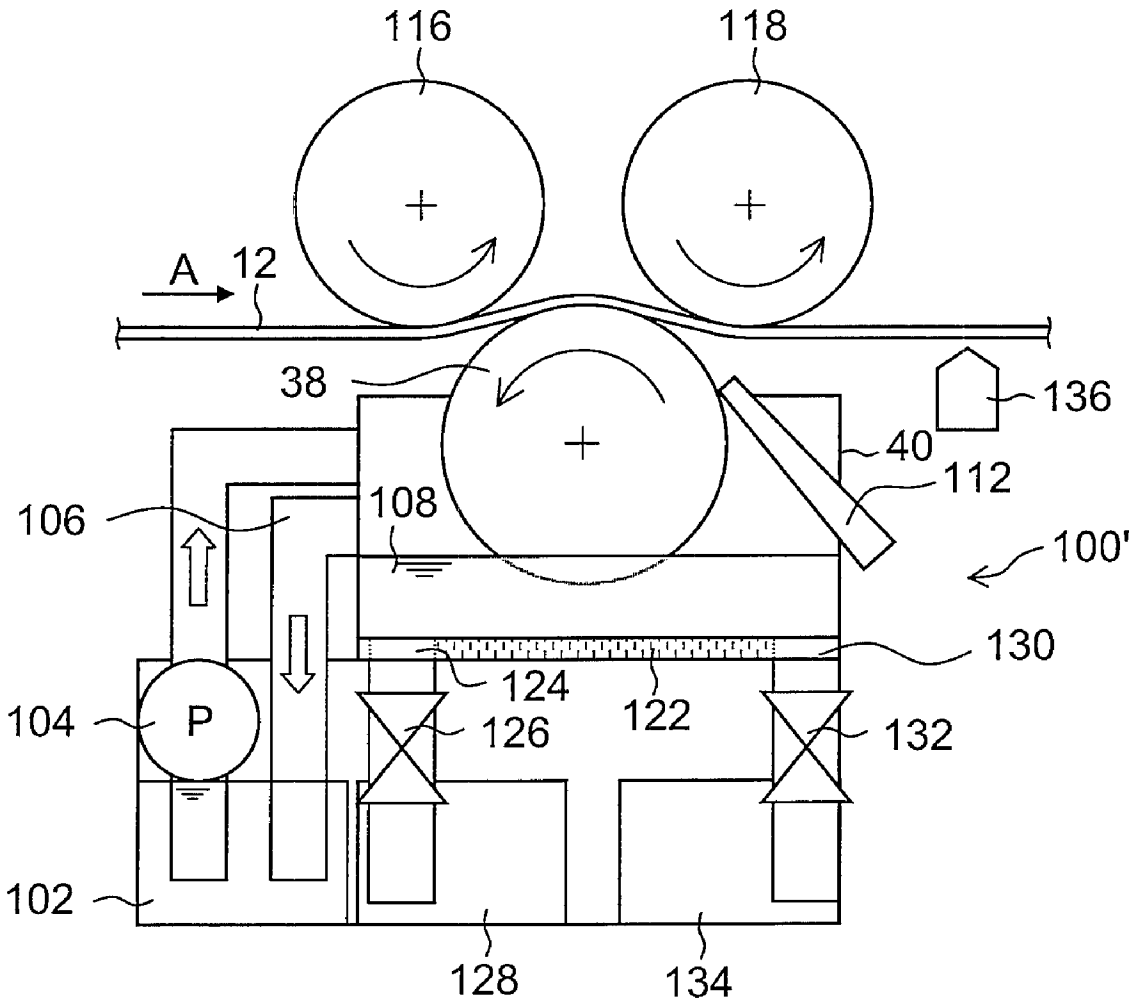
FIG. 14 is a diagram illustrating an example of controlling application by means of the main blade only (by one blade only) (a case where a portion of the spiral roller is immersed)

It is also possible to make the magnitude of the biasing force of the main blade 112 switchable, and to set the main blade 112 so as to be switchable between two stages: a state (application state) where the main blade only scrape surplus treatment liquid from the outer circumferential surface of the spiral roller 38 but does not remove treatment liquid from the grooves of the spiral roller 38, so that treatment liquid is applied to the intermediate transfer body 12, and a state (removal state) where both the surplus treatment liquid and the treatment liquid in the grooves in the outer circumferential surface of the spiral roller 38 are removed from the outer circumferential surface of the spiral roller 38 so that treatment liquid is not applied to the intermediate transfer body 12. FIG. 14 illustrates a liquid application apparatus 100' in this case. According to this liquid application apparatus 100', it is possible to control application by means of the main blade 112 only (one blade only), without using a squeegee blade 110, and therefore controllability can be improved yet further.

Furthermore, it is desirable if a film thickness determination device 136, such as a moisture meter or film thickness meter is provided on the spiral roller 38 or the intermediate transfer body 12, since this makes it possible to maintain a stable application thickness in the application state. Moreover, if the biasing force of the main blade 112 in the removal state is raised and the spiral roller 38 is separated from the intermediate transfer body 12, then this is beneficial in making it possible to avoid friction or contact with the step difference of the joint of the intermediate transfer body 12, when liquid cleaning is halted. Desirably, the viscosity of the treatment liquid (application liquid) is set to 20 mPa·s through 100 mPa·s, since this also improves the separation characteristics from the intermediate transfer body 12, as well as the application characteristics described above.

Since a spanning roller 34C which is a tensioning member of the intermediate transfer body 12 is provided in the vicinity of the spiral roller 38 (see FIG. 1), then it is possible to achieve stable application of treatment liquid onto the intermediate transfer body 12 by absorbing speed fluctuations in the intermediate transfer body 12 during image formation, and therefore image distortions can be prevented.

By using an elastic body having a hardness of 20° through 80° as the surface of the intermediate transfer body 12, the contract of the spiral roller 38 is stabilized and uniform application is achieved. Furthermore, by using for the material of the surface material of the intermediate transfer body 12, any one of fluorine rubber, urethane rubber, silicone rubber, a fluorine elastomer, or a silicone elastomer, the surface tension (surface energy) can be set to 10 mN/m through 40 mN/m, liquid repelling properties can also be guaranteed, and therefore excellent cleaning properties are achieved.

Second Example of Liquid Application Apparatus

Next, a second example of the liquid application apparatus used in the treatment liquid application unit 16 will be described.

Figure 15:
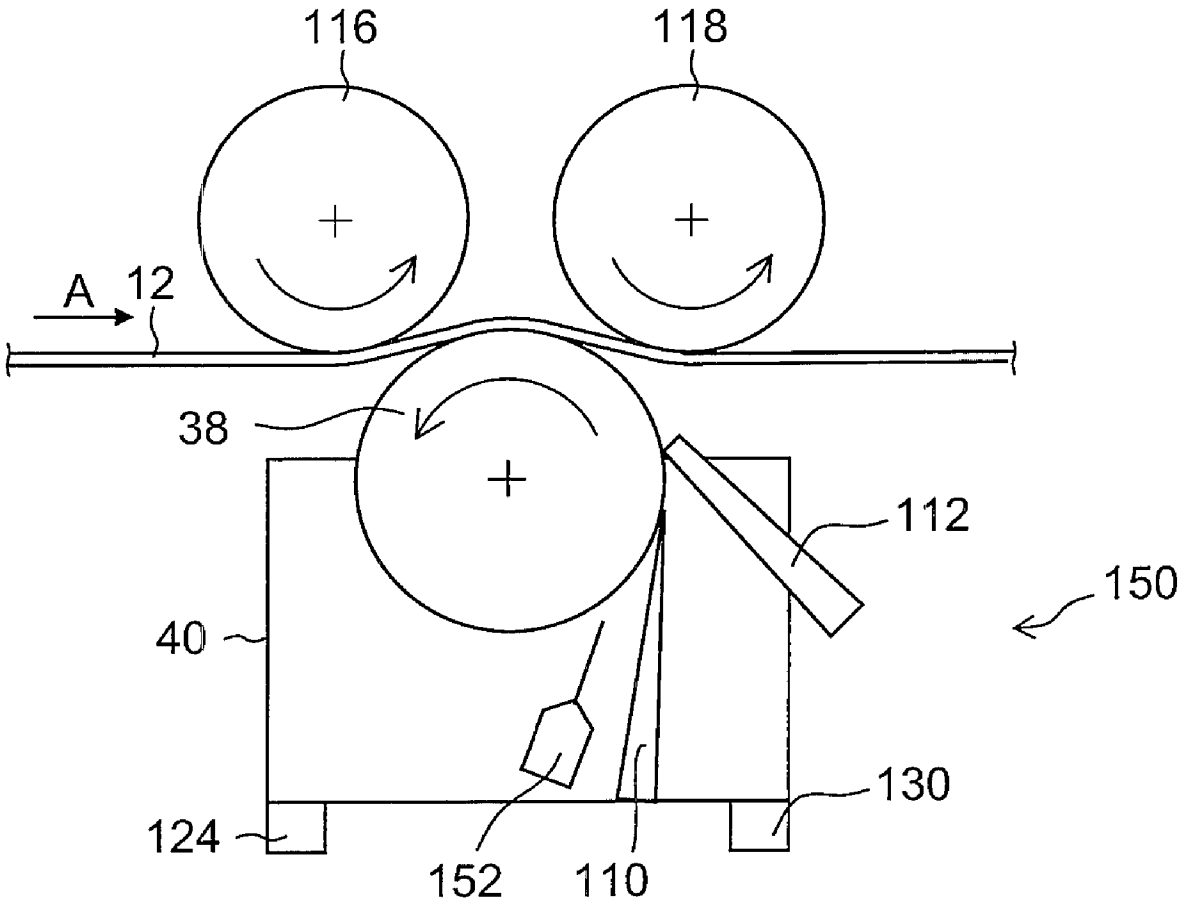
FIG. 15 is a compositional diagram illustrating a second example of a liquid application apparatus used in a treatment liquid application unit.

The second example of the liquid application apparatus illustrated in FIG. 15 is an apparatus in which the application range can be controlled both in the breadthways direction and the conveyance direction of the intermediate transfer body 12. In FIG. 15, members which are the same as or similar to the composition described in FIG. 7 are labeled with the same reference numerals and description thereof is omitted here.

The liquid application apparatus 150 according to the second example illustrated in FIG. 15 comprises a liquid spraying unit 152 as a device for applying a treatment liquid to the spiral roller 38. A single-fluid flat spray nozzle having a controllable spray angle, or a pressurized two-fluid flat spray nozzle, is used as the spraying member of the treatment liquid spraying unit 152. More specifically, the nozzle used is, for example, a single-fluid flat spray nozzle having an orifice diameter of approximately 0.2 mm through 0.4 mm and a spray angle of 60° through 100°, or a pressurized two-fluid flat spray nozzle of similar size.

Figure 16:
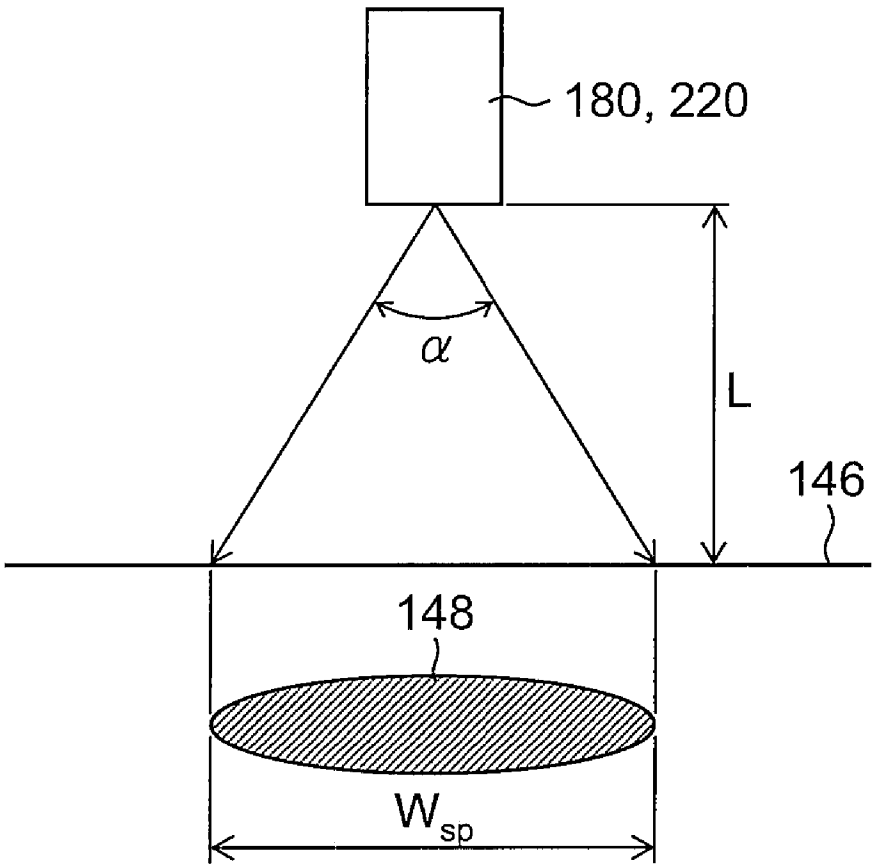
FIG. 16 is an illustrative diagram of a flat spray nozzle.

As illustrated in FIG. 16, since the flat spray nozzle sprays fluid at a spray angle of $\alpha$, then the effective spray width Wsp of the spray range 148 is governed by the distance L between the ejection surface of the nozzle body 180 (see FIG. 19) of the liquid spraying unit 152 and the spray receiving surface 146. The flat spray nozzle is not limited to a mode using a single nozzle, and it is also possible to use a plurality of flat spray nozzles aligned in the breadthways direction of the spiral roller 38. In this case, it is possible to control the removal process in the breadthways direction, as well as the conveyance direction.

As illustrated in FIG. 15, the liquid spraying unit 152 sprays treatment liquid toward the vicinity of the front end of the squeegee blade 110 from below the spiral roller 38. In this way, the spraying pressure is controlled so as to set a spraying angle which achieves an application width that matches the width of the image forming region. In other words, the liquid spraying unit 152 forms a supply width control device which controls the width at which the treatment liquid is supplied on the outer circumferential surface of the spiral roller 38.

Figure 17:
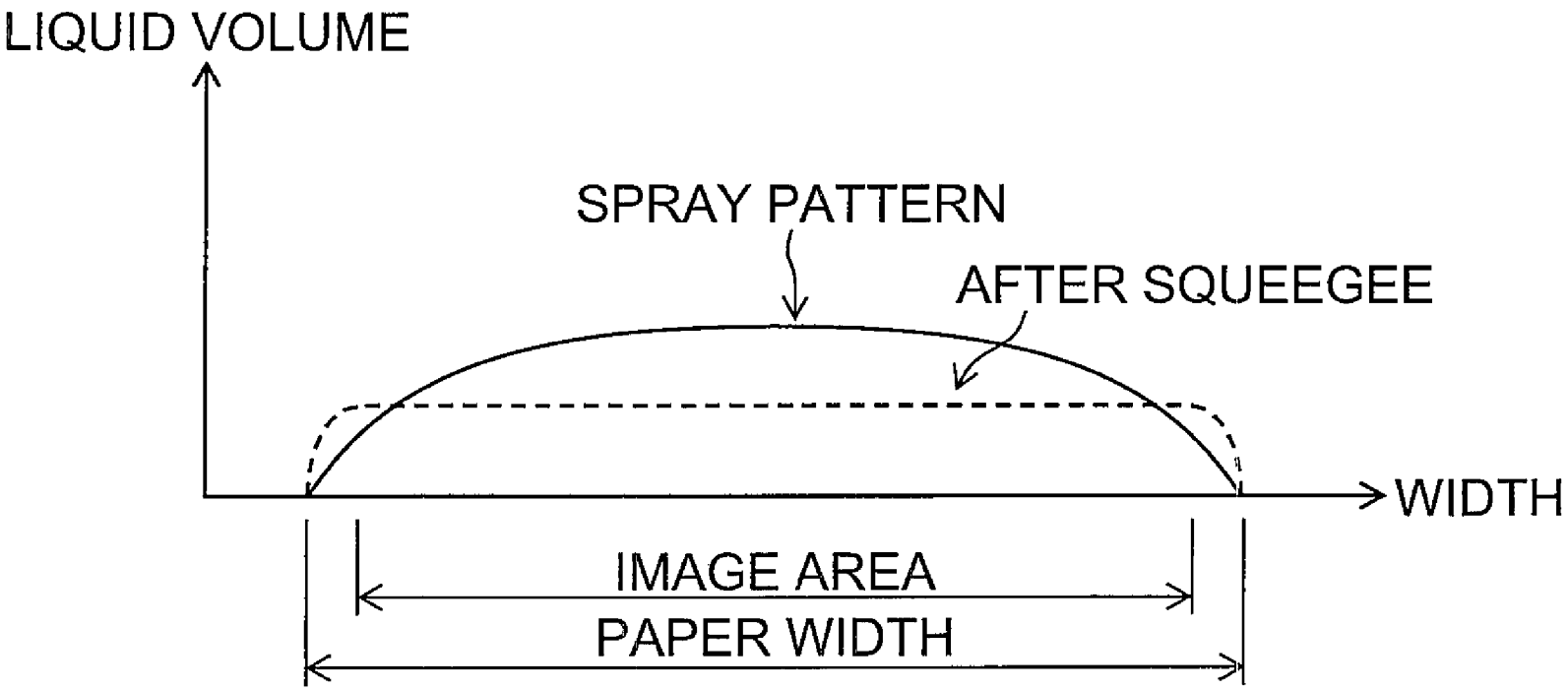
FIG. 17 is a graph showing the liquid volume distribution of a liquid spraying pattern achieved by a flat spray.

As illustrated in FIG. 17, the liquid spray pattern achieved by the flat spray creates a liquid volume distribution in the breadthways direction. Furthermore, the spray amount (flow rate) varies depending on the spraying pressure. However, in the case of the present example, since excess treatment liquid is removed by the squeegee blade 110, in such a manner that the liquid can be applied in a paper width range which is broader than the width of the effective image area, then it is possible to keep the amount of treatment liquid deposited onto the spiral roller 38 to a stable amount, and it is possible to achieve uniform application with a controlled application width.

In the present embodiment, a spiral roller 38 which is formed with spiral-shaped grooves is used, and therefore it is possible to reduce spilling of the treatment liquid in the breadthways direction by means of the concavoconvex shape of the grooves. Therefore, width control is further improved, and due to the residual components from liquid cleaning and the smoothing effects of the coated paper, the contact friction can be reduced even in portions in the width direction where liquid is not applied.

The composition for selectively removing treatment liquid in respect of the circumferential direction of the spiral roller 38 by abutting a main blade 112 is as described in the first example.

Furthermore, similarly to the first example, the squeegee blade 110 in FIG. 15 also serves as a partition of the treatment liquid container 40, the left-hand side of the squeegee blade 110 forms a region for storing treatment liquid 108 (a portion which functions as an application liquid receptacle), and the right-hand side is a recovery region for recovering treatment liquid that has been removed by the main blade 112.

According to the liquid application apparatus of the second example which has the composition described above, the treatment liquid deposition width in the breadthways direction is controlled by means of the liquid spraying unit 152, and the treatment liquid deposition range in the conveyance direction of the intermediate transfer body (the circumferential direction of the spiral roller 38) is controlled by the main blade 112.

Figure 18:
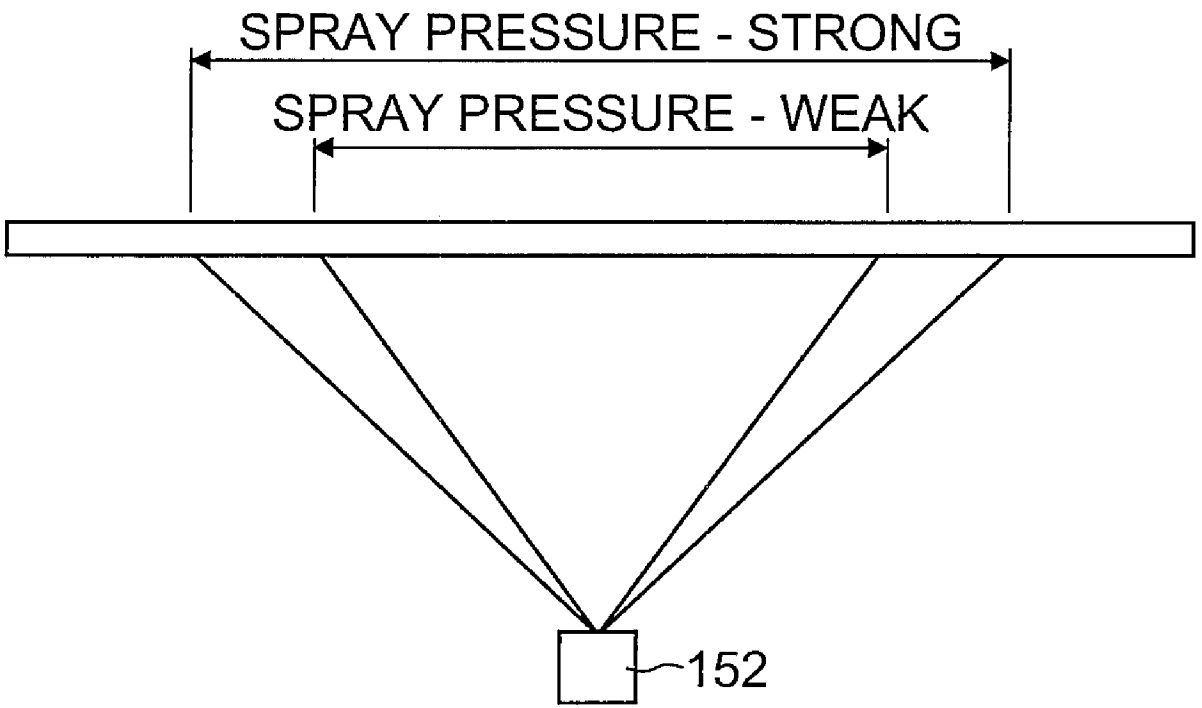
FIG. 18 is a schematic drawing illustrating the relationship between a treatment liquid spraying unit and a substitute fluid spraying unit.

FIG. 18 is an explanatory diagram illustrating a schematic view of the relationship between the spray pressure and the spray width of the liquid spraying unit 152. As illustrated in FIG. 18, the nozzle of the liquid spraying unit 152 can be switched between at least two different spray widths (spraying ranges in the breadthways direction). FIG. 18 illustrates an example in which two spray widths are achieved on the basis of the strength of the spraying pressure, but it is also possible to adopt a mode in which three or more spray widths are achieved, in accordance with the different sizes of the recording medium 14. Information relating to the recording medium 14 may be acquired automatically by means of a sensor, or the like, or it may be acquired by being input by the operator.

Figure 19:
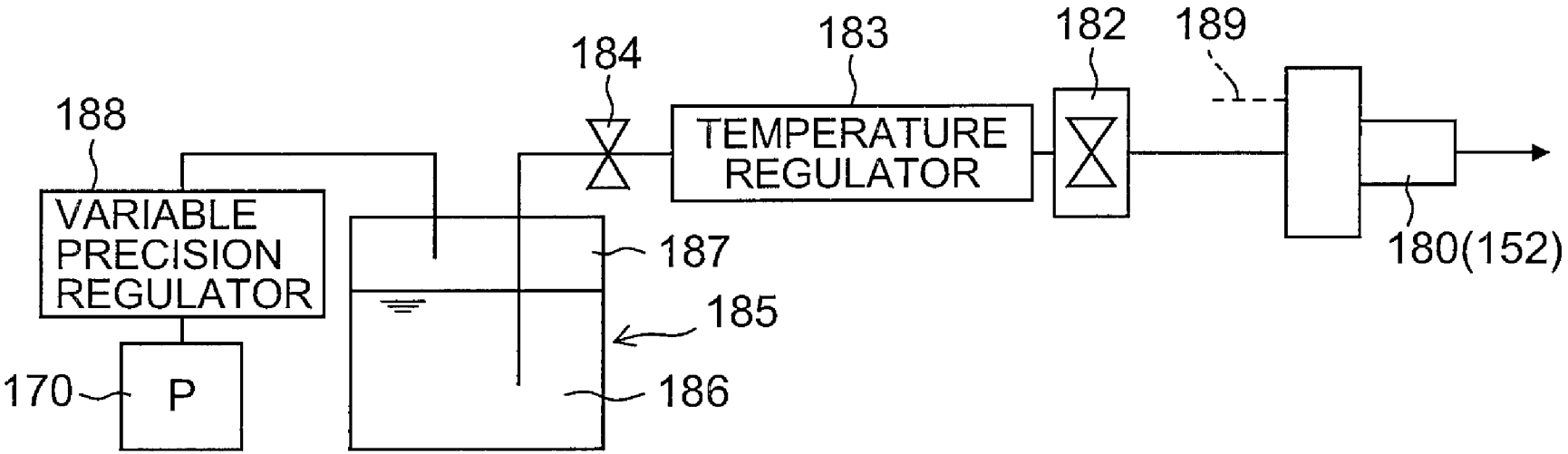
FIG. 19 is a diagram illustrating an example of the composition of a system for supplying liquid to a treatment liquid spraying unit.

FIG. 19 illustrates an example of the composition of a system for supplying liquid to the liquid spraying unit 152. The nozzle body 180 of the liquid spraying unit 152 is connected to the liquid layer 186 in a pressure container 185 via an electromagnetic valve 182, a temperature regulator 183, and a manual valve 184. The liquid for spraying (in the present example, the treatment liquid) is stored inside a sealed pressure container 185, and the gas layer 187 in the pressure container 185 is connected to the compressor 170 via a precision regulator 188 which enables the pressure to be changed and controlled.

The pressure of the liquid supplied from the pressure container 185 is adjusted by controlling the variable precision regulator 188 and thereby changing the pressure inside the pressure container 185. The liquid conveyed out from the pressure container 185 is heated to a prescribed temperature by the temperature regulator 183, and is supplied to the nozzle body 180 via the electromagnetic valve 182. The spray of liquid from the nozzle body 180 is switched on and off by switching the electromagnetic valve 182 on and off, and the spraying pressure, in other words, the spraying width from the nozzle body 180, is changed by controlling the pressure of the variable precision regulator 188. If a two-fluid air atomizing nozzle is used as the nozzle body 180 of the liquid spraying unit 152, then compressed air is supplied to the air supply unit 189 of the nozzle body 180 via the regulator (not illustrated).

Figure 20:
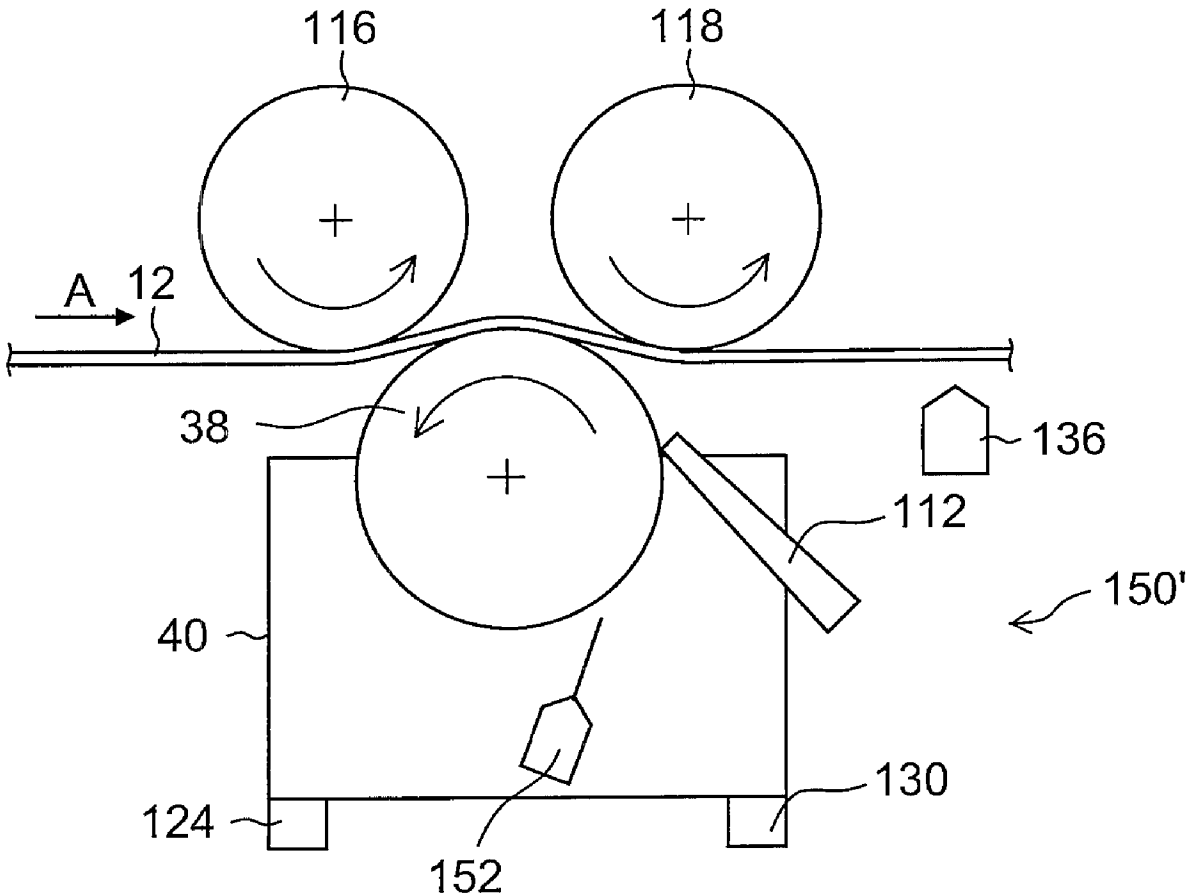
FIG. 20 is a diagram illustrating an example of controlling application by means of the main blade only (by one blade only) (a case where a treatment liquid spraying unit is provided)

It is also possible to make the biasing force of the main blade 112 switchable, and to set the main blade 112 so as to be switchable between two stages: a state (application state) where the main blade only scrape surplus treatment liquid from the outer circumferential surface of the spiral roller 38 but does not remove treatment liquid from the grooves of the spiral roller 38, so that treatment liquid is applied to the intermediate transfer body 12, and a state (removal state) where both the surplus treatment liquid and the treatment liquid in the grooves in the outer circumferential surface of the spiral roller 38 are removed from the outer circumferential surface of the spiral roller 38 so that treatment liquid is not applied to the intermediate transfer body 12. FIG. 20 illustrates a liquid application apparatus 150' in this case. According to this liquid application apparatus 150', it is possible to control application by means of the main blade 112 only (one blade only), without using a squeegee blade 110, and therefore controllability can be improved yet further.

Furthermore, when not forming images, the spiral roller 38, and the like, can be cleaned by spraying a cleaning liquid having a different composition to the treatment liquid from the liquid spraying unit 152.

Figure 21:
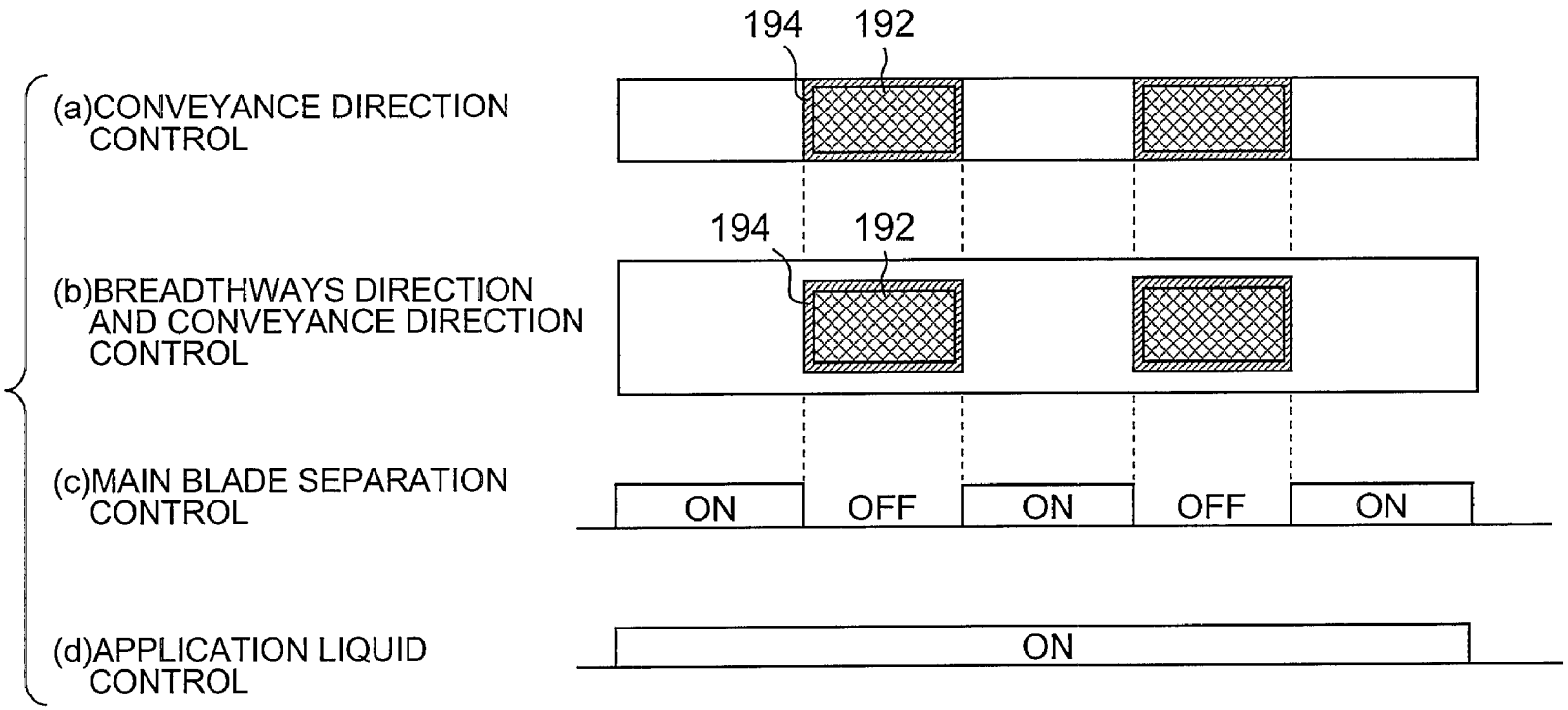
FIG. 21 illustrates examples of control of the application range of the treatment liquid onto the intermediate transfer body.

An example of the control of the application of treatment liquid to the intermediate transfer body 12 by means of the composition according to the first example and the second example described above will be described with reference to FIG. 21. (a) of FIG. 21 illustrates controlling the application range (application surface area) in the conveyance direction of the intermediate transfer body 12, by adopting the first example. (b) of FIG. 21 illustrates controlling the application range in the breadthways direction and conveyance direction of the intermediate transfer body 12, by adopting the second example.

The intermediate transfer body 12 has a width which is greater than the region of the effective image unit 192 in which the primary image which is the object for transfer is formed, and the treatment liquid is applied to a region which is broader that the effective image unit 192 (the region of the application unit which corresponds to the recording medium size indicated by reference numeral 194).

(c) of FIG. 21 illustrates the timing of the control of separation of the main blade 112 in the first example and the second example. (d) of FIG. 21 illustrates the control of the application of application liquid (treatment liquid) to the spiral roller 38 according to the first example and the second example.

As illustrated in (d) of FIG. 21, the application liquid (treatment liquid) is deposited uniformly and continuously on the spiral roller 38 itself, and the application range is controlled in the conveyance direction by controlling the separation and abutment of the main blade 112 as illustrated in (c) of FIG. 21 (see (a) and (b) of FIG. 21).

Furthermore, in the composition of the liquid application apparatus 150 relating to the second example, the spraying pressure of the liquid spraying unit 152 is controlled in accordance with the change in the size of the recording medium 14, and hence the application range in the breadthways direction is changed accordingly.

According to the liquid application apparatuses 100 and 150 of the present embodiment, the following action and beneficial effects are obtained.

(1) Since a composition (allowing abutment/separation control) is adopted in which a main blade 112 that is different to the squeegee blade 110 is disposed with respect to the spiral roller 38 onto which treatment liquid (in the present embodiment, treatment liquid) has been deposited, and the abutment operation of the main blade 112 is controlled, then it is possible to control the amount of application liquid removed (the application width) in the conveyance direction of the application receiving medium (in the present embodiment, the intermediate transfer body 12).

(2) Since a spiral roller 38 having spiral-shaped grooves formed in the outer circumferential surface thereof is used as the application roller which applies application liquid to the application receiving medium, and since an elastic body such as fluorine rubber or urethane rubber is used for the main blade 112, then the main blade 112 is able to adapt to the grooves of the spiral roller 38 and remove the application liquid satisfactorily.

(3) By taking the application receiving medium to be an intermediate transfer body 12 which is undergoing liquid cleaning, it is possible to reduce contact friction between the spiral roller 38 and the application receiving medium and to achieve stable application of high reliability, by means of the residual component of solvent, such as water or glycerine, surfactant, or the like.

(4) By applying the application liquid onto the spiral roller 38 by means of spraying by a flat line spray, as described in the second example, it is possible to control the application width by controlling the spray pressure. Furthermore, since grooves, such as spiral grooves, are formed in the outer circumferential surface of the spiral roller 38, then it is possible to reduce leaking of liquid in the breadthways direction.

(5) By making it possible to control the biasing force of the main blade 112 and by switching the biasing force between an application state and a removal state, it is possible to control application by means of one blade. Furthermore, if a film thickness determination device 136, such as a moisture meter, is provided on the application roller or the application receiving medium, then even further beneficial effects are obtained in being able to maintain a stable application thickness.

(6) By raising the biasing force of the main blade 112 during the removal of treatment liquid from the spiral roller 38 and separating the spiral roller 38 from the application receiving medium, it is possible to avoid friction between the spiral roller 38 and the application receiving medium when liquid cleaning is halted, and furthermore it is also possible to avoid contact between the spiral roller 38 and the step difference portion in the joint section of the application receiving medium.

Furthermore, if the spiral roller 38 is fixed in a separated state from the application receiving medium, by means of a push latch, then the reliability during standby of the image forming apparatus can also be improved.

(7) By providing a tensioner for the application receiving medium which forms a conveyance body, in the vicinity of the spiral roller 38, it is possible to absorb speed fluctuations during image formation and thereby prevent image distortions, by making the tensioner follow the separating operation of the spiral roller 38 from the application receiving medium.

(8) By setting the application liquid to have a surface tension of 15 mN/m through 30 mN/m and a viscosity of 20 mPa·s through 100 mPa·s when applied, it is possible to achieve excellent filtering characteristics during preparation or recovery after cleaning, and excellent application characteristics and roller separation characteristics.

Furthermore, by using an application liquid having hysteresis whereby the viscosity falls upon heating (10 mPa·s at 40° C.) and the viscosity rises over time, then it is possible to reduce scattering during spraying of the application liquid by the liquid spraying unit 152, by raising the viscosity.

(9) By using an elastic body having a hardness of 20° through 80° for the surface of the intermediate transfer body 12 which forms a conveyance body, the contact with the spiral roller 38 is stable and uniform application is achieved. Furthermore, by forming the surface of the intermediate transfer body 12 which is a conveyance medium from fluorine rubber, urethane rubber, silicone rubber, or a fluorine elastomer, it is possible to set the surface tension (surface energy) to 10 mN/m through 40 mN/m, liquid repelling characteristics can also be guaranteed, and therefore excellent cleaning properties are achieved.

Composition of Solvent Removal Unit

Figure 23:
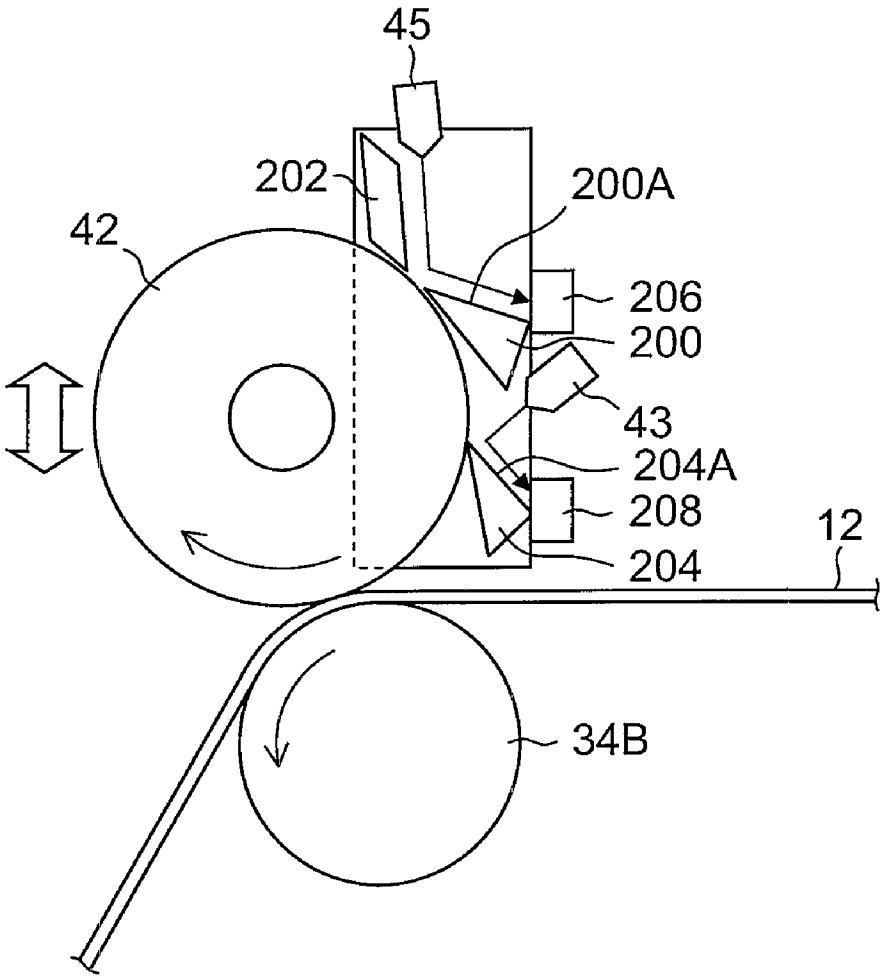
FIG. 23 is an enlarged diagram of a solvent removal unit.

FIG. 23 is an enlarged diagram of the solvent removal unit 24. In FIG. 23, the intermediate transfer body 12 is conveyed from the right-hand side toward the left-hand side. The solvent removal unit 24 illustrated in FIG. 23 is a device which abuts a solvent removal roller 42 (roller member) against the intermediate transfer body 12 being conveyed, and is driven to rotate at a prescribed uniform speed in the conveyance direction of the intermediate transfer body 12 (the clockwise direction in FIG. 23).

Figure 22A:
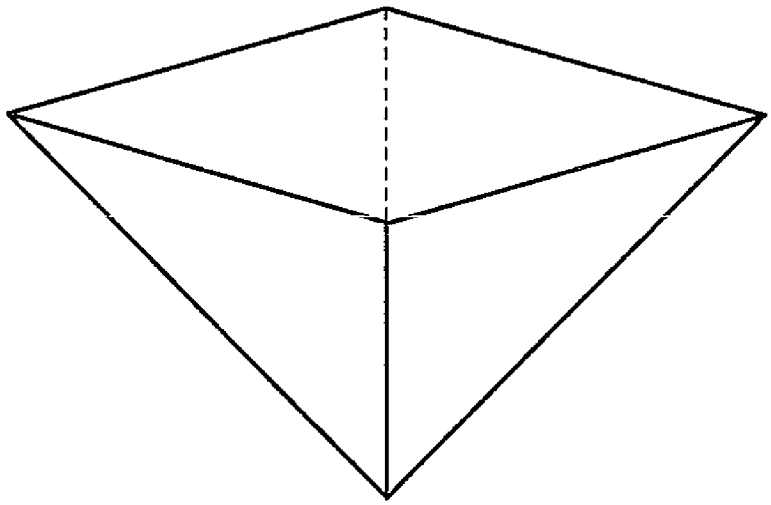
FIGS. 22A and 22B are diagrams illustrating the shape of cells formed on the surface of a gravure roller.
Figure 22B:
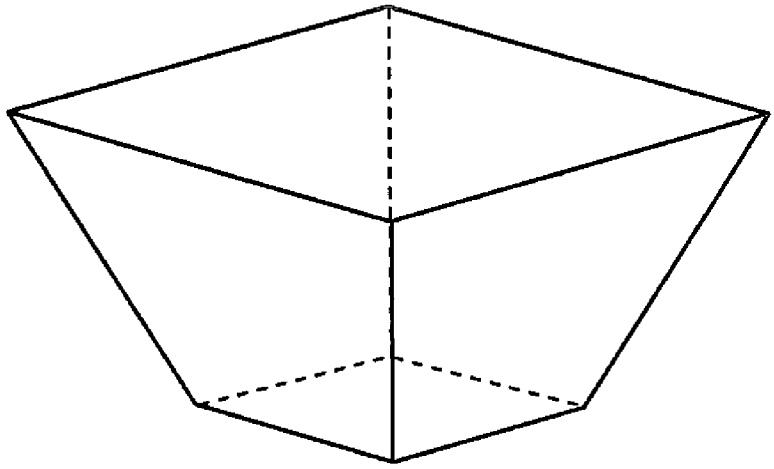

The solvent removal roller 42 traps liquid in cells in the surface thereof, by capillary action, or the like. More specifically, the solvent removal roller 42 is a gravure roller in which a plurality of highly precise cells (see FIGS. 22A and 22B) are cut in an undulating fashion into the surface of the roller, in a pyramid shape, or lattice shape (truncated square cone shape), and it has a length (width dimension) which is equal to or greater than the width dimension of the application receiving surface of the intermediate transfer body 12. There are no particular restrictions of the mode of arrangement of the cells on the roller surface, but a desirable mode is one in which the cells are aligned in an oblique direction which is not perpendicular to the direction of rotation. The shape, depth, cell volume, density, and the like, of the cells are selected appropriately in accordance with the amount of liquid that is to be removed.

Here, as indicated by the visibility curve 600 in FIG. 13 described above, a density non-uniformity is readily visible in the region above the visibility curve 600 and a density non-uniformity is not readily visible in the region below the visibility curve. In this case, the horizontal axis is changed to the line number of cells (recess) (lines per inch). According to this visibility curve 600, density non-uniformities are readily visible at a cell line number of 30 through 50 lines (per inch), and visibility is especially marked in the medium density region. If the number of lines of the cells (recess sections) in the solvent removal roller 42 described above is 100 through 200 lines per inch, then the trace of the cells is greater than the human visual frequency range, and visibility declines. Therefore, it is possible to maintain good image quality on the recording medium 14.

Furthermore, in particular, if the cells have a lattice shape, then it is possible to increase the amount of solvent recovered, and therefore the amount of solvent removed can also be increased. Similarly to the spiral roller 38 described above, the groove shape of the solvent removal roller 42 may be, apart from a spiral shape as illustrated in FIG. 9A, an independent groove configuration (FIG. 9B), a left/right groove configuration (FIG. 9C), or a multi-column spiral configuration (not illustrated), or the like. If a spiral roller is used, it is possible to recover a large amount of solvent by means of a simple shape.

The surface tension of the solvent is a low value of 20 mN/m through 30 mN/m, due to the aggregating treatment agent and the surfactant contained in the ink, and hence the wetting properties are good. Consequently, if the surface energy of the solvent removal roller 42 is set to be approximately 25 mN/m through 40 mN/m (=mJ/$m^2$) by providing a liquid-repelling treatment, such as an electroless PTFE (polytetra fluoroethylene) eutectic plating, or a PFA (paraformaldehyde) coating, on the surface of the solvent removal roller 42 (and in particular, in the recess sections), then it is possible to trap the solvent effectively due to the holding action of the cells and the effects of capillary action.

When the solvent removal roller 42 is caused to abut against the intermediate transfer body 12 which is being conveyed, the solvent (residual solvent) component which has separated from the aggregate body of the pigment enters inside the cells and is thereby collected. Consequently, the separated solvent (residual solvent) is removed from the pigment aggregate present on the intermediate transfer body 12.

Moreover, a first squeegee blade 200 is arranged in a standing fashion on the downstream side of the abutment position of the solvent removal roller 42 against the intermediate transfer body 12 in terms of the direction of rotation of the solvent removal roller 42, to serve as a device for scraping the solvent from the surface of the solvent removal roller 42. This first squeegee blade 200 is arranged in such a manner that the front end portion thereof contacts the solvent removal roller 42, and this front end portion is biased in a direction which presses against the circumferential surface of the solvent removal roller 42. This biasing force may be caused by the elastic deformation of the first squeegee blade 200 itself, or it may be applied from an external source by using a spring or other biasing member (not illustrated).

Moreover, a shielding member 202 is arranged on the downstream side of the abutment position of the solvent removal roller 42 against the intermediate transfer body 12 in terms of the direction of rotation of the solvent removal roller 42, and on the upstream side of the first squeegee blade 200 in terms of the direction of rotation of the solvent removal roller 42, so as to narrow (restrict) the range of the opening over the surface of the solvent removal roller 42 in the direction of rotation. Furthermore, a gas spray nozzle 45 is arranged which sprays a gas, such as air, from above with respect to the outer circumferential surface of the solvent removal roller 42 which is exposed between the shielding member 202 and the first squeegee blade 200 (the range of opening described above), as illustrated in FIG. 23.

The gas spray nozzle 45 has a spraying range whereby the gas is sprayed onto the whole width of the solvent removal roller 42. By spraying gas from the gas spray nozzle 45, the solvent is blown away and removed from the cells formed in the outer circumferential surface of the solvent removal roller 42.

Moreover, a second squeegee blade 204 is arranged in a standing fashion on the downstream side of the first squeegee blade 200 in terms of the direction of rotation of the solvent removal roller 42, to serve as a device for scraping the solvent from the surface of the solvent removal roller 42. A mist spray nozzle 43 is arranged which sprays a fluid in the form of a mist (hereinafter, called "mist") including a gas (air, or the like) and a liquid, from approximately the upper right-hand direction with respect to surface of the solvent removal roller 42 which is exposed between the second squeegee blade 204 and the first squeegee blade 200, as illustrated in FIG. 23. By changing the liquid content ratio in the liquid mist sprayed from the mist spraying nozzle 43, it is possible to change the amount of liquid which is deposited on the surface of the solvent removal roller 42. Consequently, it is also possible to spray only gas by setting the liquid content ratio in the liquid mist, to zero.

The mist spray nozzle 43 has a spraying range whereby the mist or gas is sprayed onto the whole width of the solvent removal roller 42. By spraying the mist onto the solvent removal roller 42 from the mist spray nozzle 43, the aggregating agent layer on the intermediate transfer body 12 which makes contact with the portion of the solvent removal roller 42 where mist has been sprayed is dissolved and diluted, and the collection of solvent by the solvent removal roller 42 is promoted, in particular in cases of images having a low ink volume (in cases of images including large white area).

Moreover, if the high-boiling-point solvent contained in the treatment liquid or the ink is added to the mist, then beneficial effects are obtained in preventing drying in the transfer step by the transfer unit 26 and the cleaning step by the first cleaning unit 30. Furthermore, if the polymer microparticles contained in the ink are also included in the mist, then it is possible to apply the polymer onto the whole of the paper, and therefore a uniform and stable texture is achieved on the paper to which the image is transferred. One example of the liquid contained in the mist is illustrated in Table 5.

Furthermore, it is also possible to spray only air from the mist spray nozzle 43, as described above, and in this case, the solvent is blown away and removed from the cells of the solvent removal roller 42.

TABLE 5

| Material | Weight % |
|---|---|
| Latex LX-2 | 8 |
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 61 |

A desirable mode is one in which the rotational drive device for the solvent removal roller 42 (not illustrated) uses direct drive by an inverter motor (direct shaft coupling), but it is not limited to this mode, and it is also possible to use a combination of various types of motor and a reduction gear device, or a combination of various types of motor and a wound transmission device, such as a timing belt.

Moreover, the solvent removal roller 42 is supported movably in the vertical direction in FIG. 23 by means of a movement mechanism (abutment/separation mechanism), which is not illustrated, and the movement mechanism can be controlled to switch between a state where the solvent removal roller 42 is pressed against the intermediate transfer body 12 (the nip state illustrated in FIG. 23), and a state where the solvent removal roller 42 has been separated (retracted) from the intermediate transfer body 12.

A tensioning roller 34B is arranged on the opposite side of the intermediate transfer body 12 with respect to the solvent removal roller 42.

Is If the density of the cells in the solvent removal roller 42 is set to 100 through 200 lines per inch, then the visibility of the pattern of the cells of the solvent removal roller 42 on the transfer receiving medium is low, as described above, and a uniform thickness of the liquid layer can also be achieved.

Furthermore, the first squeegee blade 200 and the gas spray nozzle 45 are arranged in such a manner that the solvent removed by the spraying of gas flows down from the spraying position and along the first squeegee blade 200, to an outlet port 206 located in substantially the rightward and downward direction. In other words, in FIG. 23, the front end section of the first squeegee blade 200 abuts against the solvent removal roller 42 at approximately the two o'clock position, and the solvent removed from the solvent removal roller 42 by the gas sprayed onto the region between the first squeegee blade 200 and the shielding member 202 flows down to the outlet port 206 located in substantially the rightward and downward direction, along the oblique surface 200A of the first squeegee blade 200. By this means, the liquid is prevented from collecting at the front end portion of the first squeegee blade 200, and scattering of the solvent can be prevented, while improving the controllability of the solvent removal process.

Moreover, the second squeegee blade 204 is arranged in such a manner that the excess of the liquid which is sprayed from the mist spray nozzle 43 flows down from the spraying position and along the second squeegee blade 204 to an outlet port 208 located in substantially the rightward and downward direction. In other words, in FIG. 23, the front end portion of the second squeegee blade 204 is abutted against the solvent removal roller 42 at approximately the four o'clock position, and the excess of the liquid sprayed from the mist spray nozzle 43 flows down along the oblique surface 204A of the second squeegee blade 204, to the outlet port 208 located in rightward and downward direction. By this means, the liquid is prevented from collecting at the front end portion of the second squeegee blade 204, and scattering of the solvent can be prevented, while improving the controllability of the solvent removal process.

Figure 24:
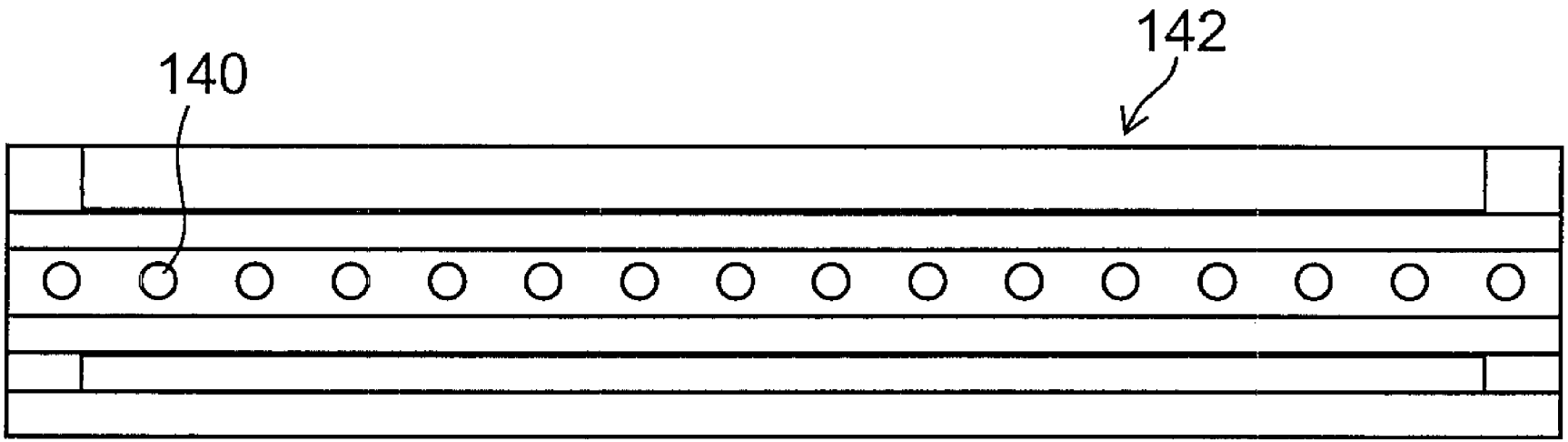
FIG. 24 is a compositional diagram of a line spray illustrating one example of a spraying member used in a gas spraying nozzle.
Figure 25:
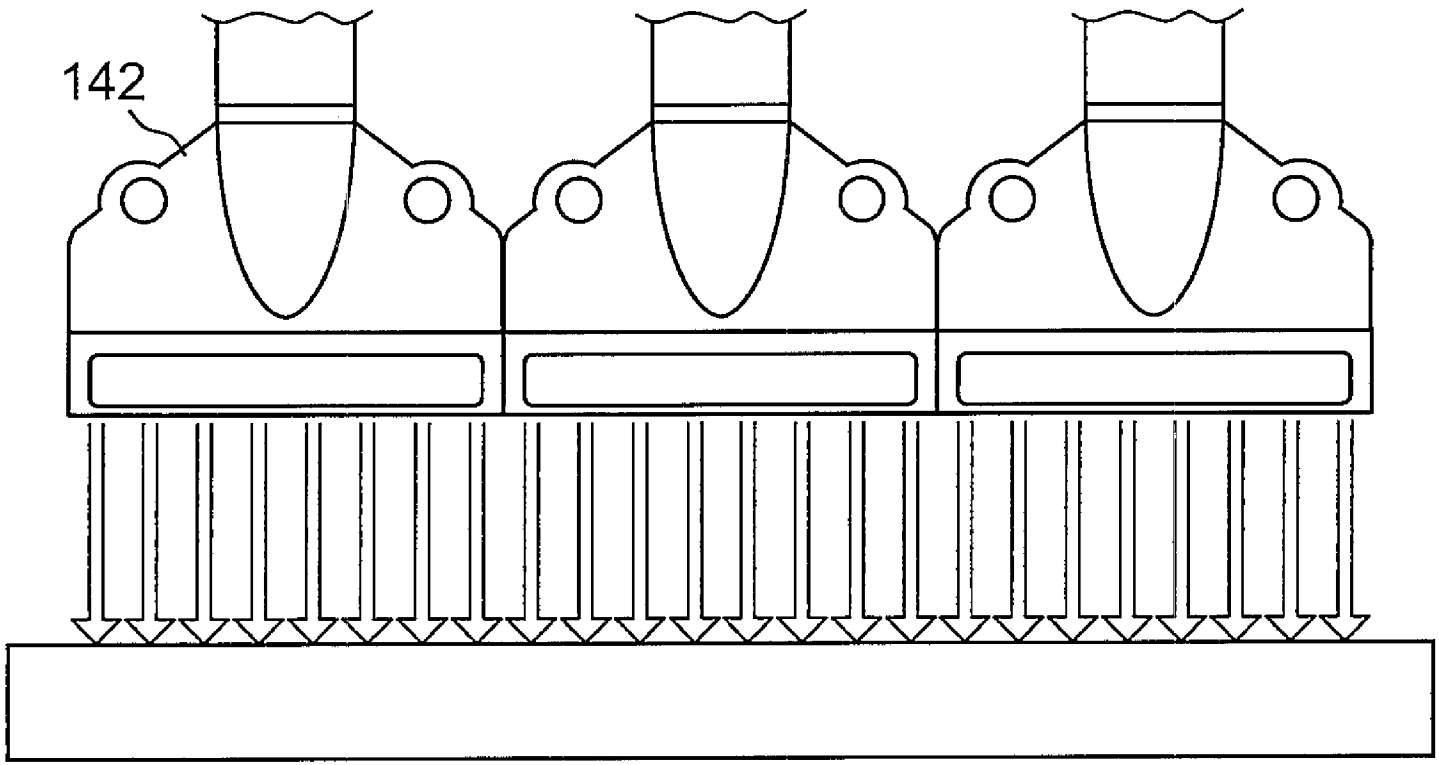
FIG. 25 is a diagram illustrating one example of the use of a line spray.

To give one example of a spraying member used in the gas spray nozzle 45, as illustrated in FIG. 24, a line spray 142 can be used in which nozzles 140 having a diameter of approximately 0.5 mm through 1 mm are arranged in the breadthways direction of a spraying surface, at a pitch of 1 mm through 3 mm. By arranging a plurality of line sprays 142 of this kind as illustrated in FIG. 25, a prescribed spray width is achieved, and a substantially uniform impact force of 500 mN through 1500 mN can be applied to the whole of the surface receiving the spray, in a pressure range of 0.1 MPa through 0.5 MPa.

One example of the spraying member used for the mist spray nozzle 43 is a two-fluid flat spray nozzle which can be used at an air pressure of 0.2 MPa through 0.6 MPa, a liquid pressure of 0 MPa through 0.3 MPa, an air flow rate of 40 l/min through 80 l/min, a liquid flow rate of 0 l/h through 10 l/h, and a spray angle of 90° through 130°. As illustrated in FIG. 16, since the flat spray nozzle sprays the fluid at a spray angle of $\alpha$, then the effective spray width $W_{sp}$ of the spray range 148 is governed by the distance L between the ejection surface of the nozzle body 220 (see FIG. 26) and the spray receiving surface 146. The flat spray nozzle is not limited to a mode where a single nozzle is used, and it is also possible to use a plurality of flat spray nozzles arranged in the breadthways direction of the solvent removal roller 42. In this case, it is possible to control the removal process in the breadthways direction, as well as the conveyance direction.

Figure 26:
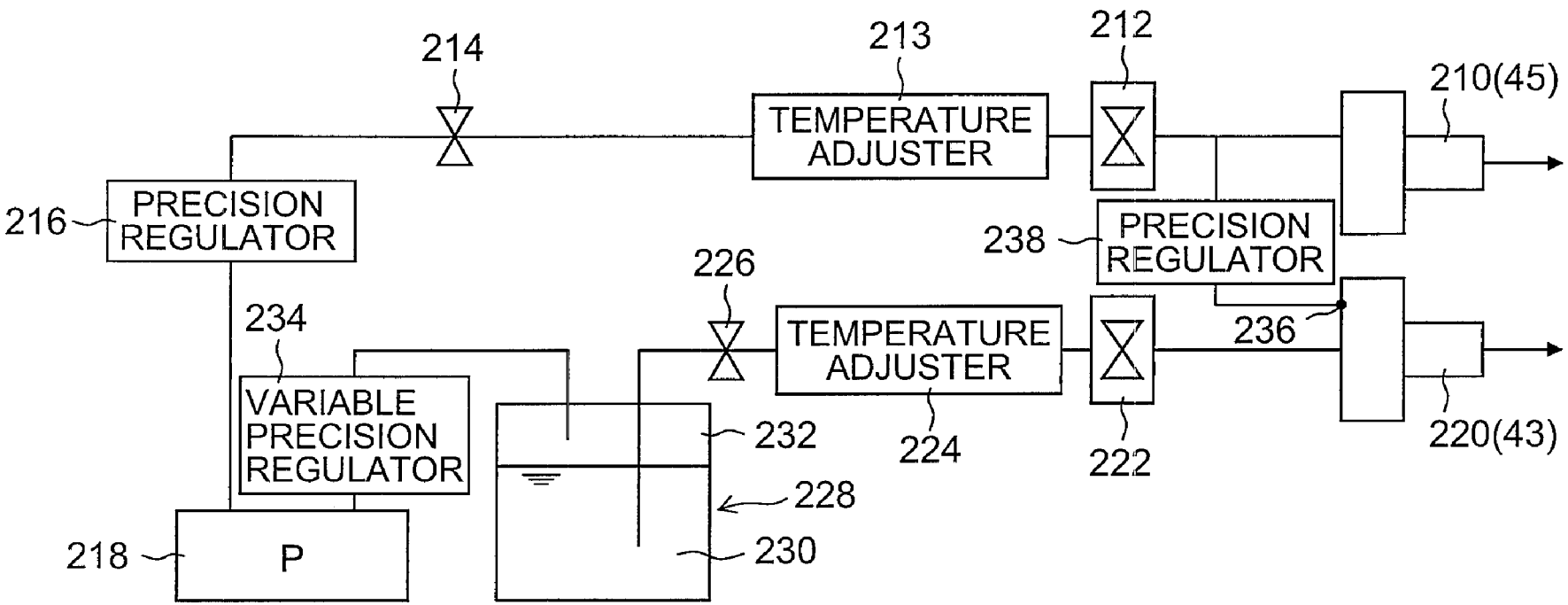
FIG. 26 is an illustrative diagram illustrating an example of the composition of a liquid supply system for the solvent removal unit.

FIG. 26 is an illustrative diagram illustrating an example of the composition of an air and liquid supply system in a solvent removal unit 24. The nozzle body 210 of the gas spray nozzle 45 is connected to a compressor 218 via an electromagnetic valve 212, a temperature adjuster 213, a manual valve 214, and a variable precision regulator 216 whereby the pressure is variable and controllable. The pressure of the compressed gas (compressed air, or the like) from the compressor 218 is adjusted by the variable precision regulator 216. It is possible to control the nozzle body 210 to spray and not to spray the gas by switching the electromagnetic valve 212 on and off. By means of this composition, a desired spray width can be achieved by adjusting the gas spray pressure from the nozzle body 210.

Moreover, the compressed gas is heated to a prescribed temperature by the temperature adjuster 213. Therefore, by heating the compressed gas by means of the temperature adjuster 213, so that the temperature of the gas sprayed from the nozzle body 210 is raised within a range of equal to or less than the boiling point (the boiling point of water, in the case where the treatment liquid and the ink are mainly composed of water) of the solvent after reaction between the treatment liquid and the ink, and equal to or less than the fusion temperature of the polymer micro-particles which are contained in the aggregating treatment agent or ink, then the dissolution of the aggregating treatment agent layer and the separation of the solvent removal roller 42 are improved, and the solvent removing effect is enhanced yet further.

More specifically, in cases where the polymer micro-particles contained in the aggregating treatment agent and the ink are micro-particles of a non-crystalline polymer, then desirably the heating temperature is adjusted so as to be equal to or lower than the glass transition temperature (for example, 50° C. or lower in the case of an acrylic polymer). Moreover, in cases where the polymer micro-particles contained in the aggregating treatment agent and the ink are crystalline polymer micro-particles, then desirably, the heating temperature is adjusted so as to be equal to or lower than the melting point (for example, 110° C. or lower in the case of an ethylene polymer, or 70° C. or lower in the case of a wax polymer).

The nozzle body 220 of mist spray nozzle 43 is connected to the liquid layer 230 in a pressure container 228 via an electromagnetic valve 222, a temperature adjuster 224, and a manual valve 226. The liquid to be sprayed is stored in a sealed pressure container 228, and the gas layer 232 in the pressure container 228 is connected to the compressor 218 via a variable precision regulator 234 which enables the pressure to be changed and controlled.

The pressure of the liquid supplied from the pressure container 228 is adjusted by controlling the variable precision regulator 234 and thereby changing the pressure of the gas in the pressure container 228. The liquid supplied from the pressure container 228 is heated to a prescribed temperature by the temperature adjuster 224, and is then supplied to the nozzle body 220 via the electromagnetic valve 222. Furthermore, the compressed gas is supplied to the gas supply unit 236 of the nozzle body 220 via the precision regulator 238 separately from the gas supply path to the nozzle body 210 of the gas spray nozzle 45.

The mist sprayed from the nozzle body 220 is composed of the liquid that is supplied from the pressure container 228 and the compressed gas that is supplied via the precision regulator 238. If the supply of the liquid from the pressure container 228 is halted by switching the electromagnetic valve 222 on and off, then only the compressed gas can be supplied via the precision regulator 238. Thus, it is also possible to spray only the gas from the nozzle body 220.

In this way, it is possible to control the nozzle body 220 to spray and not to spray the mist (composed of gas and liquid) or only the gas by switching the electromagnetic valve 222 on and off.

Furthermore, by heating the liquid supplied from the pressure container 228 by means of the temperature adjuster 224, so that the temperature of the mist sprayed from the nozzle body 220 is raised within a range of equal to or less than the boiling point (the boiling point of water, in the case where the treatment liquid and the ink are mainly composed of water) of the solvent after the reaction between the treatment liquid and the ink, and equal to or less than the fusion temperature of the polymer micro-particles which are contained in the aggregating treatment agent or ink, then the dissolution of the aggregating treatment agent layer and the separation of the solvent removal roller 42 are improved, and the solvent removing effect is enhanced yet further.

More specifically, in cases where the polymer micro-particles contained in the aggregating treatment agent and the ink are micro-particles of a non-crystalline polymer, then desirably the heating temperature is adjusted so as to be equal to or lower than the glass transition temperature (for example, 50° C. or lower in the case of an acrylic polymer), Moreover, if the polymer micro-particles contained in the aggregating treatment agent and the ink are crystalline polymer micro-particles, then desirably, the heating temperature is adjusted so as to be equal to or lower than the melting point (for example, 110° C. or lower in the case of an ethylene polymer, or 70° C. or lower in the case of a wax polymer).

It is desirable to keep the pressure of the compressed gas (compressed air, or the like) supplied from the compressor 218 to the nozzle body 220 of the mist spray nozzle 43 at a prescribed pressure, by means of the precision regulator 238. Moreover, the pressure of the liquid supplied from the pressure container 228 to the nozzle body 220 can be adjusted by means of the variable precision regulator 234, and it is thereby possible to change the spray width (spray pressure) from the nozzle body 220.

To give a concrete example, in the nozzle body 220, the pressure of the compressed gas from the compressor 218 is kept at 0.4 MPa, and the pressure of the liquid supplied from the pressure container 228 is adjusted in a range between 0 MPa through 0.3 MPa, In this case, if the distance L (see FIG. 16) between the ejection surface of the nozzle body 220 and the spray receiving surface 146 is taken to be 15 cm, then it is possible to adjust the gas flow rate from the nozzle body 220 at 60 l/min, the spray width $W_{sp}$ (see FIG. 16) at 60 cm, and the liquid flow rate in a range of 0 l/h through 10 l/h.

Moreover, it is desirable that the spray volume of the gas spray nozzle 45 or the spray volume of the mist spray nozzle 43 is controlled in accordance with the volume of the liquid on the intermediate transfer body 12 (the amount of solvent after reaction between the aggregating treatment agent and the ink). By this means, it is possible to keep the residual volume of the solvent at a desirable volume, even in the case of an image that is substantially a solid image or an image that is substantially a blank image, and hence the transfer properties and the cleaning properties of the intermediate transfer body are enhanced.

To give a concrete example, the thickness of the liquid (solvent) layer (the solvent of the aggregating treatment agent) on the intermediate transfer body 12 is set to approximately 1 μm in the case of a blank image, while the thickness of the liquid layer (the solvent after reaction between the aggregating treatment agent and inks of 2 colors through 3 colors) to approximately 9 μm through 13 μm in the case of a solid image. Therefore, by controlling the solvent removal roller 42, it is possible to stably reduce the thickness of the liquid layer on the intermediate transfer body 12 to approximately 3 μm through 7 μm. In order to further reduce the thickness of the liquid layer on the intermediate transfer body 12, it is possible to provide a plurality of solvent removal rollers 42.

FIG. 27 is a diagram illustrating an example of control relating to spraying from the gas spray nozzle 45 and the mist spray nozzle 43. As illustrated in FIG. 27, the control of the spraying from the gas spray nozzle 45 and the mist spray nozzle 43 is changed based on the image density (%:image density (amount of solvent)). In FIG. 27, the image to be formed on the intermediate transfer body 12 is categorized into three types: a solid image having a density equal to or greater than 80% and equal to or less than 100%; an intermediate tone image having a density equal to or greater than 20% and less than 80%; and a blank surface image having a density equal to or greater than 0% and less than 20%. Furthermore, the control illustrated in FIG. 27 is carried out by means of the system controller (reference numeral 272 in FIG. 40 and FIG. 46) estimating the amount of liquid (solvent) on the intermediate transfer body 12, on the basis of image data that is to be printed.

As illustrated in FIG. 27, if the image to be formed on the intermediate transfer body 12 has a greater density than an intermediate tone image (i.e., in the case of a solid image; the image density (amount of solvent) is "equal to or greater than 80% and equal to or less than 100%" in FIG. 27), then the amount of the gas sprayed from the gas spray nozzle 45 is controlled so as to be a large amount, and only the gas is sprayed from the mist spray nozzle 43. In this way, if an image having a high density (including a solid image) is formed, then the amount of liquid on the intermediate transfer body 12 is large, and therefore a large amount of gas is sprayed in two stages, from the gas spray nozzle 45 and the mist spray nozzle 43.

On the other hand, if forming an intermediate tone image (in the case of an image density (amount of solvent) which is "equal to or greater than 20% and less than 80%") in FIG. 27, then control is performed in such a manner that the amount of gas sprayed from the gas spray nozzle 45 is set to a medium amount or small amount, and the mist spray nozzle 43 is controlled to spray either gas only or a mist, as appropriate. More specifically, in the case of an image density (amount of solvent) which is "equal to or greater than 60% and less than 80%" in FIG. 27, then control is performed in such a manner that the amount of gas sprayed from the gas spray nozzle 45 is set to a medium volume, and only gas is sprayed from the mist spray nozzle 43. In the case of an image density (amount of solvent) which is "equal to or greater than 40% and less than 60%" in FIG. 27, then control is performed in such a manner that the amount of gas sprayed from the gas spray nozzle 45 is set to a small volume, and only gas is sprayed from the mist spray nozzle 43. In the case of an image density (amount of solvent) which is "equal to or greater than 20% and less than 40%" in FIG. 27, then control is performed in such a manner that the amount of gas sprayed from the gas spray nozzle 45 is set to a medium volume, and a mist is sprayed from the mist spray nozzle 43.

Furthermore, if an image having a lower density than an intermediate tone image (including a blank image) is formed on the intermediate transfer body 12 (in the case of an image density (amount of solvent) which is "equal to or greater than 0% and less than 20%" in FIG. 27), the amount of gas sprayed from the gas spray nozzle 45 is controlled so as to be a small amount, and a mist is sprayed from the mist spray nozzle 43. If an image of low density (including a blank image) is formed in this way, then since the amount of liquid on the intermediate transfer body 12 is small, then a small amount of gas is sprayed from the gas spray nozzle 45, the amount of solvent removed is made small, and liquid is supplied by performing a mist spray from the mist spray nozzle 43.

As described above, by controlling the amount of gas sprayed from the gas spray nozzle 45, and the amount of gas sprayed or the amount of mist sprayed from the mist spray nozzle 43, in accordance with the amount of liquid on the intermediate transfer body 12, then it is possible to achieve stable removal of solvent, regardless of the amount of liquid on the intermediate transfer body 12.

The solvent removal roller 42 may be driven in rotation by being biased against the intermediate transfer body 12, but desirably, it is coupled to an opposing roller, or the like, by means of a gear which adjusts the speed reduction ratio, or the like, since this improves the capacity of the solvent removal roller 42 to follow the action of the intermediate transfer body 12.

Moreover, by heating the solvent removal roller 42 (and in particular, the outer circumferential surface thereof) by means of a roller heating unit such as a heater (reference numeral 354 in FIG. 42), to a temperature within a range of equal to or less than the boiling point (the boiling point of water, in the case where the treatment liquid and the ink are mainly composed of water) of the solvent after reaction between the treatment liquid and the ink, and equal to or less than the fusion temperature of the polymer micro-particles which are contained in the aggregating treatment agent or ink, then the dissolution of the aggregating treatment agent layer and the separation of the solvent removal roller 42 are improved, and the solvent removing effect is enhanced yet further.

More specifically, in cases where the polymer micro-particles contained in the aggregating treatment agent and the ink are micro-particles of a non-crystalline polymer, then desirably the heating temperature is adjusted so as to be equal to or lower than the glass transition temperature (for example, 50° C. or lower in the case of an acrylic polymer), Moreover, in cases where the polymer micro-particles contained in the aggregating treatment agent and the ink are crystalline polymer micro-particles, then desirably, the heating temperature is adjusted so as to be equal to or lower than the melting point (for example, 110° C. or lower in the case of an ethylene polymer, or 70° C. or lower in the case of a wax polymer).

Figure 28:
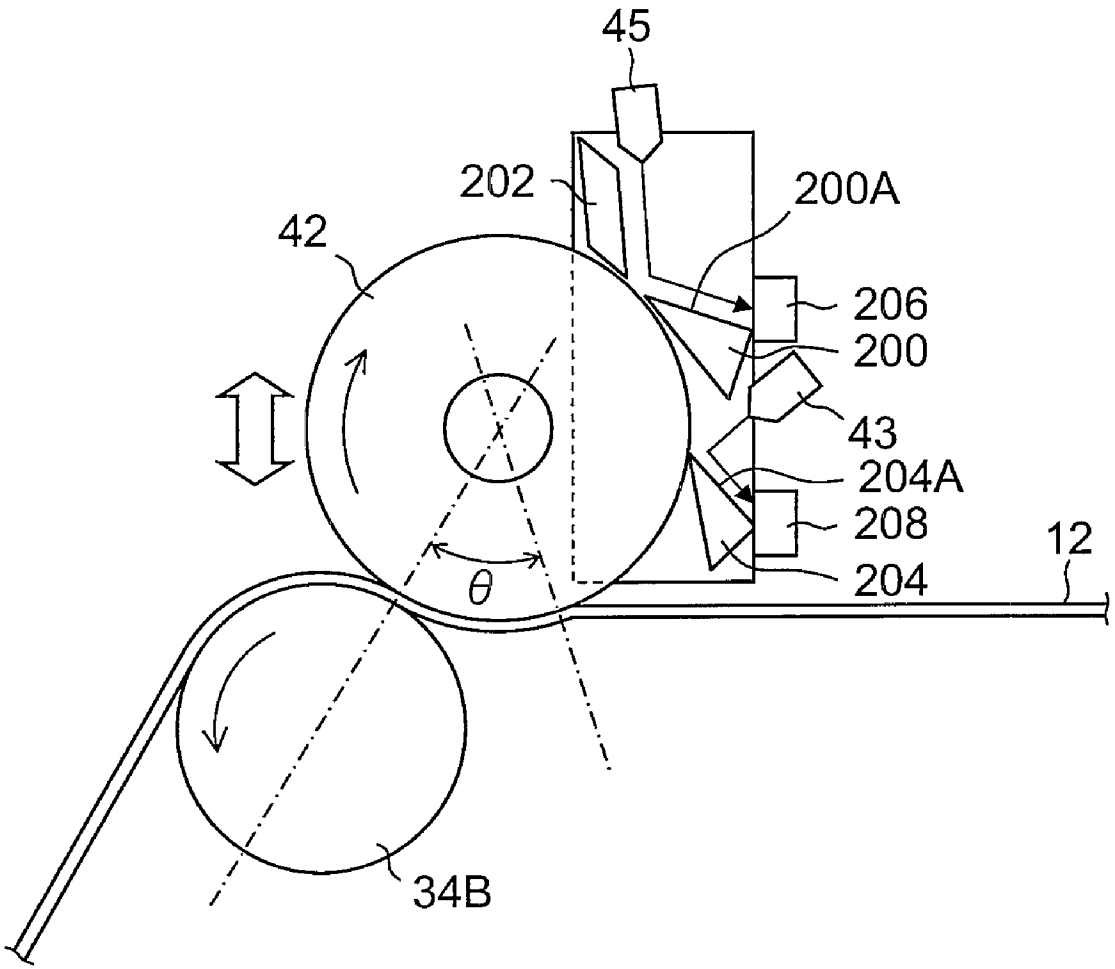
FIG. 28 is a diagram illustrating an example in which a tensioning roller is displaced in the direction of rotation of the solvent removal roller.

As illustrated in FIG. 28, the tensioning roller 34B may be arranged at a displaced position from the solvent removal roller 42 in the direction of rotation of the solvent removal roller 42. By this means, it is possible to increase the amount of winding (the contact length) of the intermediate transfer body 12 with respect to the solvent removal roller 42 by the amount corresponding to the winding angle θ, and therefore a more reliable effect in removing the solvent can be obtained.

Composition of First Cleaning Unit

As illustrated in FIG. 1, which has been described above, the first cleaning unit 30 is a device which cleans the intermediate transfer body 12 by using a washing liquid and it comprises a washing liquid spray unit 60 which sprays a washing liquid, a rotation brush 62 which makes contact with the image forming surface 12A of the intermediate transfer body 12 and rotates in the reverse direction with respect to the direction of conveyance of the intermediate transfer body, and a blade 64 (first wiping device) which slides and wipes the surface of the intermediate transfer body 12.

Furthermore, a heater 65 is arranged on the rear surface side of the intermediate transfer body 12 in the first cleaning unit 30. By means of this heater 65, the permeation of the surfactant into the residual material on the intermediate transfer body 12 is improved and the residual material composed of polymer micro-particles and the like is dissolved. To give one specific example, the intermediate transfer body 12 is heated to 90° C. through 120° C. by the heater 65.

Here, the residual material on the intermediate transfer body 12 is derived from the treatment liquid and ink described above.

The residual material on the intermediate transfer body 12 is separated by the rotation brush 62 which rotates in the reverse direction to the conveyance direction of the intermediate transfer body. The surface of the rotation brush 62 may be provided with brush fibers made from nylon, fluorine resin, or the like.

Moreover, the residual material on the intermediate transfer body 12 is removed by means of a rubber blade 64 composed of EPT (ethylene propylene terpolymer rubber), NBR (nitrile butadiene rubber), fluorine rubber, urethane lubber, and the like.

As described above, the first cleaning unit 30 principally functions as a device which cleans the intermediate transfer body 12 after completing image transfer to the recording medium 14.

Figure 43:
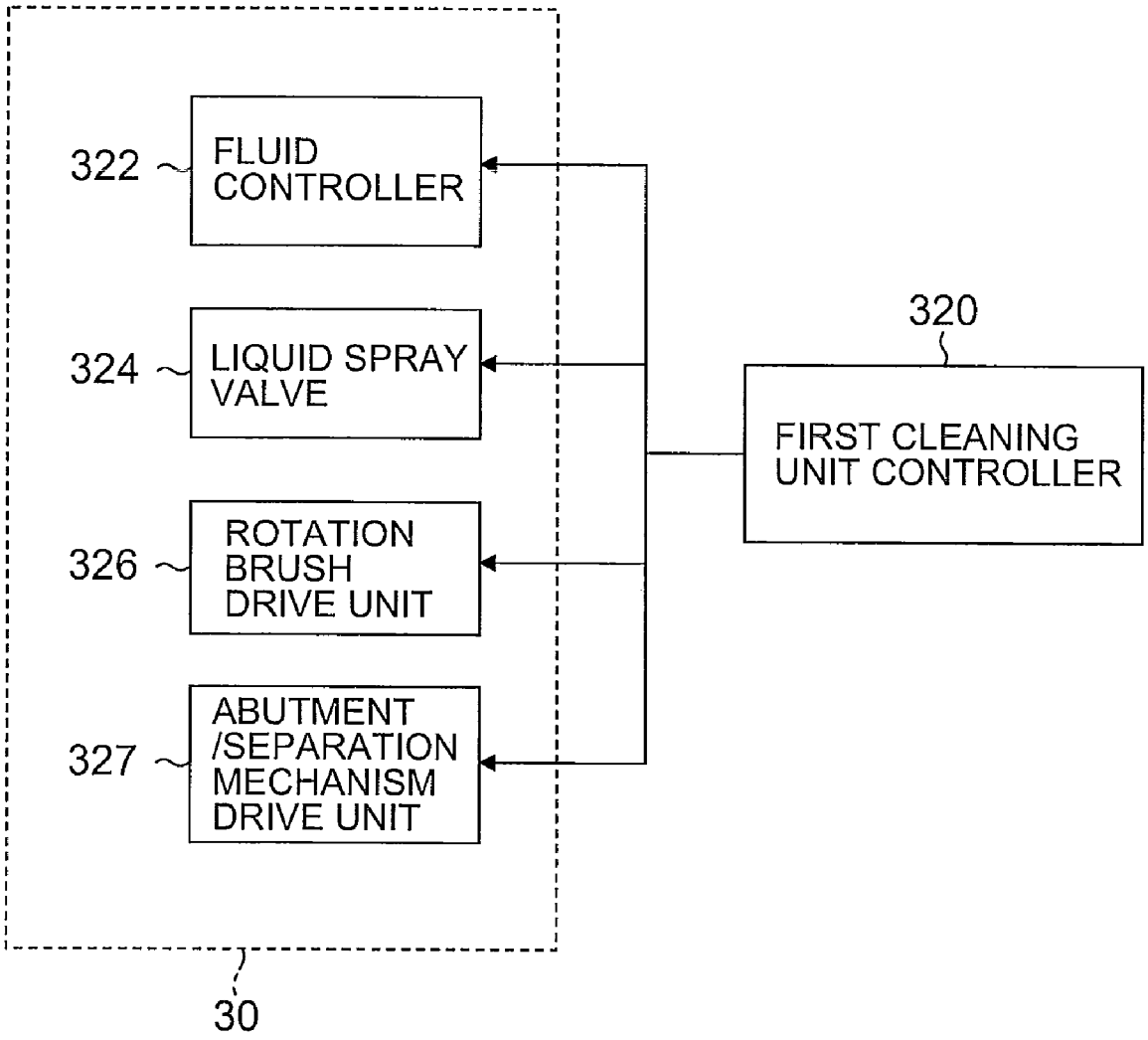
FIG. 43 is a block diagram illustrating the composition of the first cleaning unit controller.

Furthermore, the rotation brush 62 and the blade 64 are supported movably by a movement mechanism (an abutment/separation mechanism drive unit, reference numeral 327 in FIG. 43) which can be controlled so as to switch between a state where the rotation brush 62 and blade 64 are pushed against the intermediate transfer body 12 and a state where these members are separated (withdrawn) from the intermediate transfer body 12.

Figure 29:
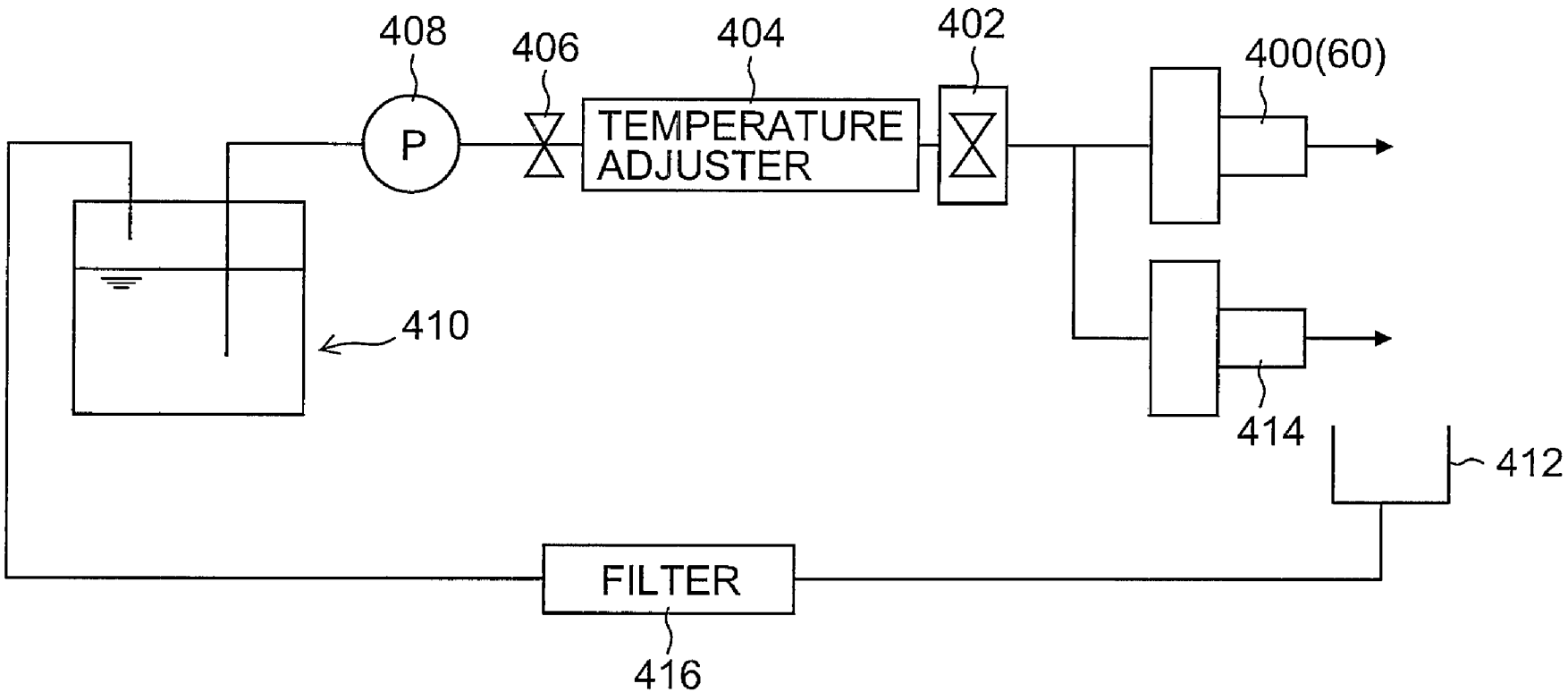
FIG. 29 is an illustrative diagram illustrating an example of the composition of a liquid supply system when one liquid is sprayed in a first cleaning unit.

FIG. 29 is a diagram illustrating an example of the composition of a liquid supply system in a case where one liquid is sprayed. The nozzle body 400 of the washing liquid spray unit 60 is connected to the interior of a storage container 410, via an electromagnetic valve 402, a temperature adjuster 404, a manual valve 406 and a liquid supply pump 408. Furthermore, in order to determine the spraying action, a spray determination sensor for determining the liquid sprayed from the nozzle body 400 (not illustrated; a resistance value determination sensor, a light transmission determination sensor, a spray pressure determination sensor, or the like), is arranged between the nozzle body 400 and the intermediate transfer body 12.

Moreover, in order to ensure the spray width of the liquid for spraying (in the case of the present embodiment, washing liquid), the flow channel between the nozzle body 400 and the electromagnetic valve 402 is branched off and connected to the nozzle body 414. The liquid to be sprayed (in the case of the present embodiment, washing liquid) is stored in the storage container 410, and the storage container 410 is connected to a collection container 412 through a filter 416. The washing liquid which has been sprayed from the nozzle body 400 or the nozzle body 414 is collected by means of the collection container 412 and then sent to the storage container 410 through the filter 416, thereby reusing the washing liquid.

On the basis of this composition, the liquid supplied from the storage container 410 by controlling the liquid supply pump 408 is heated to a prescribed temperature (for example, 50° C. through 90° C.) by the temperature adjuster 404, and is then sent to the nozzle body 400 or the nozzle body 414 via the electromagnetic valve 402. The spray of liquid from the nozzle body 400 and the nozzle body 414 can be switched by switching the electromagnetic valve 402 on and off.

Figure 30:
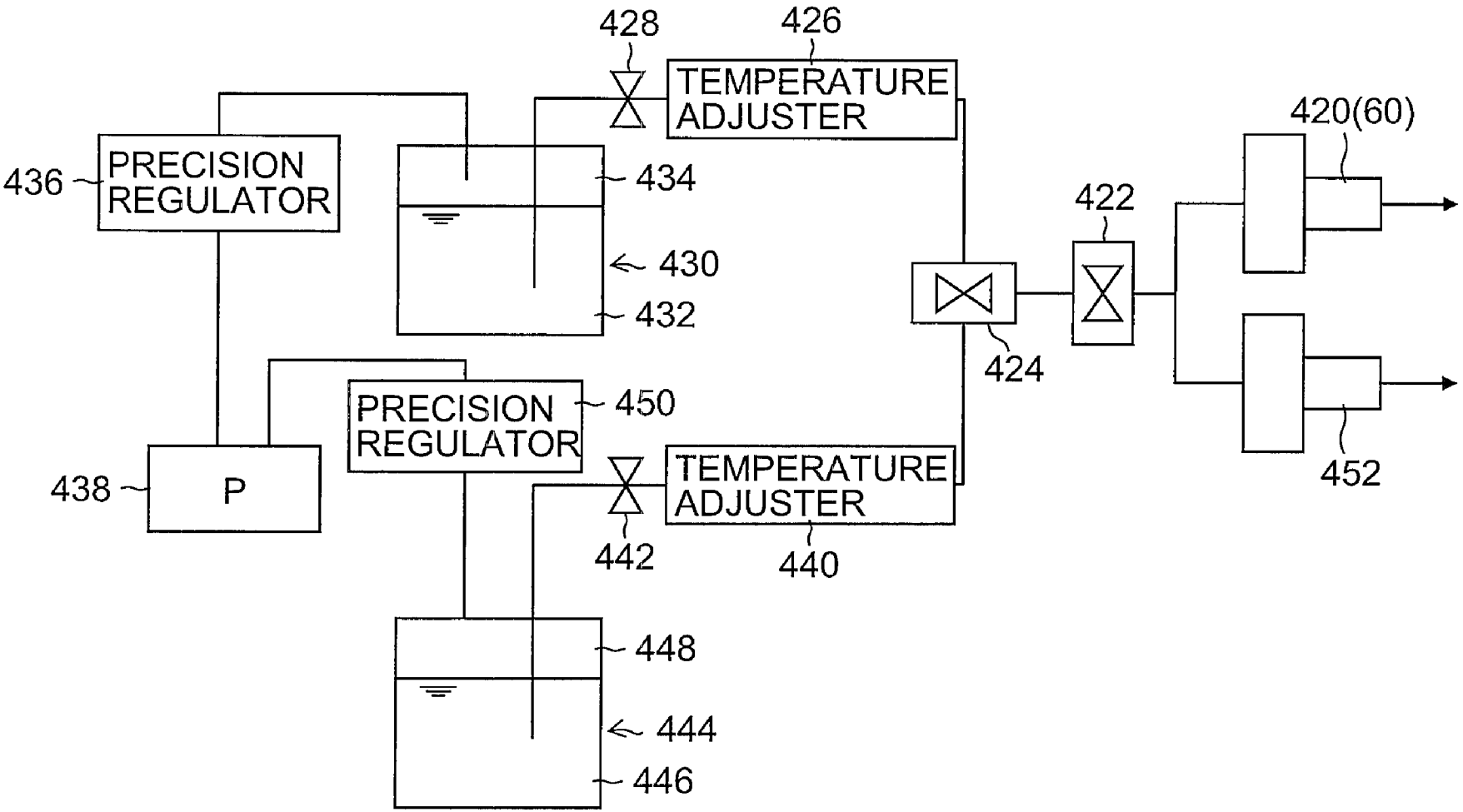
FIG. 30 is an illustrative diagram illustrating an example of the composition of a liquid supply system when two liquids are sprayed in the first cleaning unit.

FIG. 30 is a diagram illustrating an example of the composition of a liquid supply system in a case where two liquids are sprayed. The nozzle body 420 of the washing liquid spray unit 60 is connected to the liquid layer 432 in a pressure container 430 via an electromagnetic valve 422, a switching valve 424, a temperature adjuster 426, and a manual valve 428. The liquid to be sprayed (in the present embodiment, the washing liquid) is stored in a sealed pressure container 430, and the gas layer 434 in the pressure container 430 is connected to the compressor 438 via a precision regulator 436 which enables the pressure to be changed and controlled.

The switching valve 424 is also connected to the liquid layer 446 in the pressure container 444 via the temperature adjuster 440 and the manual valve 442. The liquid to be sprayed (in the present embodiment, distilled water, purified water, or the like) is stored in a sealed pressure container 444, and the gas layer 448 in the pressure container 444 is connected to the compressor 438 via a precision regulator 450 which enables the pressure to be changed and controlled.

Furthermore, in order to determine the spraying action, a spray determination sensor for detecting the liquid sprayed from the nozzle body 420 (not illustrated; a resistance value determination sensor, a light transmission determination sensor, a spray pressure determination sensor, or the like), is arranged between the nozzle body 420 and the intermediate transfer body 12.

Moreover, in order to ensure the spray width of the sprayed liquid (in the case of the present embodiment, washing liquid, purified water, distilled water, or the like), the flow channel between the nozzle body 420 and the electromagnetic valve 422 is branched off and connected to the nozzle body 452.

On the basis of this composition, the pressure of the liquid (in the present embodiment, the washing liquid) supplied from the pressure container 430 is adjusted by controlling the variable precision regulator 436 and thereby changing the pressure inside the pressure container 430. The liquid supplied from the pressure container 430 is heated to a prescribed temperature by the temperature adjuster 426, and is supplied to the nozzle body 420 and nozzle body 452 via the switching valve 424 and the electromagnetic valve 422. The spray of liquid from the nozzle body 420 or the nozzle body 452 is switched on and off by switching the electromagnetic valve 422 on and off, and the spraying pressure (in other words, the sprayed amount and the spraying width from the nozzle body 420 and the nozzle body 452) is changed by controlling the pressure of the variable precision regulator 436.

Furthermore, the pressure of the liquid supplied from the pressure container 444 is adjusted by controlling the precision regulator 450 and thereby changing the pressure inside the pressure container 444. The liquid supplied from the pressure container 444 (in the present embodiment, purified water, distilled water, or the like) is heated to a prescribed temperature by the temperature adjuster 440, and is supplied to the nozzle body 420 and the nozzle body 452 via the switching valve 424 and the electromagnetic valve 422. The spray of liquid from the nozzle body 420 or the nozzle body 452 is switched on and off by switching the electromagnetic valve 422 on and off, and the spraying pressure (in other words, the sprayed amount and the spraying width from the nozzle body 420 and the nozzle body 452) is changed by controlling the pressure of the precision regulator 450.

Desirably, an aqueous liquid containing high-boiling-point solvent which includes a surfactant similar to that of the aggregating treatment agent and ink, is used as the washing liquid, and it is also possible to use the liquid which has been collected by the solvent removal unit 24 described above. Moreover, desirably, the washing liquid collected in the collection container 412 is reused after being filtered through a filter 416, and the concentration thereof may be adjusted by using purified water, or the like. Table 6 indicates one example of the prepared washing liquid.

TABLE 6

| Material | Weight % |
|---|---|
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 69 |

Furthermore, as one example of a spraying member used in the washing liquid spray unit 60, it is possible to use the single-fluid flat spray nozzle of the treatment liquid spray unit 152 described above. Moreover, it is also possible to achieve a required spraying width by arranging a plurality of the single-fluid flat spray nozzles in the breadthways direction.

Furthermore, in order to improve the cleaning properties yet further, it is also possible to provide a plurality of rotating brushes 62 and blades 64.

Composition of Second Cleaning Unit

Figure 31:
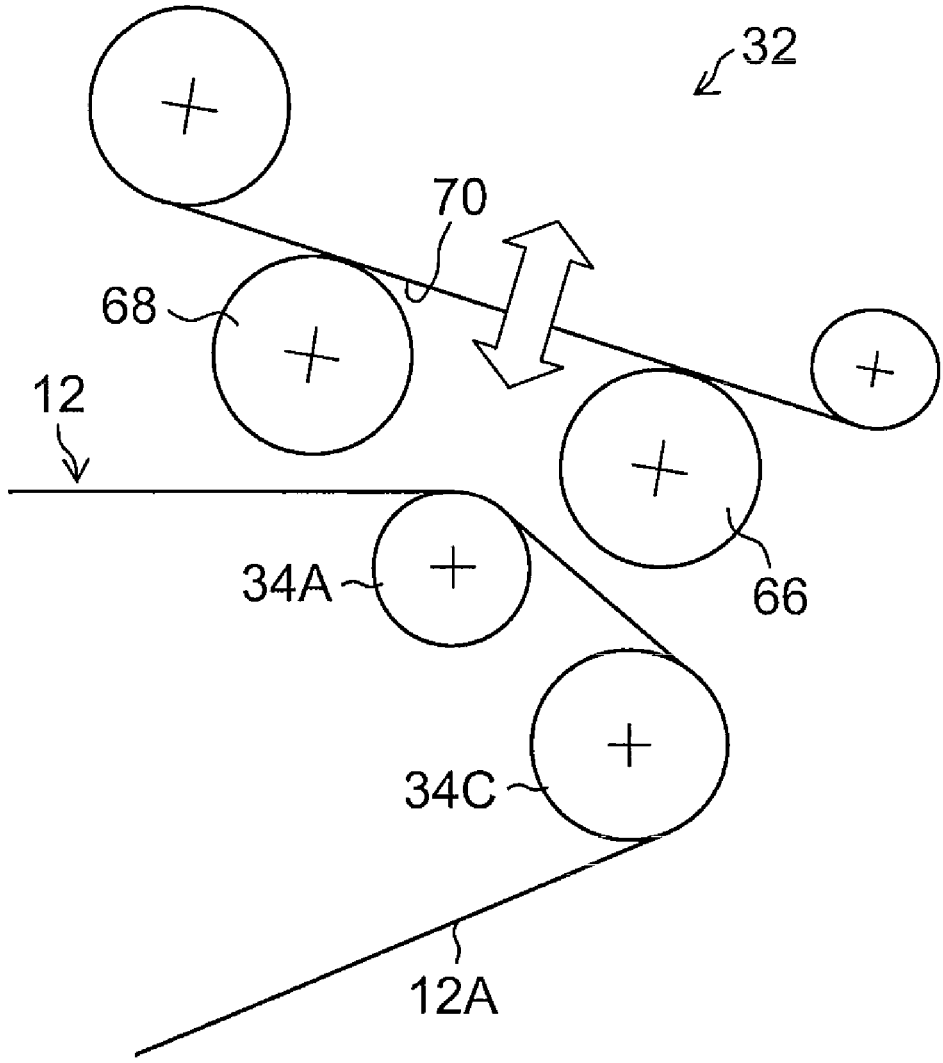
FIG. 31 is an enlarged diagram of a portion of the second cleaning unit.

FIG. 31 is an enlarged diagram of a portion of the second cleaning unit 32 illustrated in FIG. 1. As illustrated in FIG. 31, the second cleaning unit 32 is constituted by adhesive rollers 66 and 68 which are switchable between the contact state and the separation state with respect to the surface (12A) of the intermediate transfer body 12, and a cleaning web (or adhesive belt) 70 which is able to make contact with these adhesive rollers 66 and 68. As illustrated in FIG. 1, the second cleaning unit 32 is arranged at a position opposing the tensioning roller 34A.

In this way, by arranging the second cleaning unit 32 at a position opposing the tensioning roller 34A, the adhesive rollers 66 and 68 are located respectively before and after the vertex (point of reverse) where the direction of conveyance of the intermediate transfer body 12 changes. Therefore, a tension is generated in the vicinity of the reverse point of the direction of conveyance of the intermediate transfer body 12, and the residual material on the intermediate transfer body 12 can therefore be removed more readily due to the generated tension.

The adhesive rollers 66 and 68 have a higher adhesive force than the intermediate transfer body 12, and as a more specific example, desirably, they are formed of a butyl rubber or urethane rubber, or the like, which has an adhesive force of 20 hpa through 200 hpa (measurement method conforming to JIS-K-6256). Furthermore, desirably, the adhesive rollers 66 and 68 are set to have a broader width than the intermediate transfer body 12.

By rotating the adhesive rollers 66 and 68 while they are in contact with the intermediate transfer body 12 when the apparatus is not forming images, for instance, when the inkjet recording apparatus is started up, during standby, during batch processing, during print initialization immediately before transferring to image formation, or in other such circumstances, then it is possible to cause the foreign matter on the intermediate transfer body 12 to be attached to the adhesive rollers 66 and 68, thereby removing the foreign matter (dust) from the surface 12A of the intermediate transfer body 12 and thus cleaning the intermediate transfer body 12. The cleaning method is described later in more detail.

The foreign material which has become attached to the surface of the adhesive rollers 66 and 68 can be transferred to the cleaning web (or the adhesive belt) 70, by separating the adhesive rollers 66 and 68 from the intermediate transfer body 12 and rotating the adhesive rollers 66 and 68 while they are in contact with the cleaning web (or adhesive belt) 70. Consequently, it is possible to clean the surface of the adhesive rollers 66 and 68.

Figure 32:
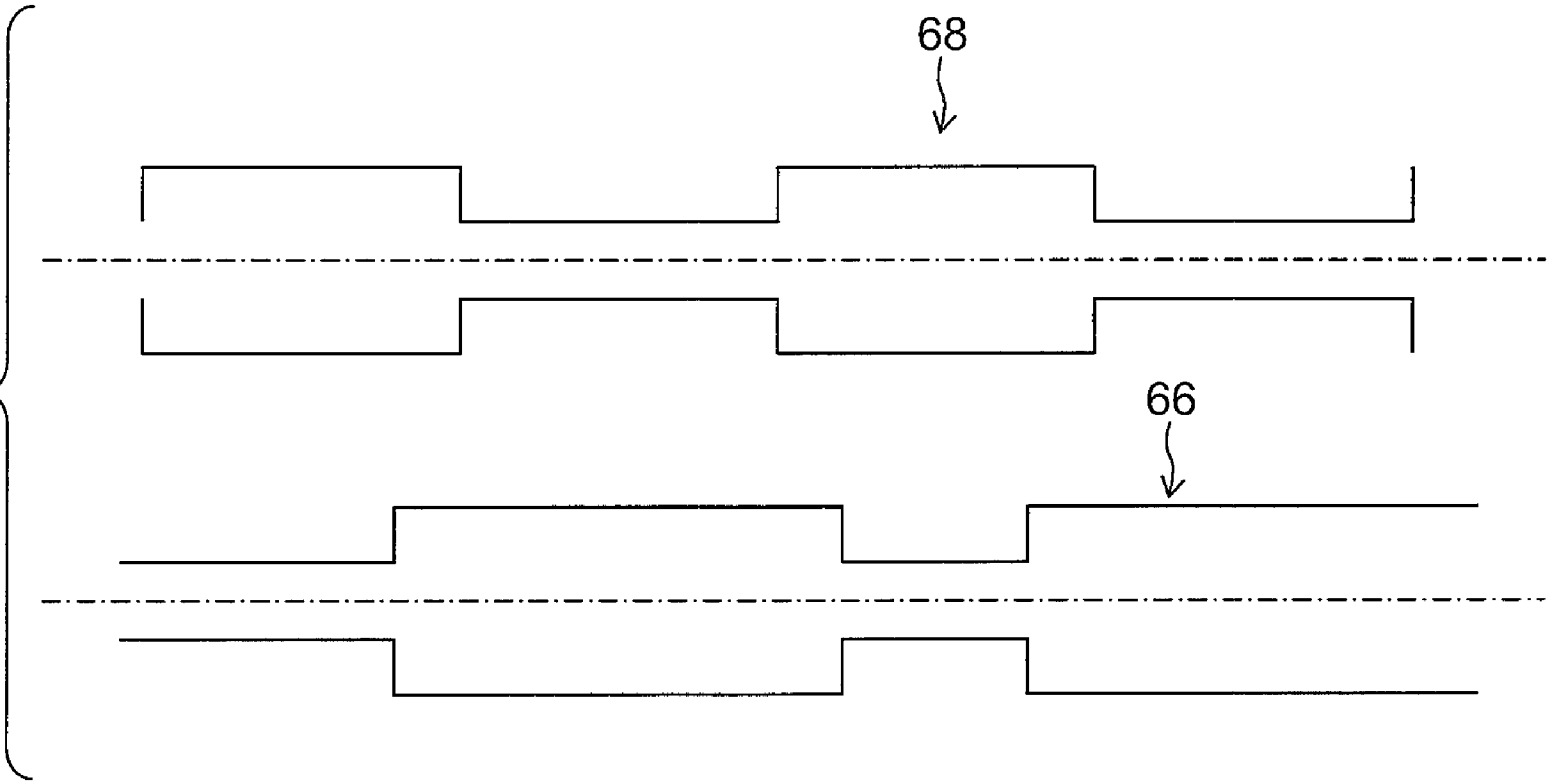
FIG. 32 is a plan view diagram illustrating an example in which the adhesive rollers are divided in a two-step fashion in the shape of a comb, as viewed from the direction perpendicular to the axis direction of the adhesive rollers.

FIG. 32 is a plan view diagram illustrating an example in which the adhesive rollers 66 and 68 are divided in a two-step fashion in the shape of a comb, as viewed from the direction perpendicular to the axis direction of the adhesive rollers 66 and 68. As illustrated in FIG. 32, by dividing the adhesive rollers 66 and 68 in a two-step comb shape, the adhesive force of the adhesive rollers 66 and 68 is distributed, and sticking of the rollers to the intermediate transfer body 12 can be prevented.

Desirably, the adhesive rollers 66 and 68 are periodically detached and the surfaces thereof are polished and refreshed. Furthermore, the cleaning web 70 may also be kept in contact with the adhesive rollers 66 and 68 at all times.

Furthermore, instead of the adhesive rollers 66 and 68, it is also possible to adopt a composition using a web coated with adhesive, which is wound in multiple layers, the surface of the web being peeled away appropriately.

Composition of the Soiling Determination Unit

Figure 33:
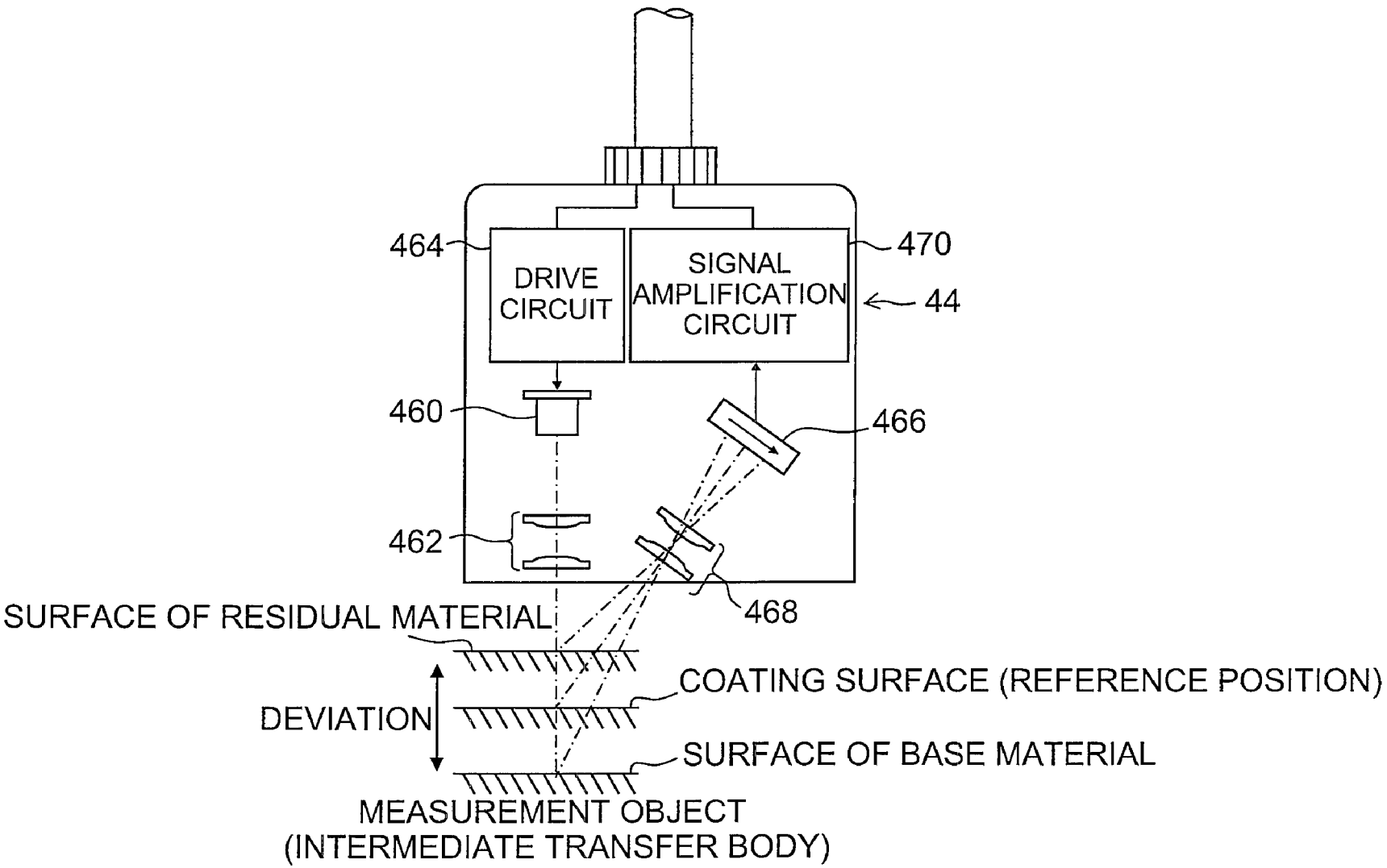
FIG. 33 is an enlarged diagram of a soiling determination unit.

FIG. 33 is an enlarged diagram of the soiling determination unit 44. As illustrated in FIG. 33, the soiling determination unit 44 includes a laser displacement sensor. More specifically, the soiling determination unit 44 is constituted by a semiconductor laser light source 460, a light transmitting lens system 462, a drive circuit 464, a light position determination element 466, a light receiving lens system 468, a signal amplification circuit 470, and the like.

The semiconductor laser light source 460 is driven by the drive circuit 464, and the laser light is irradiated onto the measurement object through the light transmitting lens system 462. The laser light which has been irradiated onto the measurement object and reflected by same is read in by the light position determination element 466 through the light receiving lens system 468, and a determination signal is generated by the light position determination element 466. The determination signal is then sent to the signal amplification circuit 470 and is then amplified by the signal amplification circuit 470. On the basis of the amplified determination signal, the system controller 272 (see FIG. 40), which is described later, calculates the distance to the measurement object, and the amount of displacement of the measurement object from the reference position.

One concrete example of a semiconductor laser light which is irradiated from the semiconductor laser light source 460 is laser light having a wavelength of 410 nm or 670 nm. Furthermore, the distance to the measurement object may be calculated by using a triangulation method.

As described above, the intermediate transfer body 12 includes a base material of polyimide, or the like, and the base material is coated with a coating layer that is composed of silicon rubber, fluorine rubber, a fluorine elastomer, or the like and has a thickness of approximately 30 μm through 150 μm. The coating layer typically has light permeable properties and the laser light can pass readily through the coating layer, but if residual material is adhering on the coating layer, then surface reflection occurs and the reflection distance changes. Consequently, by calculating the amount of displacement of the measurement object from the reference position, it is possible to determine soiling in a stable and reliable fashion compared to a measurement method based on the amount of reflected light, even in cases where high-boiling-point solvent, acid, polymer micro-particles, or the like, are left in a thin layer (for example, 0.5 μm through 5 μm) over the whole surface.

To describe this method with reference to FIG. 33, the measurement object is the intermediate transfer body 12 in which the base material composed of polyimide or the like is coated with the coating layer composed of silicon rubber, fluorine rubber, fluorine elastomer, or the like. The coating layer has a coating surface that is taken as the reference position.

Here, if there is no residual material present on the coating surface, then the laser light which is emitted toward the intermediate transfer body 12 through the light transmitting lens system 462 passes through the coating surface and the coating layer, and is reflected by the surface of the base material. The reflected laser light is then taken into the light position determination element 466 via the light receiving lens system 468.

If, on the other hand, the residual material is present on the coating surface and forms a residual material surface as illustrated in FIG. 33, then the laser light emitted toward the intermediate transfer body 12 through the light transmitting lens system 462 does not pass through the residual material, but rather is reflected by the residual material surface. The reflected laser light is then taken into the light position determination element 466 through the light receiving lens system 468.

Consequently, soiling is determined on the basis of the difference between the displacement from the surface of the base material to the coating surface (reference position), and the displacement from the surface of the base material to the surface of the residual material.

Cleaning of Intermediate Transfer Body

FIGS. 34 through 37 are flowchart diagrams illustrating an operational sequence relating to the cleaning of the intermediate transfer body.

Figure 34:
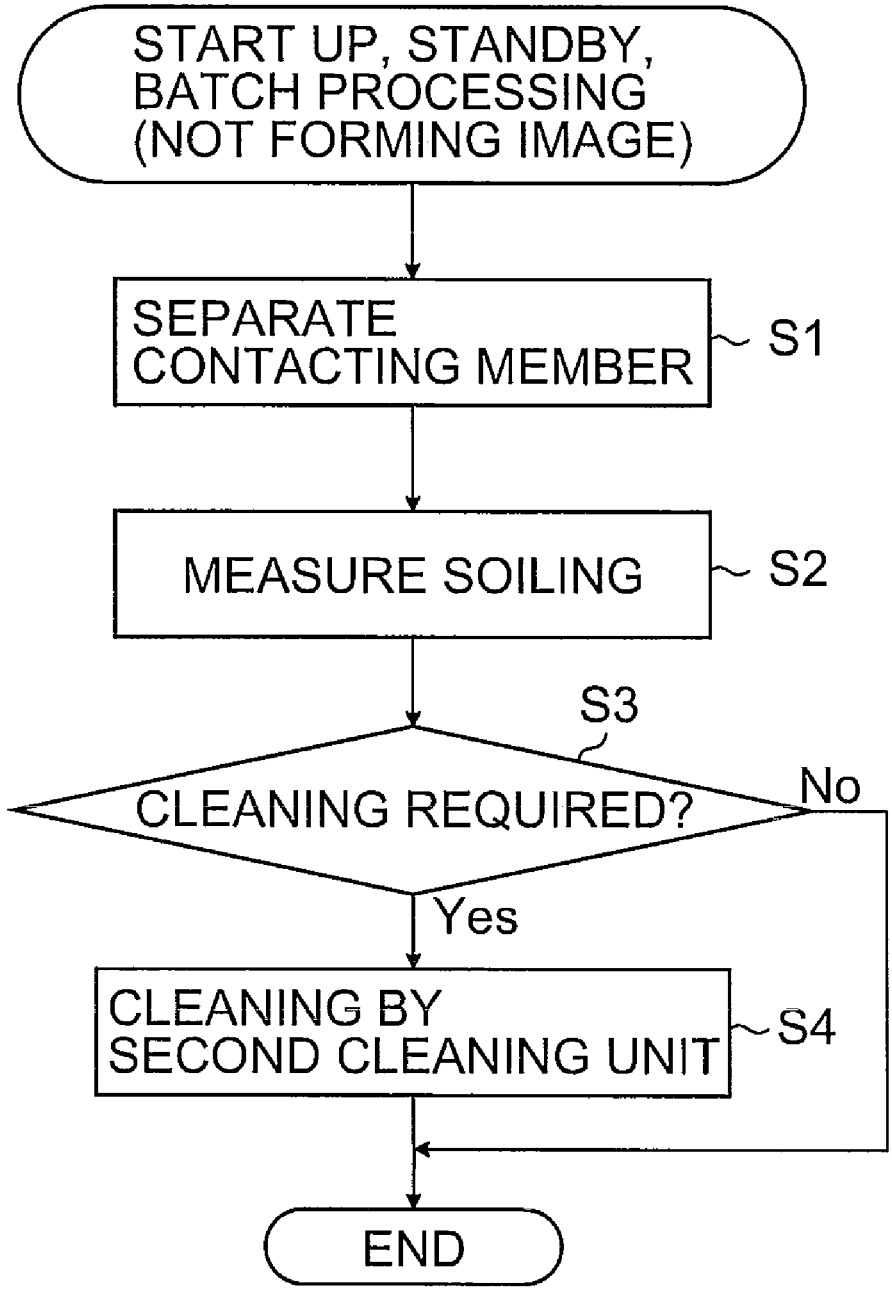
FIG. 34 is a flowchart illustrating an operational sequence for carrying out cleaning by a second cleaning unit, when the inkjet recording apparatus is not forming images, for instance, when the apparatus is started up, at standby, or carrying out batch processing.

FIG. 34 is a flowchart diagram illustrating an operational sequence for carrying out cleaning by means of a second cleaning unit 32, when the inkjet recording apparatus is not forming images, for instance, when the apparatus is started up, at standby, or carrying out batch processing. As illustrated in FIG. 34, all of the members which are in contact with the intermediate transfer body 12 are separated from the intermediate transfer body 12 (step S1). Here, "all of the members which are in contact with the intermediate transfer body 12" means all of the members that make contact with the image forming surface of the intermediate transfer body 12, namely, the spiral roller 38 of the treatment liquid application unit 16, the solvent removal roller 42 of the solvent removal unit 24, the pressurization roller 48 of the transfer unit 26, and so on.

Next, the soiling of the intermediate transfer body 12 is determined by the soiling determination unit 44 (soiling determination step; step S2). Thereupon, it is judged whether or not cleaning is required, on the basis of the determination results (step S3). More specifically, in FIG. 33, if the difference between the displacement from the base material surface to the coating surface (reference position) and the displacement from the base material surface to the residual material surface is equal to or greater than a prescribed value, then it is judged that cleaning by the second cleaning unit 32 is required. If it is judged that cleaning is required (YES), then cleaning (a second cleaning step) is carried out by the second cleaning unit 32 (step S4), and the procedure then terminates. On the other hand, if it is judged that cleaning is not required (NO), then the operational sequence is terminated directly.

It is also possible to carry out cleaning by means of the second cleaning unit 32, compulsorily, without determining the soiling on the intermediate transfer body 12 by the soiling determination unit 44, in cases where the inkjet recording apparatus is not forming images, for instance, when the apparatus is started up, at standby or carrying out batch processing.

Furthermore, if there is a large amount of residual material, then it is possible to repeat cleaning by the adhesive rollers 66 and 68, and furthermore, it is also possible to combine cleaning by the first cleaning unit 30. When cleaning by the first cleaning unit 30 is not carried out, then the rotation brush 62 and the blade 64 are controlled so as to separate from the intermediate transfer body 12 (a withdrawn (retracted) state), by means of the movement mechanism (an abutment/separation mechanism drive unit, indicated by reference numeral 327 in FIG. 43).

As described above, if the adhesive rollers 66 and 68 are used, then the adhering matter, such as small amounts of coloring material and paper dust which have been attached to the intermediate transfer body 12, can be removed more reliably over the entire width of the intermediate transfer body 12, in comparison with washing by using a liquid.

Figure 35:
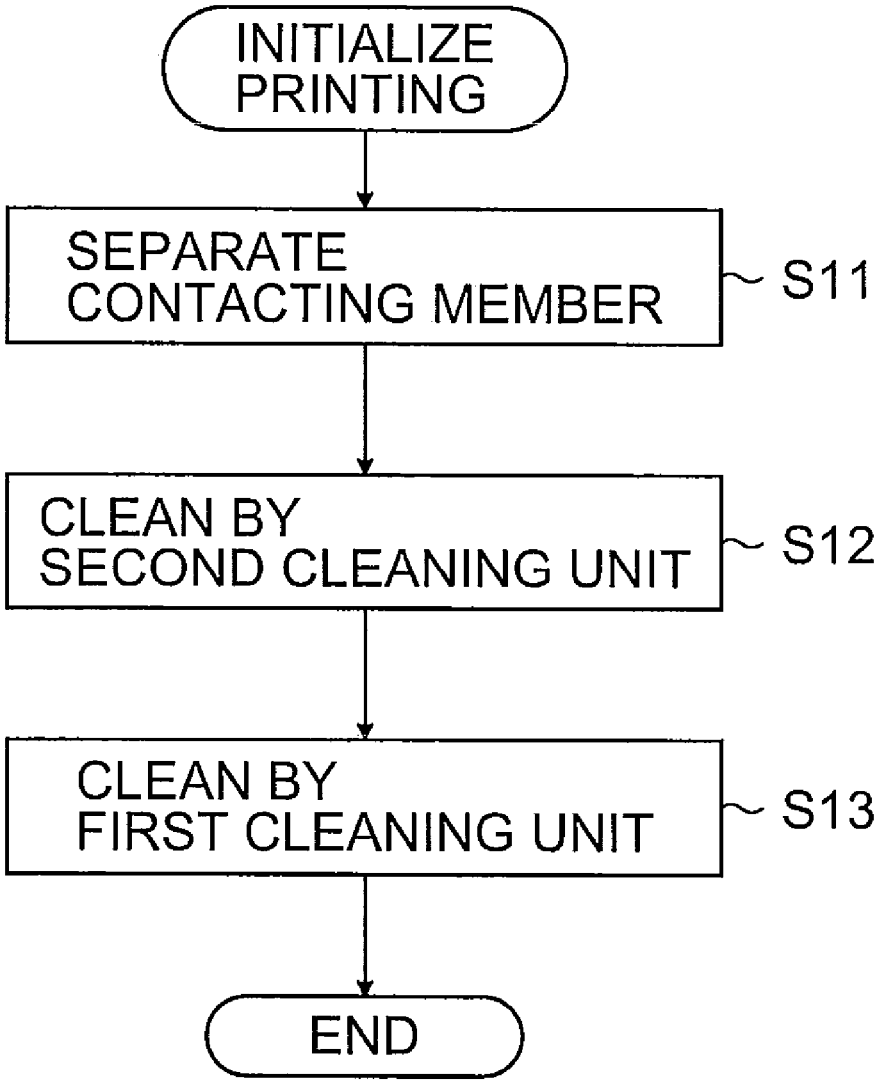
FIG. 35 is a flowchart illustrating an operational sequence for stabilizing the surface of the intermediate transfer body in initialization for printing, immediately before transferring from a non-image forming state to an image forming state.

FIG. 35 is a flowchart diagram illustrating an operational sequence for the purpose of stabilizing the surface of the intermediate transfer body 12 in initialization for printing, immediately before transferring from a non-image forming state to an image forming state, for example, before entering an image forming state from a standby state after starting up of the inkjet recording apparatus. As illustrated in FIG. 35, all of the members which make contact with the intermediate transfer body 12 are separated from the intermediate transfer body 12 (step S11). Thereupon, cleaning is carried out by means of the second cleaning unit 32 (step S12). Next, cleaning (a first cleaning step) is carried out by means of the first cleaning unit 30 (step S13), whereupon the operational sequence is terminated.

In this way, immediately before transferring from non-image formation to image formation, cleaning by the second cleaning unit 32 is carried out and then cleaning by the first cleaning unit 30 is carried out. By this means, even in cases where hard dust particles, such as grit particles, have become attached to the intermediate transfer body 12 due to the inflow of external air used for cooling the interior of the inkjet recording apparatus, the generation of dust inside the apparatus, or the performance of maintenance work or the like, it is still possible to prevent this hard dust from entering in between rotation brush 62 and the blade 64 during cleaning by the first cleaning unit 30. Thus, it is possible to prevent the damage, such as scratches, to the intermediate transfer body 12.

At step S12, by setting the temperature of the intermediate transfer body 12 to be less than the melting temperature of the polymer component of the residual material, it is possible to prevent the dust particles from fusing onto the intermediate transfer body 12, even if a small amount of polymer component is left remaining on the intermediate transfer body 12. It is therefore possible to achieve more reliable cleaning of the intermediate transfer body 12.

Figure 36:
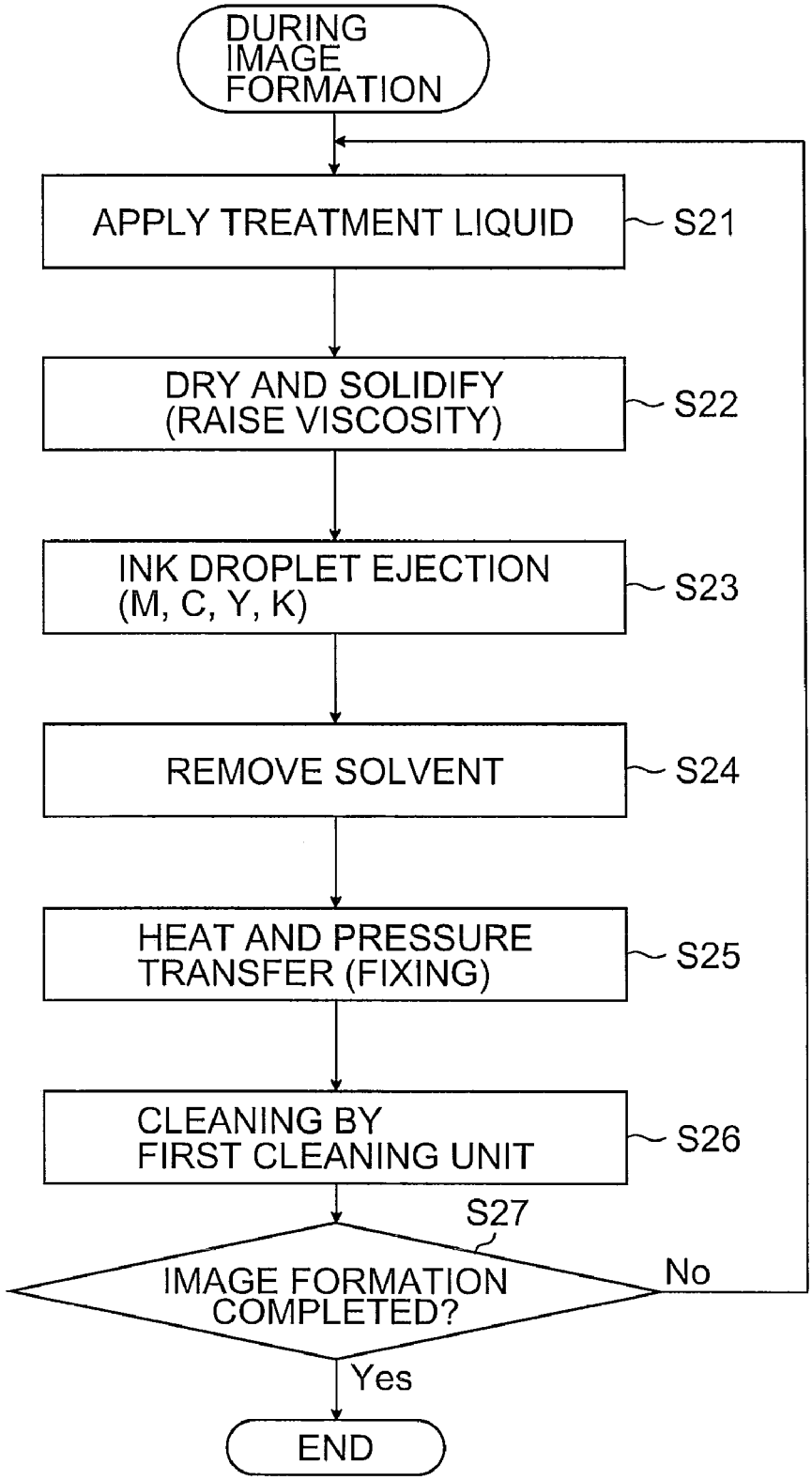
FIG. 36 is a flowchart illustrating an operational sequence for carrying out image formation while performing continuous cleaning by means of the first cleaning unit.

FIG. 36 is a flowchart diagram illustrating an operational sequence for carrying out image formation while performing continuous cleaning by means of the first cleaning unit 30. As illustrated in FIG. 36, a treatment liquid (aggregating treatment agent) which forms an undercoating liquid is applied onto the intermediate transfer body 12 by the treatment liquid application unit 16 (liquid application step, step S21). Thereupon, the applied treatment liquid is heated by passing through a heating unit 18, and the solvent component is evaporated and dried (step S22). Consequently, an aggregating treatment agent layer which is in a solid state or a semi-solid state (namely, a thin film layer in which the treatment liquid has dried) is formed on the surface of the intermediate transfer body 12.

Subsequently, droplet ejection is carried out onto the aggregating treatment agent layer by ejecting pigment-based inks of respective colors (C, M, Y, K) from the heads 22Y, 22M, 22C, 22K of the print 22, in accordance with the image signal (liquid deposition step; step S23). Thereupon, the solvent (residual solvent) component which has separated from the aggregated pigment material is removed from the intermediate transfer body 12 by the solvent removal roller 42 of the solvent removal unit 24 (step S24). The primary image thus formed on the intermediate transfer body 12 is then transferred to the recording medium 14 (step S25).

Thereupon, the intermediate transfer body 12 is cleaned by means of the first cleaning unit 30 (step S26). Next, it is judged whether or not image formation is to be continued (step S27), and if image formation is to be continued (YES), then the procedure returns to step S21 again, whereas if image formation is not to be continued (NO), then the operational sequence is terminated.

During image formation, it is possible to separate the adhesive rollers 66 and 68 of the second cleaning unit 32 from the intermediate transfer body 12 and to bias the adhesive rollers 66 and 68 against the low-speed wrapping web which employs a nonwoven cloth impregnated with a water-based or oil-based washing liquid, or the like, for the purpose of cleaning the adhesive rollers 66 and 68. Moreover, it is also possible to bias the adhesive rollers 66 and 68 against an adhesive belt having a stronger adhesive force than the adhesive rollers 66 and 68 to clean the adhesive rollers 66 and 68.

Figure 37:
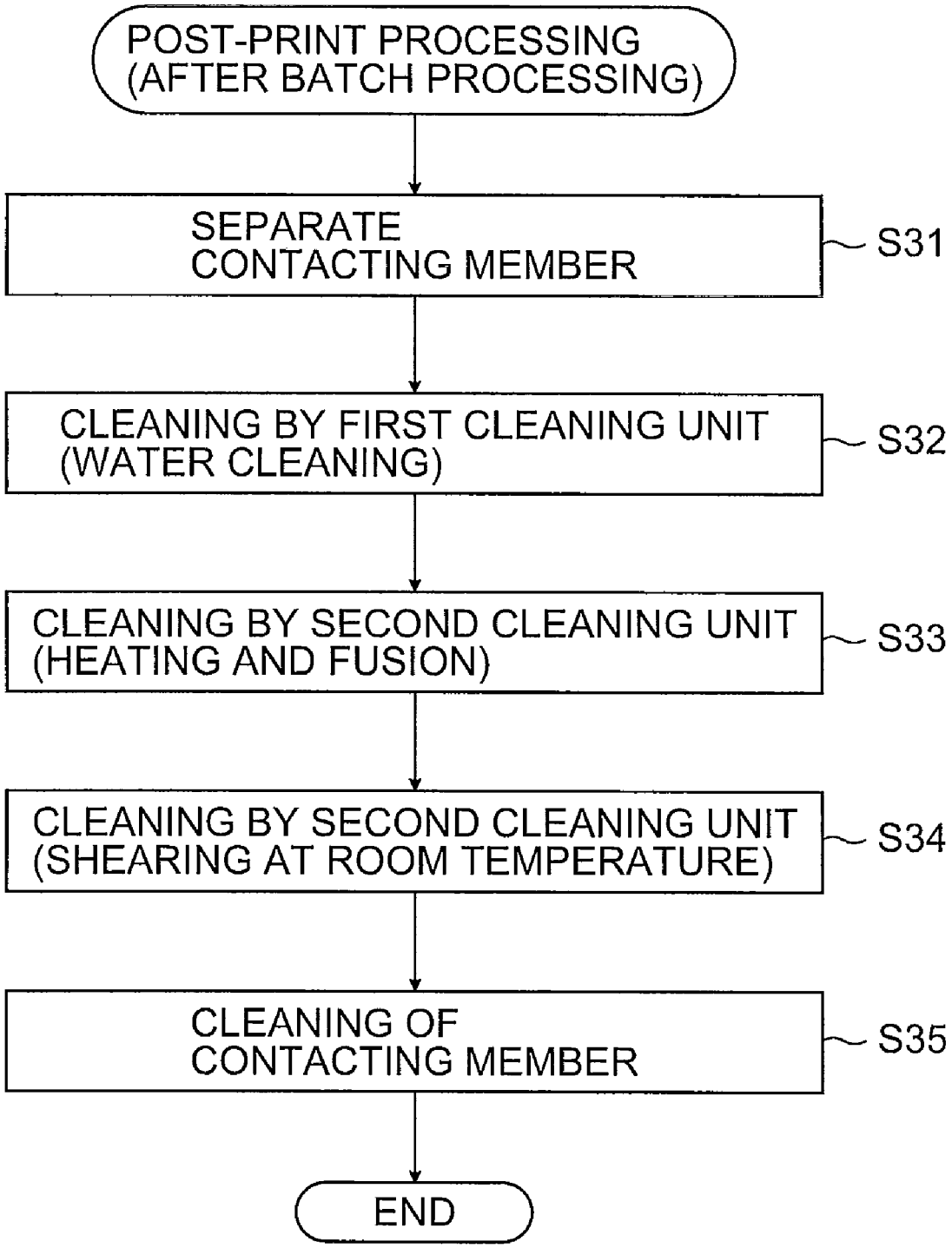
FIG. 37 is a flowchart diagram illustrating an operational sequence for cleaning the intermediate transfer body in a print post-processing step, when the apparatus has completed image formation (batch processing) and is no longer forming images.

FIG. 37 is a flowchart diagram illustrating an operational sequence for cleaning the intermediate transfer body 12 in a post-print processing step, when the apparatus has completed image formation (batch processing) and is no longer forming images. As illustrated in FIG. 37, all of the members which make contact with the intermediate transfer body 12 are separated from the intermediate transfer body 12 (step S31).

Thereupon, cleaning is carried out by means of the first cleaning unit 30 (step S32). In this case, cleaning is carried out by using a liquid (second liquid; a liquid having a small content of high-boiling-point solvent and surfactant) which has a water content ratio higher than the washing liquid (first liquid). More specifically, before carrying out cleaning by means of the second cleaning unit 32, cleaning is performed in the first cleaning unit 30 by adjusting the switching valve 424 (FIG. 30) and spraying water, such as purified water or distilled water, from the washing liquid spray unit 60. By this means, the high-boiling-point solvent (e.g., glycerine or diethylene glycol, the surfactant and the acid contained in the aggregating treatment agent and ink that are present as the residual matter on the intermediate transfer body 12) is diluted and removed, and therefore the cleaning performed by the second cleaning unit 32 can be carried out even more effectively.

When cleaning is carried out by the first cleaning unit 30, it is possible to suppress the evaporation of the sprayed liquid having a high water content ratio by lowering the temperature of the intermediate transfer body 12, and it is also possible to increase the amount of water sprayed from the washing liquid spray unit 60 onto the intermediate transfer body 12 by adjusting the pressure of the gas layer 448 in the pressure container 444 by means of the precision regulator 450. Consequently, the amount of the residual material on the intermediate transfer body 12 is reduced and therefore it is possible to carry out the cleaning by the second cleaning unit 32 even more effectively.

Thereupon, cleaning based on heating and melting is carried out by means of the second cleaning unit 32 (step S33). Here, the cleaning by heating and melting is described below.

Firstly, the intermediate transfer body 12 is rotated while being heated for 1 through 3 minutes by either one of the heater 65 of the first cleaning unit 30 or the heating unit 18, or by both the heater 65 of the first cleaning unit 30 and the heating unit 18 (an intermediate transfer body temperature adjustment step), and then the adhesive rollers 66 and 68 are placed in contact with the intermediate transfer body 12 which has been raised in temperature. In this case, the temperature of the heater 65 or the heating unit 18 is desirably set to either a temperature at which the water in the residual material is evaporated from the intermediate transfer body 12, or a temperature at which the polymer micro-particles melt, or it is set to a temperature at which the water in the residual material evaporates from the intermediate transfer body 12 and the polymer micro-particles melt. More specifically, if the polymer micro-particles are micro-particles of a non-crystalline polymer, then desirably, the temperature is set to a temperature equal to or greater than the glass transition temperature (for example, 50° C. or above in the case of an acrylic-based polymer). Furthermore, if the polymer micro-particles are a crystalline polymer, then desirably the temperature is set to be equal or greater than the melting point (for example, 110° C. or above in the case of an ethylene polymer, and 70° C. or above in the case of a wax polymer). It is also possible to reduce the conveyance speed of the intermediate transfer body 12 compared to the speed during image formation, when the temperature is raised.

By performing heating and drying by setting the temperature in this way, the residual material assumes a semi-solid state. In this case, if it is sought to remove the residual material with the blade 64 of the first cleaning unit 30, then there is a possibility of the occurrence of a stick and slip effect, and a possibility of causing damage to the intermediate transfer body 12 by friction. However, by removing this material by means of the adhesive rollers 66 and 68 instead of the blade 64, then it is possible to clean the intermediate transfer body 12 reliably over the entire width thereof, without the possibility of causing damage to the intermediate transfer body 12.

If the rotation brush 62 of the first cleaning unit 30 is biased against the intermediate transfer body 12 when the intermediate transfer body 12 is rotated while controlling the heater 65, then this is effective in detaching melted micro-particles of polymer, and the like, from the intermediate transfer body 12. Durability of the rotation brush 62 can be enhanced by using a heatproof and liquid-proof material such the fibers of the brush, such as nylon 66, or PPS (polyphenylene sulfide), PFA (a tetrafluoroethylene/perfluoroalkyl vinyl ether copolymer), or the like.

Furthermore, if the intermediate transfer body 12 is rotated while being heated by the heating unit 18, then the cooler 20 involved in the aggregating treatment agent drying step is also controlled in such a manner that the temperature of the intermediate transfer body 12 falls to less than the melting temperature of the polymer component (intermediate transfer body temperature adjustment step), and beneficial effects are obtained if this thermal cycle is repeated in the intermediate transfer body 12, since the residual material becomes more liable detach from the intermediate transfer body 12 due to the combined effects of thermal warping and the curvature of rotation.

As described above, it is possible to perform the cleaning of the second cleaning unit 32 more efficiently by heating and melting the residual material on the intermediate transfer body 12. This is because water contained in the residual material evaporates and moreover the viscosity of the residual material (viscosity of the polymer particles) decreases when the residual material is heated and melted.

Thereupon, cleaning based on a shearing action at normal temperature is carried out by means of the second cleaning unit 32 (step S34). Here, the cleaning by shearing at normal temperature is described below.

In order to perform the cleaning based on a shearing action, a torque limiter (not illustrated), or the like, is provided via an electromagnetic clutch, or the like, on the adhesive rollers 66 and 68, in such a manner that a rotational load can be applied to the adhesive rollers 66 and 68. Thereupon, the intermediate transfer body 12 is set to a temperature equal to or lower than the melting point of the polymer particles in the residual material, and the adhesive rollers 66 and 68 are driven in contact with the intermediate transfer body 12 so as to generate a shearing force with respect to the intermediate transfer body 12. By this means, it is possible to generate a detaching force and to remove even very small amount of residual material. In this case, if the conveyance speed of the intermediate transfer body 12 is reduced below the speed during image formation, then it is possible to remove the residual material more effectively. To give a specific example, desirably, the rotational load applied to the adhesive rollers 66 and 68 is set to 3 N/300 mm through 15 N/300 mm, and the conveyance speed of the intermediate transfer body 12 is set to 50 mm/sec through 300 mm/sec.

If the adhesive force of the adhesive rollers 66 and 68 is too strong, then they may stick to the intermediate transfer body 12. Therefore, one possible method of distributing the adhesive force of the adhesive rollers 66 and 68 is to divide the adhesive rollers 66 and 68 into a two-step comb shape, as illustrated in FIG. 32, for example. By this means, since portions of both of the adhesive rollers 66 and 68 do not make contact with the intermediate transfer body 12, then the adhesive force of the adhesive rollers 66 and 68 can be distributed in the direction of conveyance of the intermediate transfer body 12. FIG. 32 illustrates a plan view diagram of an example in which the adhesive rollers 66 and 68 are divided in a two-step fashion in the shape of a comb, as viewed from the direction perpendicular to the axis direction of the adhesive rollers 66 and 68. Another possible method of preventing sticking to the intermediate transfer body 12 is to arrange the pressing rollers 72 and 73 as illustrated in FIG. 31.

Thereupon, the intermediate transfer body contacting members (the intermediate transfer body contacting devices) are cleaned (third cleaning step, step S35). Here, "the intermediate transfer body contacting members" means the members that contact the image forming surface of the intermediate transfer body 12, namely, the spiral roller 38 of the treatment liquid application unit 16, the solvent removal roller 42 of the solvent removal unit 24, the pressurization roller 48 of the transfer unit 26, and so on.

Here, the adhesive forces are set in the order of (adhesive rollers 66, 68)>(intermediate transfer body 12)>(intermediate transfer body contacting members). By setting the adhesive forces of the respective members in this way, the intermediate transfer body contacting members, such as the spiral roller 38 of the treatment liquid application unit 16, the solvent removal roller 42 of the solvent removal unit 24, and the pressurization roller 48 of the transfer unit 26, can be cleaned by making these intermediate transfer body contacting members come into contact with the intermediate transfer body 12 after cleaning has been performed by the second cleaning unit 32.

The adhesive forces of the intermediate transfer body contacting members, such as the spiral roller 38 of the treatment liquid application unit 16, the solvent removal roller 42 of the solvent removal unit 24, the pressurization roller 48 of the transfer unit 26, and the like, do not all have to be set so as to satisfy the inequality relationship described above. According to requirements, it is also possible to set the adhesive forces in such a manner that the inequality described above is satisfied only in respect of the particular intermediate transfer body contacting members which require cleaning.

Desirably, the intermediate transfer body contacting members are formed such that a PFA coating or an electroless PTFE eutectic plating is formed on the surface of metal, and have a surface energy of approximately 25 mN/m through 40 mN/m to exhibit liquid-repelling properties. Moreover, desirably, the adhesive force as measured by a measurement method conforming to JIS-K-6256, of the adhesive rollers 66 and 68 is set to 20 hpa or above, that of the intermediate transfer body 12 is set to 5 hpa through 20 hpa, and that of the intermediate transfer body contacting members is set to be less than 5 hpa. In particular, it is suitable to use a fluorine elastomer (SIFEL600 series manufactured by Shin-Etsu Chemical Co., Ltd., or the like) as the intermediate transfer body 12, since it has weak adhesive properties.

Furthermore, if the adhesive rollers 66 and 68 are used, then the adhering material such as small amounts of coloring material or paper dust which have become attached to the intermediate transfer body 12 can be removed more reliably than in a case of washing with a washing liquid. Moreover, if there is a large amount of adhering material, then it is possible to perform the cleaning by the adhesive rollers 66 and 68 repeatedly, or to combine the use of cleaning by the first cleaning unit 30.

Maintenance and Cleaning of the Intermediate Transfer Body

As described above, from the viewpoint of durability and transfer characteristics onto normal paper, desirably, the intermediate transfer body 12 is formed such that a base material (e.g., polyimide) of the intermediate transfer body 12 is covered (coated or attached) with a silicone rubber, a fluorine rubber, a fluorine elastomer, or the like. Effective means of cleaning the intermediate transfer body 12 are cleaning by the first cleaning unit 30 during image formation, or cleaning by the first cleaning unit 30 or the second cleaning unit 32 when image formation is not in progress.

However, depending on the circumstances of the image forming process, there are situations where a relatively large amount of time cannot be allowed for cleaning by the first cleaning unit 30 and the second cleaning unit 32, or situations where a washing liquid having a strong cleaning capability, which may affect the formation of images, cannot be used during image formation.

In these situations, as the inkjet recording apparatus 10 is operated to perform image formation for a long period of time, the residual material on the surface of the intermediate transfer body 12 becomes liable to solidify and accumulate even if cleaning by the first cleaning unit 30 or the second cleaning unit 32 is carried out. In such situations, there is a possibility of decline in the transfer properties in the transfer unit 26, or decline in the texture of the image on the recording medium 14.

Furthermore, the intermediate transfer body 12 is conveyed while being pressurized by the roller member 68 of the first cleaning unit 30, the solvent removal roller 42 of the solvent removal unit 24, and the transfer roller 36 of the transfer unit 26, and the like. Consequently, there is a possibility that uneven wear may occur in the intermediate transfer body 12, for example, in the portions which make contact with the edges of the recording medium 14 in the transfer unit 26.

Therefore, in order to achieve maintenance and cleaning of the intermediate transfer body 12, when images are not being formed, the first cleaning unit 30 and the treatment liquid application unit 16 described above are used to remove the residual material completely from the intermediate transfer body 12, as well as polishing the intermediate transfer body 12.

Figure 38:
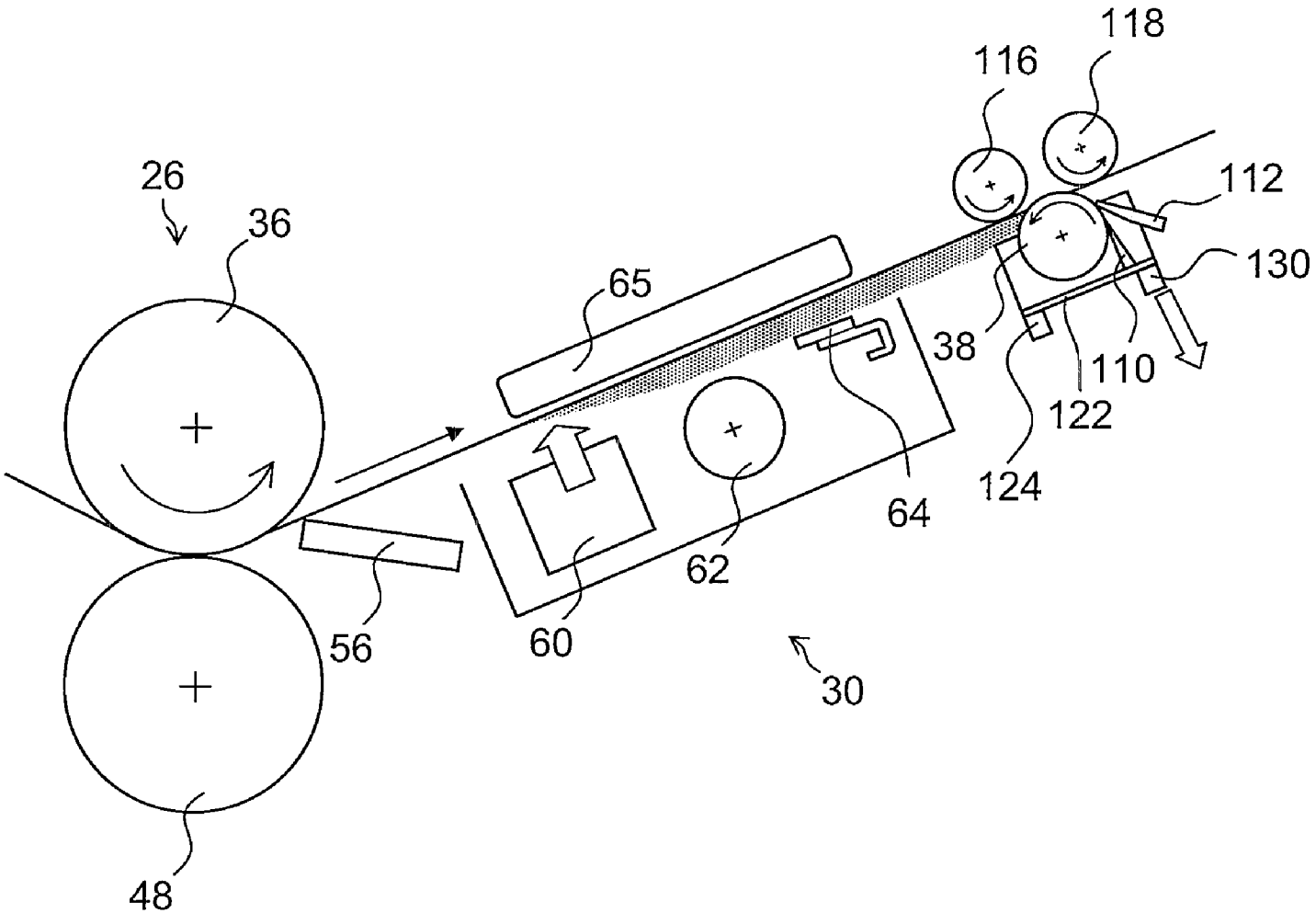
FIG. 38 is a diagram illustrating an aspect of maintenance and cleaning of the intermediate transfer body.

To give a specific compositional example, as illustrated in FIG. 38, the composition of the first cleaning unit 30 and the treatment liquid application unit 16 may be used without modification.

Figure 39:
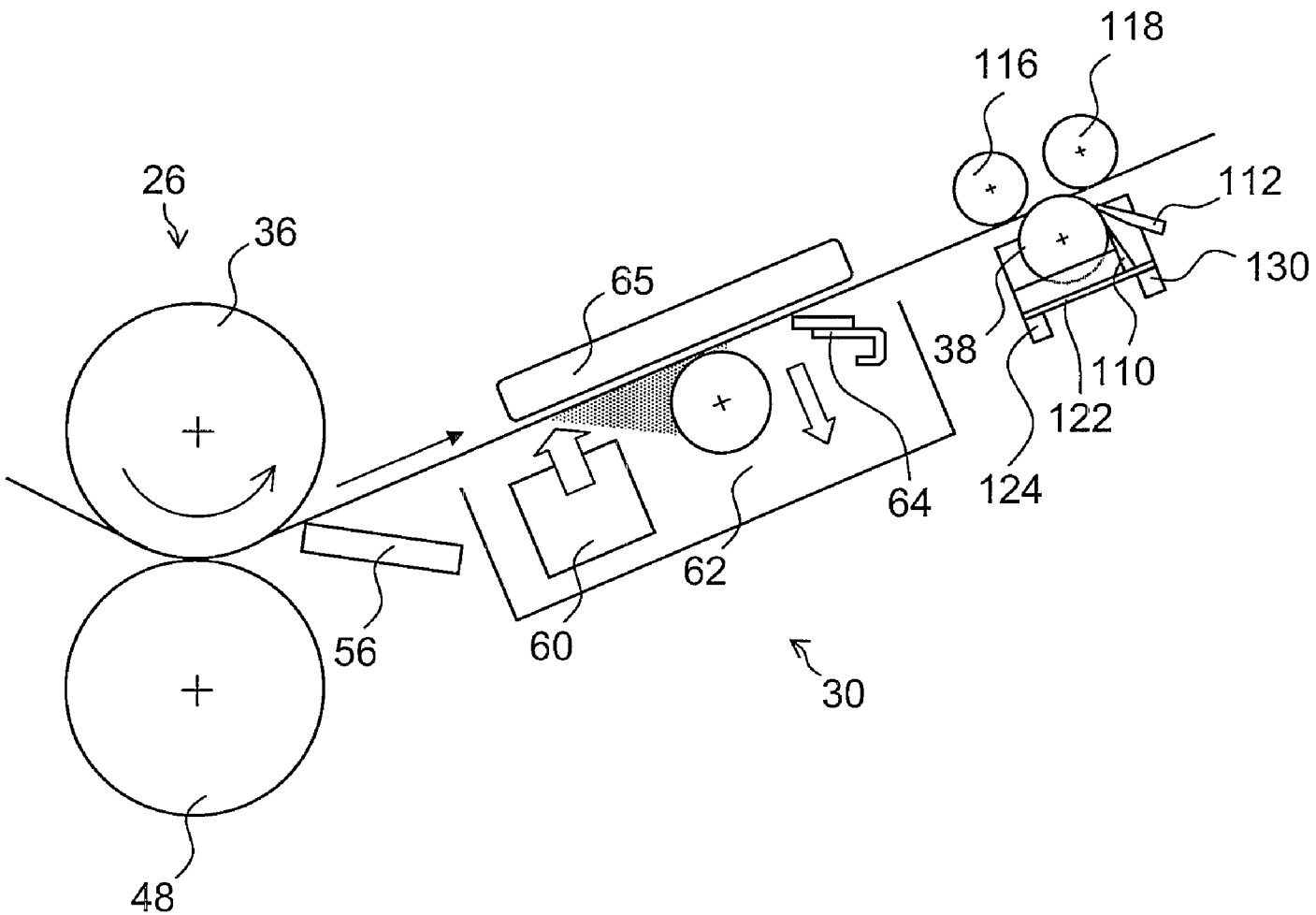
FIG. 39 is a diagram illustrating an aspect of cleaning of the intermediate transfer body by the first cleaning unit during the formation of images.

In cleaning of the intermediate transfer body 12 by the first cleaning unit 30 during image formation, as illustrated in FIG. 39, a washing liquid 61 is sprayed from a washing liquid spray unit 60 and residual material is detached by means of a rotation brush 62 and then removed by a squeegee action using the blade 64. In this cleaning during image formation, the washing liquid does not contain surfactant, or the like, and polishing of the intermediate transfer body 12 is not carried out.

On the other hand, in the maintenance and cleaning of the intermediate transfer body 12 according to the present embodiment, when not forming images, for instance, when the inkjet recording apparatus is started up, at standby or carrying out batch processing, the washing liquid 61 is sprayed onto the intermediate transfer body 12 from the washing liquid spray unit 60 in a state where the rotation brush 62 or blade 64 are separated, and the intermediate transfer body 12 is conveyed while being heated by means of the heater 65, as illustrated in FIG. 38.

Moreover, the spiral roller 38 is abutted against the intermediate transfer body 12 and is rotated in the opposite direction to the direction of conveyance of the intermediate transfer body 12, either in a state where the tension of the intermediate transfer body 12 is increased compared to a tension when applying the treatment liquid during image formation, by adjusting the tensioning roller 34C (FIG. 1), or in a state where the amount by which the spiral roller 38 is pressed against the intermediate transfer body 12 is made greater than when applying the treatment liquid during image formation, thereby increasing the winding angle (increasing the winding length) of the intermediate transfer body 12 about the spiral roller 38, or in a state where both the tension of the intermediate transfer body 12 and the amount by which the spiral roller 38 is pressed against the intermediate transfer body 12 are made greater than when applying the treatment liquid during image formation.

As described above, during image formation, the spiral roller 38 is abutted against the intermediate transfer body 12 and applies the treatment liquid thereon. In other words, the gravure roller 38 that applies the treatment liquid when the image is being formed (during image formation) also serves as the second wiping device that removes the sprayed washing liquid 61 from the intermediate transfer body 12 when the image is not being formed.

As described above, the sprayed washing liquid 61 is heated by the heater 65 of the first cleaning unit 30. Furthermore, the deposited washing liquid 61 remains on the intermediate transfer body 12 from the position where it deposits on the intermediate transfer body 12 until the position where it makes contact with the spiral roller 38, and hence the washing liquid 61 is able to permeate into the residual material for a longer time than during image formation, while maintaining the same conveyance speed of the intermediate transfer body 12 as that used during image formation.

Moreover, the tension of the intermediate transfer body 12 is greater than the tension when applying the treatment liquid during image formation. Alternatively, the amount by which the spiral roller 38 is pressed against the intermediate transfer body 12 is made greater than when applying the treatment liquid during image formation.

Consequently, by wiping while pressing by means of the spiral roller 38, the residual material on the intermediate transfer body 12 is scraped by the grooves of the spiral roller 38, and hence this residual material is removed reliably from the intermediate transfer body 12. The residual material which has been captured by the grooves of the spiral roller 38 can be removed efficiently by abutting the main blade 112 against the spiral roller 38 to remove the residual material, and then discharging the removed residual material via the removed liquid discharge port 130.

Before carrying out maintenance and cleaning of the intermediate transfer body 12, the liquid supply pump 104 (illustrated in FIG. 7) is halted, the treatment liquid outlet valve 126 is opened, the treatment liquid 108 is discharged, or the like, and the application of treatment liquid to the spiral roller 38 is thereby halted. Thereupon, when carrying out maintenance and cleaning of the intermediate transfer body 12, the washing liquid and abrasive particles are removed and then discharged via the removed liquid outlet port 130 by abutting the main blade 112 against the spiral roller 38.

It is possible to revert readily to the state of image formation by closing the treatment liquid outlet valve 126 and supplying the treatment liquid 108 to the treatment liquid container 40 until reaching the position of the drain flow channel 106. By utilizing the first cleaning unit 30 and the treatment liquid application unit 16 in this way, it is possible to achieve maintenance and cleaning of the intermediate transfer body 12 without having to provide additional special equipment.

Furthermore, for the washing liquid 61, it is possible to use a liquid which has a different composition to the liquid used to clean the intermediate transfer body 12 by means of the first cleaning unit 30 during image formation. More specifically, it is possible to use, as the washing liquid 61, a liquid having a large content of surfactant, or a liquid containing a surfactant such as Pionin D4110 (manufactured by Takemoto Oil & Fat Co., Ltd.) that has a strong cleaning effect, or the like.

Therefore, it is possible to improve the cleaning effects of the intermediate transfer body 12. In this case, the washing liquid 61 is stored in the pressure container 444 in FIG. 30, in such a manner that the washing liquid 61 can be switched by means of the switching valve 424.

Furthermore, it is also possible to use, as the washing liquid 61, a polishing liquid which contains particles of alumina, silicon carbide, or the like, having a size of approximately 2 μm through 20 μm. By this means, it is possible to further enhance the cleaning effects on the intermediate transfer body 12, at the same time as eliminating uneven wear by polishing the intermediate transfer body 12 through rotational driving by the spiral roller 38. In this case, if a hard material, such as stainless steel, is used as the material for the portions of the spiral roller 38 which abut against the intermediate transfer body 12, then it is also possible to reduce the wear of the spiral roller 38 itself.

Moreover, if a washing liquid containing plastic particles of polyester or melamine resin having a diameter of approximately 20 μm through 100 μm is used, then the particles are liable to become fixed provisionally in the grooves of the spiral roller 38, which has a density of approximately 100 through 250 lines per inch. Therefore, the residual material on the intermediate transfer body 12 can be removed more effectively. Furthermore, if a polishing liquid containing hard particles of alumina or silicon carbide, or the like, of a diameter of approximately 20 μm through 100 μm is used, then it is possible to impart an undulating shape following the conveyance direction, to the intermediate transfer body 12, and therefore movement of the coloring material in the event of ink droplet ejection is reduced, stable image formation can be achieved, and cleaning during the formation of images can also be carried out stably by means of the rotation brush 62 and the blade 64.

Furthermore, if the rotational speed of the drive motor is switched and the rotational speed (number of revolutions per unit time) of the spiral roller 38 is made greater than when applying the treatment liquid during image formation, then it is possible to enhance the cleaning effects of the intermediate transfer body 12.

Moreover, it is possible to cause the contacting members such as the transfer roller 36, the solvent removal roller 42, the rotation brush 62, or the like, to abut against the intermediate transfer body 12, during the maintenance and cleaning of the intermediate transfer body 12 described above. By this means, it is also possible to clean the contacting members such as the solvent removal roller 42, by using the washing liquid 61 which has been applied to the intermediate transfer body 12 by the spiral roller 38 when wiping residual material from the intermediate transfer body 12, and furthermore the cleaning effect of the rotation brush 62 is enhanced and the performance of the respective contacting members is maintained. In this case, desirably, the spraying of the substitute fluid from the substitute fluid spraying unit 114 is carried out after cleaning of the contacting members.

Moreover, if the spiral roller 38 is moved in the breadthways direction of the intermediate transfer body 12 during the maintenance and cleaning of the intermediate transfer body 12, then it is possible to carry out maintenance and cleaning of the intermediate transfer body 12 which has a large width.

Description of Control System

Figure 40:
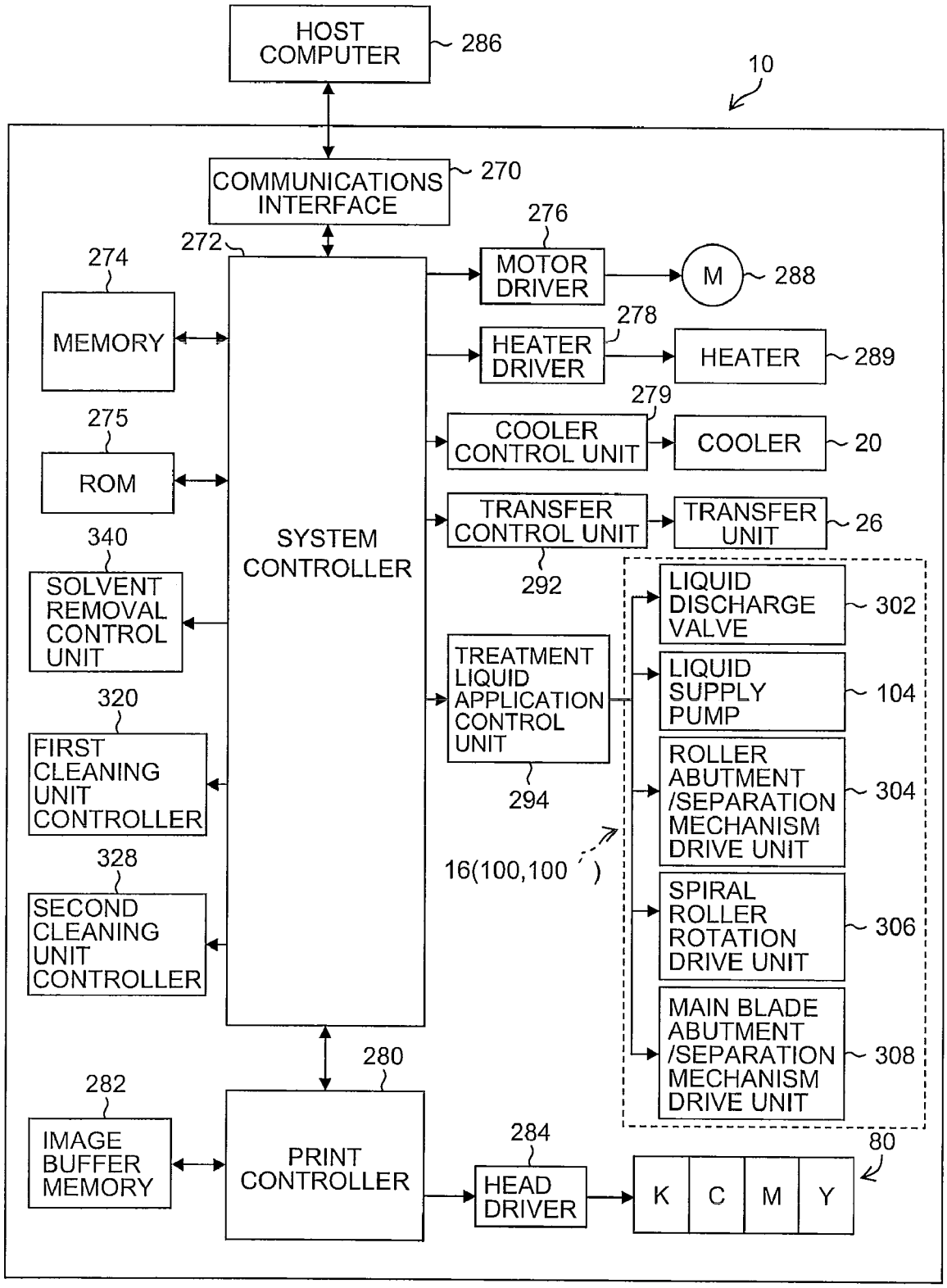
FIG. 40 is a block diagram illustrating the system configuration of the inkjet recording apparatus according to the first embodiment.

FIG. 40 is a principal block diagram illustrating the system configuration of the inkjet recording apparatus 10. The inkjet recording apparatus 10 includes a communications interface 270, a system controller 272, a memory 274, a motor driver 276, a heater driver 278, a cooler control unit 279, a print control unit 280, an image buffer memory 282, a head driver 284, and the like.

The communications interface 270 is an interface unit for receiving image data sent from a host computer 286. A serial interface such as USB (Universal Serial Bus), IEEE1394, Ethernet (registered trademark), wireless network, or a parallel interface such as a Centronics interface may be used as the communications interface 270. A buffer memory (not illustrated) may be mounted in this portion in order to increase the communication speed. The image data sent from the host computer 286 is received by the inkjet recording apparatus 10 through the communications interface 270, and is temporarily stored in the memory 274.

The memory 274 is a storage device for temporarily storing images inputted through the communications interface 270, and data is written and read to and from the memory 274 through the system controller 272. The memory 274 is not limited to a memory composed of semiconductor elements, and a hard disk drive or another magnetic medium may be used.

The system controller 272 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 272 controls the various sections, such as the communications interface 270, memory 274, motor driver 276, heater driver 278, a cooler control unit 279, and the like, as well as controlling communications with the host computer 286 and writing and reading to and from the memory 274, and it also generates control signals for controlling the motor 288 and heater 289 of the conveyance system.

The program executed by the CPU of the system controller 272 and the various types of data which are required for control procedures are stored in the ROM 275. The ROM 275 may be a non-writeable storage device, or it may be a rewriteable storage device, such as an EEPROM. The memory 274 is used as a temporary storage region for the image data, and it is also used as a program development region and a calculation work region for the CPU.

The motor driver 276 is a driver which drives the motor 288 in accordance with instructions from the system controller 272. In FIG. 40, the motors disposed in the respective sections in the apparatus are represented by the reference numeral 288. For example, the motor 288 illustrated in FIG. 40 includes a motor which drives the drive rollers in the tensioning rollers 34A through 34C in FIG. 1, a motor of the movement mechanism of the solvent removal roller 42, a motor of the movement mechanisms of the transfer roller 36 and the pressurization roller 48, and the like.

The heater driver 278 illustrated in FIG. 40 is a driver which drives the heater 289 in accordance with instructions from the system controller 272. In FIG. 40, the plurality of heaters which are provided in the inkjet recording apparatus 10 are represented by the reference numeral 289. For instance, the heater 289 illustrated in FIG. 40 includes a heater of a heating unit 18 illustrated in FIG. 1, a pre-heater 46, the heater 65 in the first cleaning unit 40, and the like.

The cooler control unit 279 in FIG. 40 is a control unit which controls the temperature of the cooler 20 (see FIG. 1) in accordance with the instructions from the system controller 272.

The print control unit 280 has a signal processing function for performing various tasks, compensations, and other types of processing for generating print control signals from the image data stored in the memory 274 in accordance with commands from the system controller 272 so as to supply the generated print data (dot data) to the head driver 284. Prescribed signal processing is carried out in the print control unit 280, and the ejection amount and the ejection timing of the ink droplets from the respective print heads 80 are controlled via the head driver 284, on the basis of the print data. By this means, prescribed dot size and dot positions can be achieved.

The print control unit 280 is provided with the image buffer memory 282; and image data, parameters, and other data are temporarily stored in the image buffer memory 282 when image data is processed in the print control unit 280. The aspect illustrated in FIG. 40 is one in which the image buffer memory 282 accompanies the print control unit 280; however, the memory 274 may also serve as the image buffer memory 282. Also possible is an aspect in which the print control unit 280 and the system controller 272 are integrated to form a single processor.

To give a general description of the sequence of processing from image input to print output, image data to be printed is input from an external source via a communications interface 270, and is accumulated in the memory 274. At this stage, RGB image data is stored in the memory 274, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 274 is sent to the print control unit 280 through the system controller 272, and is converted to the dot data for each ink color by a half-toning technique, using a threshold value matrix, error diffusion, or the like, in the print control unit 280.

In other words, the print control unit 280 performs processing for converting the input RGB image data into dot data for the four colors of K, C, M and Y. The dot data generated by the print control unit 280 in this way is stored in the image buffer memory 282. The primary image formed on the intermediate transfer body 12 is a mirror image of the secondary image which is to be formed finally on the recording medium 14, taking account of the fact that it is reversed when transferred onto the recording medium. In other words, the drive signals supplied to the heads 22Y, 22M, 22C and 22K are drive signals corresponding to a mirror image, and therefore the input image is required to be subjected to reversal processing by the print control unit 280.

The head driver 284 outputs drive signals for driving the actuators 88 corresponding to the respective nozzles 81 of the heads 80, on the basis of the print data supplied by the print control unit 280 (in other words, the dot data stored in the image buffer memory 282). A feedback control system for maintaining constant drive conditions for the heads may be included in the head driver 284.

By supplying the drive signals output by the head driver 284 to the print heads 80, inks are ejected from the corresponding nozzles 81. An image (primary image) is formed on the intermediate transfer body 12 by controlling ink ejection from the heads 80 while conveying the intermediate transfer body 12 at a prescribed speed.

Furthermore, the system controller 272 controls the transfer control unit 292 and the treatment liquid application control unit 294, and furthermore, it also controls the operation of the solvent removal unit 24, the first cleaning unit 30 and the second cleaning unit 32 described above with reference to FIG. 1.

The transfer control unit 292 illustrated in FIG. 40 controls the temperature and the nip pressure of the transfer roller 36 and the pressure roller 48 in the transfer unit 26 (see FIG. 1). The optimal values for the nip pressure and transfer temperature (target control values) are previously determined for each type of recording medium 14 and each type of ink, and this data is stored in a prescribed memory (for example, a ROM 275) in the form of a data table. When the system controller 272 acquires information about the recording medium 14 being used and the ink being used, on the basis of an input made by an operator, or by automatically reading in information by means of a prescribed sensor, then the system controller 272 controls the temperature and the nip pressure of the transfer roller 36 and the pressurization roller 48 accordingly, by referring to the data table.

The treatment liquid application control unit 294 illustrated in FIG. 40 controls the operation of the treatment liquid application unit 16 in accordance with the instructions from the system controller 272. If a liquid application apparatus 100 as illustrated in FIG. 7 is used for the treatment liquid application unit 16, then as illustrated in FIG. 40, the liquid discharge valve 302, the liquid supply pump 104, the roller abutment/separation mechanism drive unit 304 for the spiral roller 38, the spiral roller rotation drive unit 306, the main blade abutment/separation mechanism drive unit 308, and the like, are controlled by the treatment liquid application control unit 294.

The treatment liquid discharge valve 126 and the removed liquid discharge valve 132 illustrated in FIG. 7 are included in the liquid discharge valve 302. Furthermore, the main blade abutment/separation mechanism drive unit 308 in FIG. 40 includes a cam motor 510 and an eccentric cam 512, and the like, which abuts and separates the main blade 112 illustrated in FIG. 11, with respect to the spiral roller 38.

Furthermore, the main blade abutment/separation mechanism drive unit 308 has a function of performing control on the basis of the image data in accordance with instructions from the system controller 272, so as to abut the main blade 112 against a region on the spiral roller 38 which corresponds to the non-image forming region of the intermediate transfer body 12 and to separate the main blade 112 from the region on the spiral roller 38 which corresponds to the image forming region of the intermediate transfer body 12.

Moreover, the main blade abutment/separation mechanism drive unit 308 also has a function of controlling the magnitude of the biasing force of the main blade 112, when the main blade 112 is abutted against the spiral roller 38.

As described above, the system controller 272 judges the image forming region and the non-image forming region on the intermediate transfer body 12, on the basis of the image data that is to be printed, and controls the main blade abutment/separation mechanism drive unit 308 so as to abut and separate the main blade 112 with respect to the spiral roller 38, in such a manner that treatment liquid is not deposited onto the portion corresponding to the non-image forming region. Consequently, the treatment liquid is applied selectively onto the portion of the intermediate transfer body 12 which corresponds to the image forming region.

Furthermore, during maintenance and cleaning of the intermediate transfer body 12, for instance, at start-up or during standby of the inkjet recording apparatus, or when not forming images during a batch processing operation, the treatment liquid application control unit 294 controls the main blade abutment/separation mechanism drive unit 308 so as to abut the main blade 112 against the outer circumferential surface of the spiral roller 38, in order to remove residual material that has been recovered into the grooves of the spiral roller 38.

Furthermore, in carrying out maintenance and cleaning of the intermediate transfer body 12, the system controller 272 issues an instruction to the first cleaning unit controller 320 whereby the blade 64 is controlled to separate from the intermediate transfer body 12.

Simultaneously with this, the system controller 272 can also issue an instruction to the treatment liquid application control unit 294 whereby the amount by which the spiral roller 38 is pressed against the intermediate transfer body 12 in a state of abutment against the intermediate transfer body 12 is increased in comparison with the amount during image formation, by means of the roller abutment/separation mechanism drive unit 304. Alternatively, the system controller 272 may also control the tensioning roller 34C (FIG. 1) so as to increase the tension of the intermediate transfer body 12 in a state where the spiral roller 38 is abutted against the intermediate transfer body 12.

Furthermore, when liquid is not being applied, for instance, during a standby state of the inkjet recording apparatus 10, the system controller 272 may also issue an instruction to the treatment liquid application control unit 294 so that the spiral roller 38 is separated from the intermediate transfer body 12 by the roller abutment/separation mechanism drive unit 304, and is fixed and supported by the push latch 508 (see FIG. 11).

Figure 41:
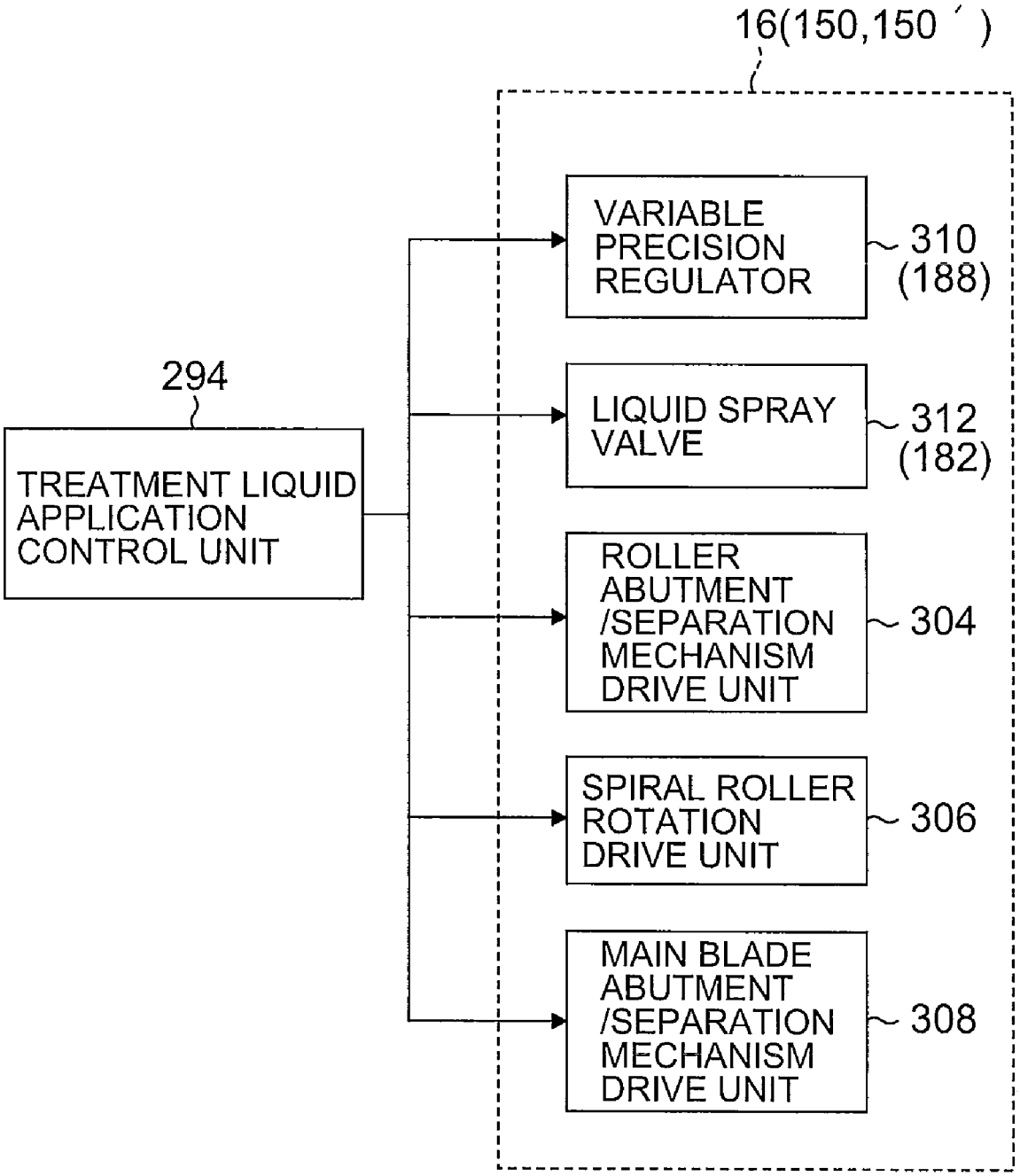
FIG. 41 is a principal block diagram illustrating the system composition when the liquid application apparatus illustrated in FIG. 15 is used.

In the treatment liquid application unit 16, if a liquid application apparatus 150 as illustrated in FIG. 15 is used, then instead of the composition involving the liquid discharge valve 302 and the liquid supply pump 104 illustrated in FIG. 40, the variable precision regulator 310 and the liquid spray valve 312 are controlled, as illustrated in FIG. 41. The variable precision regulator 310 referred to here is a device which changes the spray pressure from the liquid spray unit 152 in FIG. 15, and it corresponds to the element indicated by reference numeral 188 in the example illustrated in FIG. 19.

Moreover, the liquid spray valve 312 illustrated in FIG. 41 is a device for switching the spray of the liquid spray unit 152 in FIG. 15, on and off, and it corresponds to the electromagnetic valve indicated by reference numeral 182 in the example in FIG. 19.

When image formation is not being performed, it is possible to clean the spiral roller 38, and the like, by means of the treatment liquid application control unit 294 performing control in such a manner that a washing liquid having a different composition to the treatment liquid is sprayed from the liquid spraying unit 152.

Figure 42:
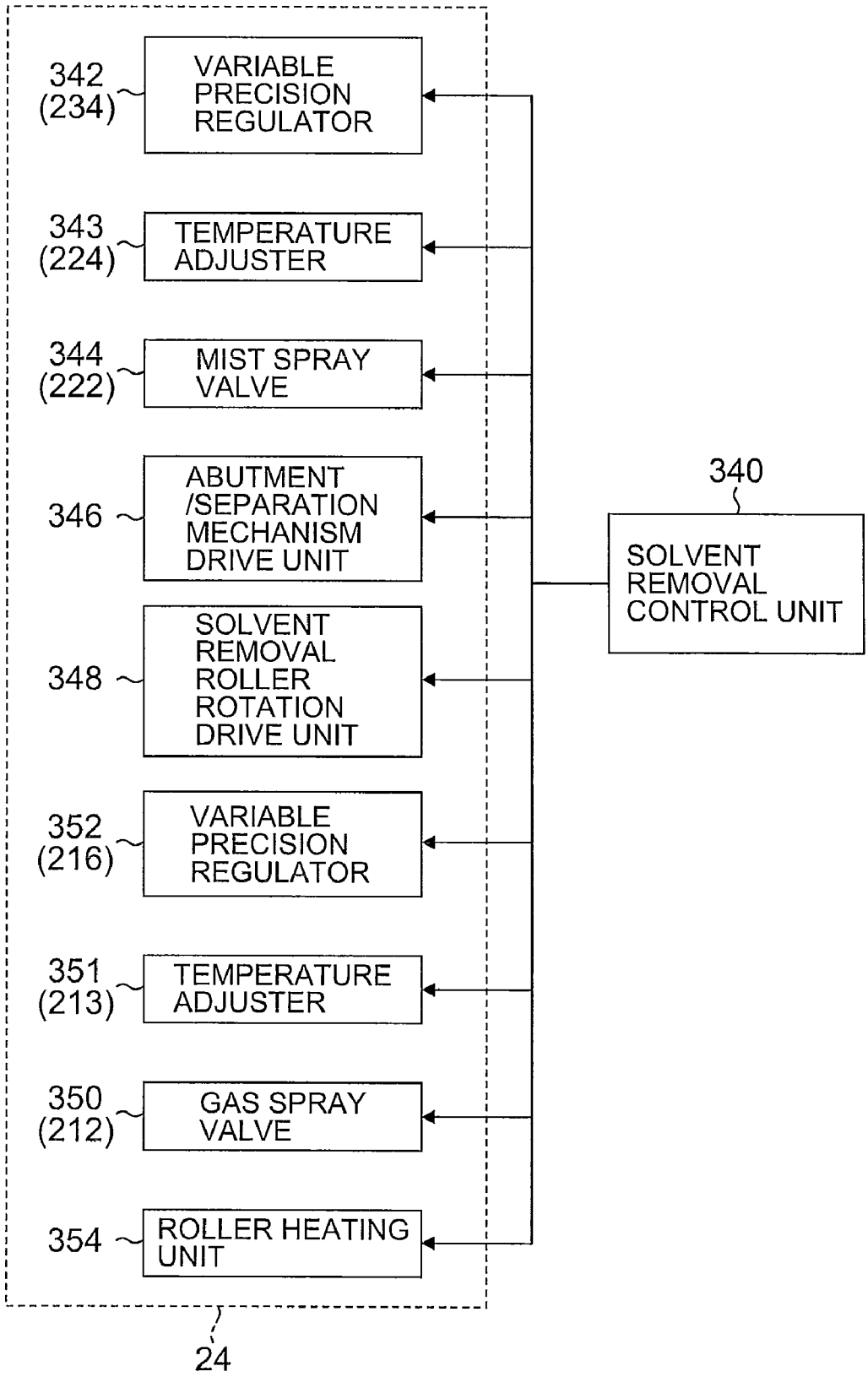
FIG. 42 is a block diagram illustrating the composition of a solvent removal control unit.

FIG. 42 is a block diagram illustrating the composition of a solvent removal control unit 340. The solvent removal control unit 340 illustrated in FIG. 42 controls the operation of the solvent removal unit 24 in accordance with the instructions from the system controller 272. As illustrated in FIG. 42, the solvent removal control unit 340 controls the variable precision regulator 342, the temperature adjuster 343, the mist spray valve 344, the abutment/separation mechanism drive unit 346 of the solvent removal roller 42, the solvent removal roller rotation drive unit 348, the gas spray valve 350, the temperature adjuster 351, the variable precision regulator 352, and the like.

The mist spray valve 344 in FIG. 42 corresponds to, for example, an electromagnetic valve 222 described above with reference to FIG. 26 which turns the spray from the nozzle body 220 on and off.

The system controller 272 controls the mist spray valve 344 to spray and not to spray the liquid, thereby adjusting the amount of the liquid deposited on the solvent removal roller 42, on the basis of the image data to be printed. By this means, the amount of the liquid on the intermediate transfer body 12 is adjusted.

The variable precision regulator 342 referred to here is a device which changes the spray pressure from the mist spray nozzle 43 in FIG. 23, and it corresponds to the element indicated by reference numeral 234 in the example illustrated in FIG. 26.

Moreover, the gas spray valve 350 is a device for switching on and off the spray from the gas spray nozzle 45 in FIG. 23, and it corresponds to the electromagnetic valve indicated by reference numeral 212 in the example in FIG. 26.

Furthermore, the variable precision regulator 352 referred to here is a device which changes the spray pressure from the gas spray nozzle 45 in FIG. 23, and it corresponds to the element indicated by reference numeral 216 in the example illustrated in FIG. 26.

Furthermore, the temperature adjuster 343 is a device for heating the liquid which forms the mist that is sprayed from the mist spray valve 344, and this corresponds to the element indicated by reference numeral 224 in the example in FIG. 26. Moreover, the temperature adjuster 351 is a device for heating the gas which is sprayed from the gas spray valve 350, and this corresponds to the element indicated by reference numeral 213 in the example in FIG. 26.

Furthermore, the roller heating unit 354 is a device for heating the solvent removal roller 42 (and in particular, the outer circumferential surface of the solvent removal roller 42).

Moreover, the abutment/separation mechanism drive unit 346 may be controlled by the solvent removal control unit 340 to abut against the intermediate transfer body 272 during maintenance and cleaning of the intermediate transfer body 12 when not forming images, in accordance with the instructions from the system controller 272. By this means, it is possible to achieve cleaning of the solvent removal roller 42.

FIG. 43 is a block diagram illustrating the composition of the first cleaning unit controller 320. The first cleaning unit controller 320 illustrated in FIG. 43 controls the operation of the first cleaning unit 30, in accordance with the instructions from the system controller 272 illustrated in FIG. 40. As illustrated in FIG. 43, the first cleaning unit controller 320 controls a fluid controller 322, a liquid spray valve 324, a rotation brush drive unit 326, the abutment/separation mechanism drive unit 327, and the like. Furthermore, the fluid controller 322 in FIG. 43 corresponds to the liquid supply pump 408 illustrated in FIG. 29 and the compressor 438 illustrated in FIG. 30. Moreover, the liquid spray valve 324 in FIG. 43 corresponds to the electromagnetic valve 402 illustrated in FIG. 29 and the electromagnetic valve 422 and switching valve 424, and the like, illustrated in FIG. 30.

Furthermore, during maintenance and cleaning of the intermediate transfer body 12 when not forming images, the first cleaning unit controller 320, in accordance with an instruction from the system controller 272, may control the fluid controller 322 and the liquid spray valve 324, so as to select the washing liquid 61, which is, for instance, a washing liquid which contains a polishing agent. Moreover, similarly, the first cleaning unit controller 320 may control the rotation brush 62 in such a manner that it is abutted against the intermediate transfer body 12.

Figure 44:
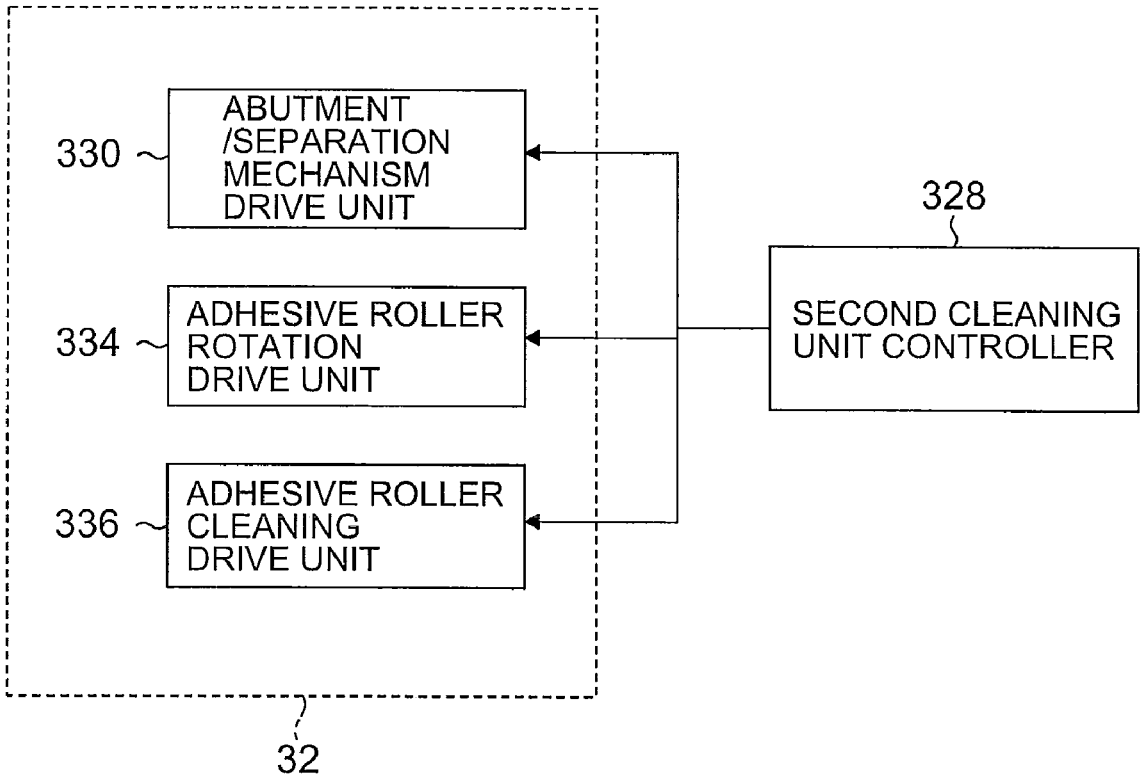
FIG. 44 is a block diagram illustrating the composition of the second cleaning unit controller.

FIG. 44 is a block diagram illustrating the composition of the second cleaning unit controller 328. The second cleaning unit controller 328 illustrated in FIG. 44 controls the operation of the second cleaning unit 32, in accordance with the instructions from the system controller 272 illustrated in FIG. 40. As illustrated in FIG. 44, the abutment/separation mechanism drive unit 330 of the adhesive rollers, the adhesive roller cleaning drive unit 334, the adhesive roller cleaning drive unit 336, and the like, are controlled by the second cleaning unit controller 328. The cleaning web (or adhesive belt) 70 described above is driven by the adhesive roller cleaning drive unit 334.

The determination signal from the soiling determination unit 44 described above is input to the system controller 272.

In the first embodiment which is described above, after applying an aggregation treatment agent (treatment liquid), the treatment agent is caused to dry so as to form a solid or semi-solid aggregation treatment agent layer, and droplets of ink are then deposited onto this layer. However, a mode is also possible in which the aggregation treatment agent is applied after droplets of ink are deposited on the intermediate transfer body. Below, this mode is described as a second embodiment.

Second Embodiment

Figure 45:
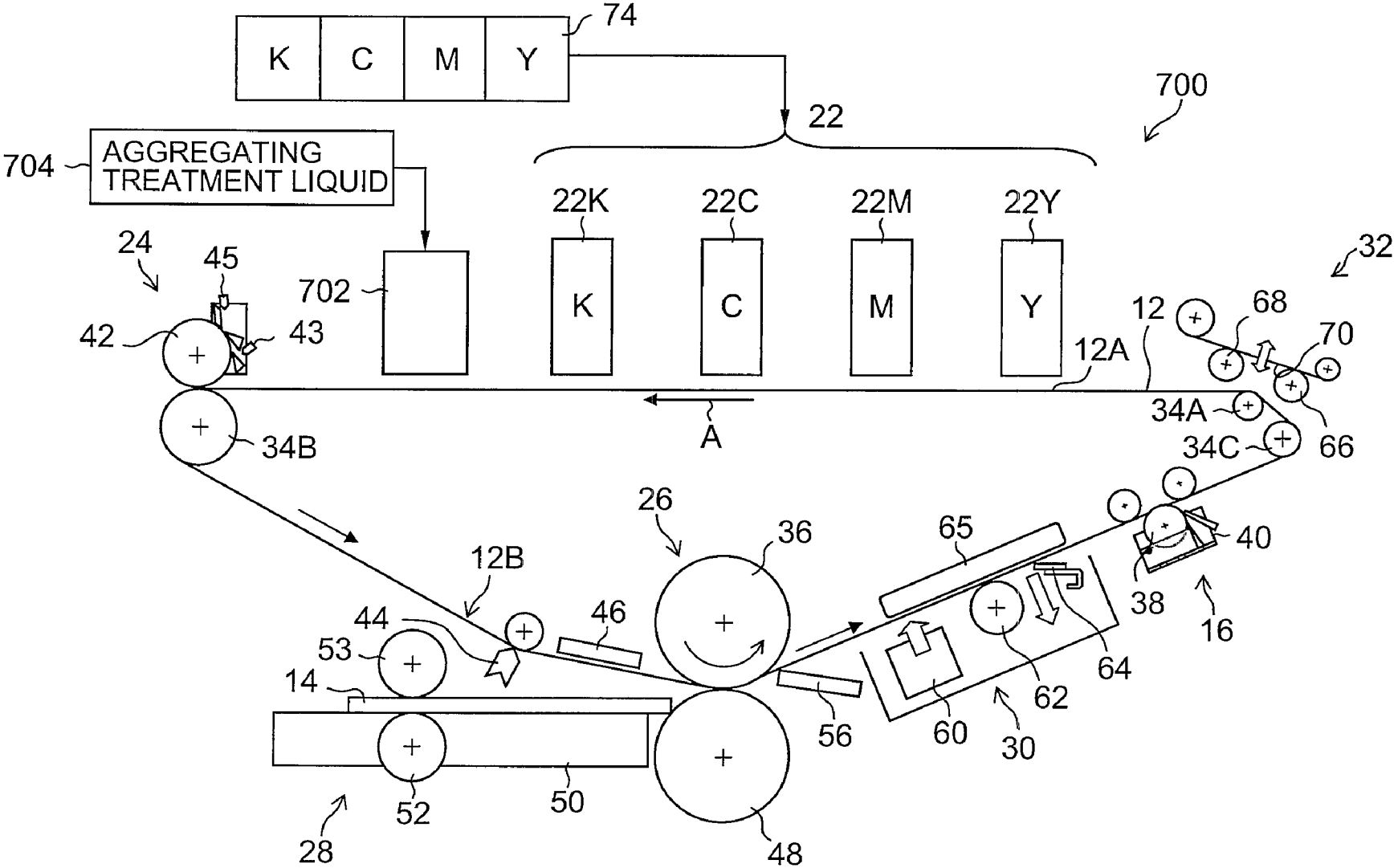
FIG. 45 is a general schematic drawing of an inkjet recording apparatus according to the second embodiment of the present invention.

FIG. 45 is a schematic drawing of an inkjet recording apparatus 700 according to a second embodiment. In FIG. 45, elements which are the same as or similar to the composition in FIG. 1 are labeled with the same reference numerals and description thereof is omitted here.

The inkjet recording apparatus 700 illustrated in FIG. 45 differs from the inkjet recording apparatus 10 illustrated in FIG. 1 according to the first embodiment, in respect of the undercoating liquid applied by the treatment liquid application unit 16. Moreover, the inkjet recording apparatus 700 differs from the inkjet recording apparatus 10 in that the inkjet recording apparatus 700 is provided with a liquid ejection head (hereinafter, called "aggregation liquid head") 702 which is arranged on the downstream side of the print unit 22 and deposits an aggregation treatment liquid (image formation liquid), instead of the heating unit 18 and cooler 20 in FIG. 1.

In other words, the inkjet recording apparatus 700 illustrated in the present embodiment employs a three-liquid image forming method, in which a first treatment liquid layer is formed by means of an undercoating liquid (hereinafter, called the "first treatment liquid") on the intermediate transfer body 12, droplets of ink are ejected into this first treatment liquid layer, and then droplets of an aggregation treatment liquid (hereinafter, called the "second treatment liquid") which has the function of causing the ink droplets to aggregate are ejected in accordance with the liquid ink droplets in the first treatment liquid layer, thereby causing the coloring material (pigment) in the ink to aggregate and thus forming an ink aggregate.

The first treatment liquid which is applied by the treatment liquid application unit 16 of this inkjet recording apparatus 700 is a liquid which does not have the function of aggregating the ink droplets, even if it makes contact with the ink droplets; for example, a liquid obtained by removing the coloring material (pigment) from the ink liquid used in the print unit 22 can be used as the first treatment liquid. An example of the preparation of the first treatment liquid is illustrated in Table 7.

TABLE 7

| Material | Weight % |
|---|---|
| Latex LX-2 | 8 |
| Glycerine (made by Wako Pure Chemical Industries Co., Ltd.) | 20 |
| Diethylene glycol (made by Wako Pure Chemical Industries Co., Ltd.) | 10 |
| Olfine E1010 (made by Nissin Chemical Industry Co., Ltd.) | 1 |
| Deionized water | 61 |

The aggregation treatment liquid (second treatment liquid) ejected from the aggregation liquid head 702 is desirably a treatment liquid which has the function of generating an ink aggregate by causing the pigment (coloring material) and the polymer micro-particles contained in the ink to aggregate by altering the pH of the ink.

The aggregation treatment liquid storing and loading unit 704 illustrated in FIG. 45 is constituted by a tank which stores the second treatment liquid which is supplied to the aggregation liquid head 702. The tank is connected to the treatment liquid head 702 via a prescribed flow channel.

The aggregation liquid head 702 according to the present embodiment uses the same composition as the head disposed in the print unit 22. Provided that it is possible to deposit aggregation treatment liquid by a non-contact method onto the intermediate transfer body 12, the aggregation liquid head 702 may adopt a structure having a reduced droplet ejection density (resolution) compared to the ink heads 22Y, 22M, 22C and 22K, and it may also adopt a method other than an inkjet method, such as a spray method.

Desirably, the component of the second treatment liquid is selected from: polyacrylic acid, acetic acid, glycol acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, or derivatives of these compounds, or salts of these, or the like The treatment liquid illustrated in Table 1 or Table 2 may also be used.

A desirable example of the second treatment liquid is a treatment liquid to which a multivalent salt or polyallylamine has been added. These compounds may be used singly, or a combination of two or more of these compounds may be used.

From the viewpoint of the pH aggregating performance with respect to the ink, the second treatment liquid desirably has a pH of 1 through 6, more desirably, a pH of 2 through 5, and particularly desirably, a pH of 3 through 5.

The added amount, in the second treatment liquid, of the compound which causes aggregation of the ink pigment and polymer micro-particles, is desirably not less than 0.01 wt % and not more than 20 wt %, with respect to the total weight of the liquid. If the amount is less than 0.01 wt %, then when the ink comes into contact with the second treatment liquid, the concentration and dispersion do not advance sufficiently, and a sufficient aggregating action on the basis of the pH change may not be produced. If, on the other hand, the amount is more than 20 wt %, then there are concerns over deterioration of the ejection performance from the inkjet head (for example, the occurrence of ejection abnormalities).

Desirably, the second treatment liquid contains water and another organic solvent which is capable of dissolving the additive, in order to prevent blocking of the nozzles of the ejection head (702) due to drying. The water or other organic solvent capable of dissolving the additive includes a moistening agent or a penetrating agent. These solvents can be used independently, or in plural fashion, together with the other additive.

The content of the water and the other organic solvent capable of dissolving the additive should desirably be not more than 60 wt % with respect to the total weight of the second treatment liquid. If the content is more than 60 wt %, then the viscosity of the treatment liquid increases, and the ejection characteristics from the inkjet head may deteriorate.

It is also possible to include a resin component in the second treatment liquid in order to improve the fixing characteristics and the rub resistance. The resin component may be any resin which would not impair the ejection characteristics from the head and which has stable storage characteristics in cases where the treatment liquid is ejected in the form of droplets by an inkjet method, and it is possible freely to choose a water-soluble resin, resin emulsion, or the like.

The resin component may be an acrylic polymer, a urethane polymer, a polyester polymer, a vinyl polymer, a styrene polymer, or the like. In order to display sufficiently the functions of the material in improving fixing characteristics, it is necessary to add a polymer of relatively high molecular weight, at a high concentration (1 wt % through 20 wt %). However, if it is sought to add the aforementioned materials by dissolving in the liquid, then the viscosity of the liquid increases and the ejection characteristics decline. In order to add a suitable material at a high concentration or to suppress increase in the viscosity, it is effective to add the material in the form of a latex. Possible latex materials are, for instance: an alkyl copolymer of acrylic acid, carboxyl-modified SBR (styrene-butadiene latex), SIR (styrene-isoprene latex), MBR (methyl methacrylate-butadiene latex), NBR (acrylonitrile-butadiene latex), or the like.

The glass transition temperature Tg of the latex has a significant effect during the fixing process, and desirably, it is not lower than 50° C. or not higher than 120° C., in order to achieve both the stability during storage at normal temperature and good transfer characteristics after heating. Moreover, during the process, the minimum film forming temperature MFT also has a significant effect on fixing and in order to achieve suitable fixing at low temperatures, desirably it is 100° C. or lower, and more desirably, 50° C. or lower.

A desirable mode is one where the second treatment liquid contains polymer micro-particles of opposite polarity to the ink, since this further enhances the aggregating properties by causing aggregation of the pigment and polymer micro-particles in the ink. Furthermore, the aggregating properties may be enhanced by including, in the second treatment liquid, a curing agent which corresponds to the polymer micro-particle component contained in the ink, in such a manner that the resin emulsion in the ink composition aggregates and produces a cross-linking or polymerization reaction, after the ink and second treatment liquid have come into contact.

The second treatment liquid may include a surfactant. Desirable examples of a surfactant are: in a hydrocarbon system, an anionic surface active agent, such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfonate/formalin condensate, a polyoxyethylene alkyl sulfonate ester salt, or the like; or a non-ionic surface active agent, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerine fatty acid ester, an oxyethylene oxypropylene block copolymer, and the like.

Furthermore, it is also desirable to use SURFYNOLS (Air Products & Chemicals Co. Ltd.), which is an acetylene-based polyoxyethylene oxide surface active agent. Furthermore, an amine oxide type of ampholytic surface active agent, such as N,N-dimethyl-N-alkyl amine oxide, is also desirable. Moreover, the surfactants cited on pages 37 through 38 of Japanese Patent Application Publication No. 59-157636, and the surfactants cited in Research Disclosure No. 308119 (1989), can be used as the surfactant of the second treatment liquid.

Furthermore, it is also possible to use a fluorine (alkyl fluoride) type, or silicone type of surface active agent such as those described in Japanese Patent Application Publication No. 2003-322926, Japanese Patent Application Publication No. 2004-325707, and Japanese Patent Application Publication No. 2004-309806. It is also possible to use a surface tension adjuster of this kind as an anti-foaming agent; and a fluoride or silicone compound, or a chelating agent, such as EDTA, can also be used.

If the surfactant described above is included in the second treatment liquid, then a beneficial effect is obtained in that the surface tension of the second treatment liquid is lowered and the wetting properties on the intermediate transfer body are improved. Desirably, the surface tension of the second treatment liquid is 10 through 50 mN/m, and in the case of application by means of an inkjet method, more desirably, the surface tension of the second treatment liquid is 15 through 45 mN/m from the viewpoint of achieving finer liquid droplets and improving the ejection performance.

Desirably, the viscosity of the second treatment liquid is 1.0 through 20.0 cP, from the viewpoint of depositing by means of an inkjet method. It is also possible to add, to a second treatment liquid, a pH buffering agent, an anti-oxidation agent, an anti-rusting agent, a viscosity adjusting agent, a conducting agent, an ultraviolet light absorbing agent, and the like.

Figure 46:
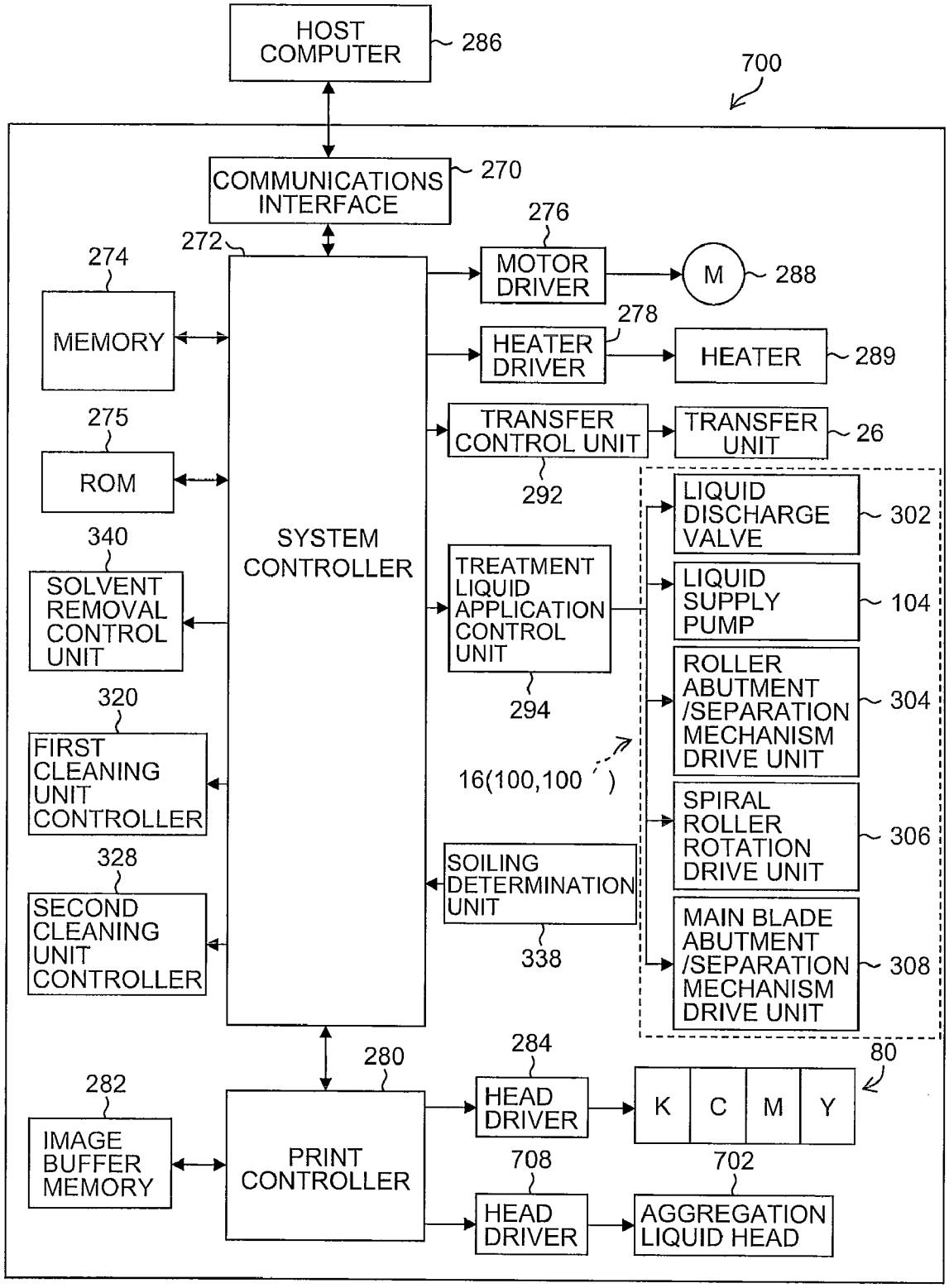
FIG. 46 is a block diagram illustrating the system configuration of the inkjet recording apparatus according to the second embodiment.

FIG. 46 is a block diagram of the inkjet recording apparatus 700 illustrated in FIG. 45. In FIG. 46, elements which are the same as or similar to the example in FIG. 40 are labeled with the same reference numerals and description thereof is omitted here.

In the inkjet recording apparatus 700 illustrated in FIG. 46, an aggregation liquid head 702 and a head driver 706 which drives this head are provided as devices for depositing the aggregation treatment liquid (second treatment liquid). The head driver 706 generates drive signals to be applied to the actuators 88 (see FIG. 5) in the aggregation liquid head 702, on the basis of image data supplied from the print control unit 280, and also comprises drive circuits which drive the actuators 88 by applying the drive signals to the actuators 88. In this way, a desirable mode is one in which a composition for ejecting droplets of aggregation liquid in accordance with the image data is adopted, and droplets of aggregation treatment liquid are ejected selectively onto the positions where droplets of ink have been deposited by the print unit 22, but it is also possible to adopt a mode in which the aggregation liquid is deposited in a uniform fashion by using a spray nozzle.

Instead of the treatment liquid application unit 16 illustrated in FIG. 46, it is also possible to adopt the composition illustrated in FIG. 41.

Furthermore, in the respective embodiments described above, an endless belt is used as the intermediate transfer body, but it is also possible to adopt a mode which uses a drum-shaped intermediate transfer body. In this case, from the viewpoint of the processing characteristics and the thermal control characteristics, it is desirable to use an intermediate transfer body formed by coating a fluorine elastomer onto the surface of a thin aluminum tube which is reinforced by ribs.

Third Embodiment

Figure 47:
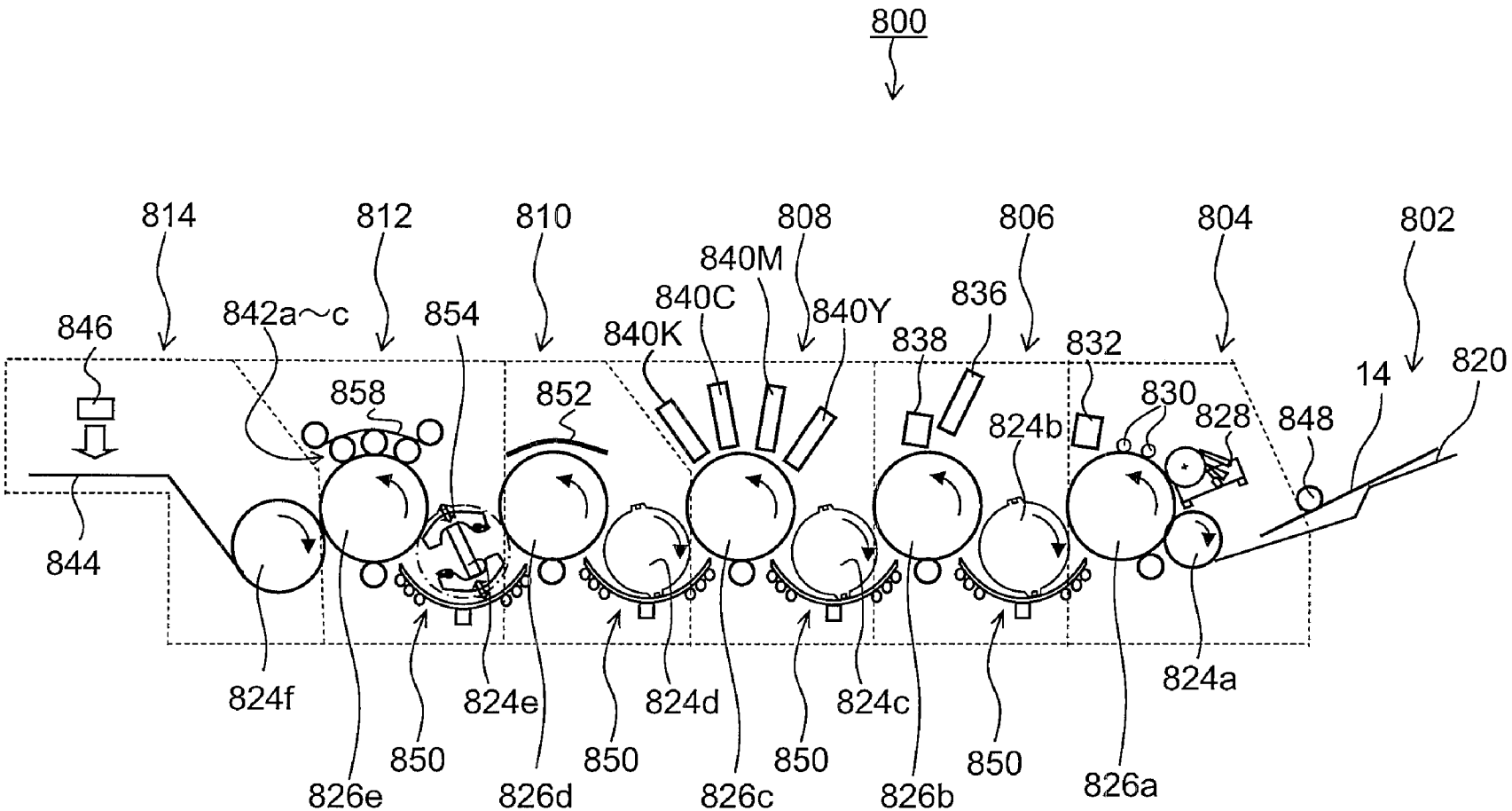
FIG. 47 is a general schematic drawing of an inkjet recording apparatus relating to a third embodiment of the present invention.

FIG. 47 is a diagram of the general composition of an inkjet recording apparatus relating to a third embodiment. As illustrated in FIG. 47, the inkjet recording apparatus 800 according to the present embodiment is an inkjet recording apparatus using a pressure drum direct printing method employing a pressure drum, which is one mode of a direct printing method of forming an image directly on a recording medium 14.

The inkjet recording apparatus 800 principally comprises: a paper supply unit 802 which supplies a recording medium 14; a permeation suppression processing unit 804 which carries out permeation suppression processing on the recording medium 14; a treatment agent deposition unit 806 which deposits treatment agent, such as an ink aggregating agent, onto the recording medium 14; a print unit 808 which forms an image by depositing color inks onto the recording medium 14; a solvent drying unit 810 which dries the solvent of the color inks; a heat and pressure fixing section 812 which makes the image permanent; and an output unit 814 which conveys and outputs the recording medium 14 on which an image has been formed.

A paper supply tray 820 for supplying the recording medium 14 is provided in the paper supply unit 802. The recording medium 14 which has been supplied from the paper supply tray 820 is supplied via the transfer drum 824*a* to the circumferential surface of the pressure drum 826*a* of the permeation suppression processing unit 804 by a gripper (not illustrated).

In the permeation suppression processing unit 804, a liquid application apparatus 828, a paper pressing member 830 and a permeation suppression agent drying unit 832 are provided respectively at positions opposing the circumferential surface of the pressure drum 826*a*, in this order from the upstream side in terms of the direction of rotation of the pressure drum 826*a* (the counter-clockwise direction in FIG. 47). In the present embodiment, a permeation suppression agent is applied to the recording medium 14 by means of a liquid application apparatus 828 having the same composition as the liquid application apparatus 150 described above (see FIG. 15).

Figure 48:
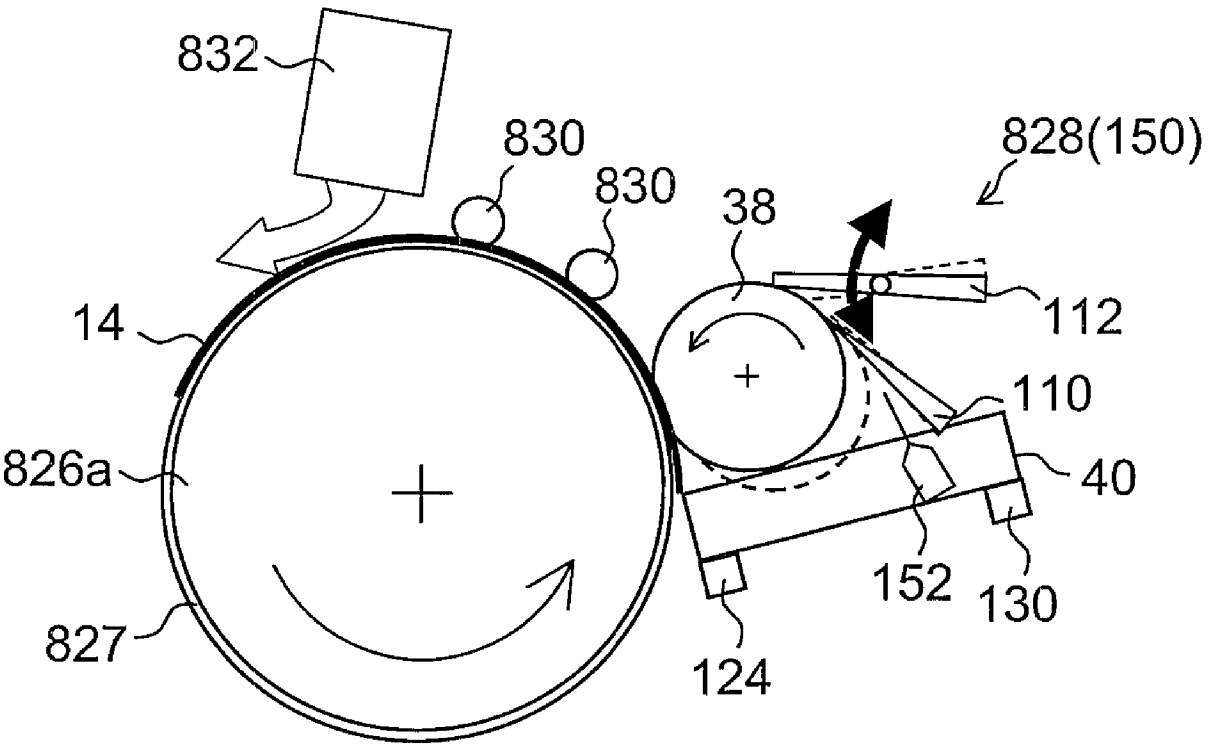
FIG. 48 is a schematic drawing of a permeation suppression processing unit.

FIG. 48 is a schematic drawing of the permeation suppression processing unit 804. In FIG. 48, members of the liquid application apparatus 828 which are the same as or similar to the composition of the liquid application apparatus 150 described in relation to FIG. 15 are labelled with the same reference numerals and further description thereof is omitted here.

As illustrated in FIG. 48, the liquid application apparatus 828 is an apparatus which applies a permeation suppression agent selectively to a desired region of the recording medium that moves in rotation while being held by a gripper (not illustrated) of a pressure drum 826*a*, by abutting a spiral roller 38 against the rotating pressure drum 826*a*, and driving the spiral roller 38 to rotate at a prescribed uniform speed in a direction opposite to the direction of rotation of the pressure drum 826*a* (the counter-clockwise direction in FIG. 48).

The circumferential surface of the pressure drum 826*a* is covered by an elastic layer 827, whereby positional deviation between the pressure drum 826*a* and the spiral roller 38 is alleviated and the wrapping of the recording medium 14 is stabilized. By using an elastic body having a hardness of 20° through 80° as the elastic layer 827 provided on the circumferential surface of the pressure drum 826*a*, the contract of the spiral roller 38 is stabilized and uniform application is achieved. Furthermore, by using for the material of the elastic layer 827 provided on the circumferential surface of the pressure drum 826*a*, any one of fluorine rubber, urethane rubber, silicone rubber, a fluorine elastomer, or a silicone elastomer, the surface tension (surface energy) can be set to 10 mN/m through 40 mN/m, liquid repelling properties can also be guaranteed, and hence the circumferential surface of the pressure drum 826*a* has excellent cleaning properties. This is also desirable since it improves the contact properties of the paper wrapped about the drum.

To give a specific example, it is possible to form the pressure drum 826*a* efficiently from cast iron, or the like, and then apply a lyophobic elastic layer 827 made of fluorine rubber, urethane rubber, silicone rubber or fluorine elastomer (Shinetsu Chemical Co., Ltd.: SIFEL 600 series, or the like) having a thickness of 0.1 mm through 1 mm to the surface of the drum. As the material of the elastic layer 827, it is possible to coat the surface of the rubber with PFA, or the like.

Figure 49:
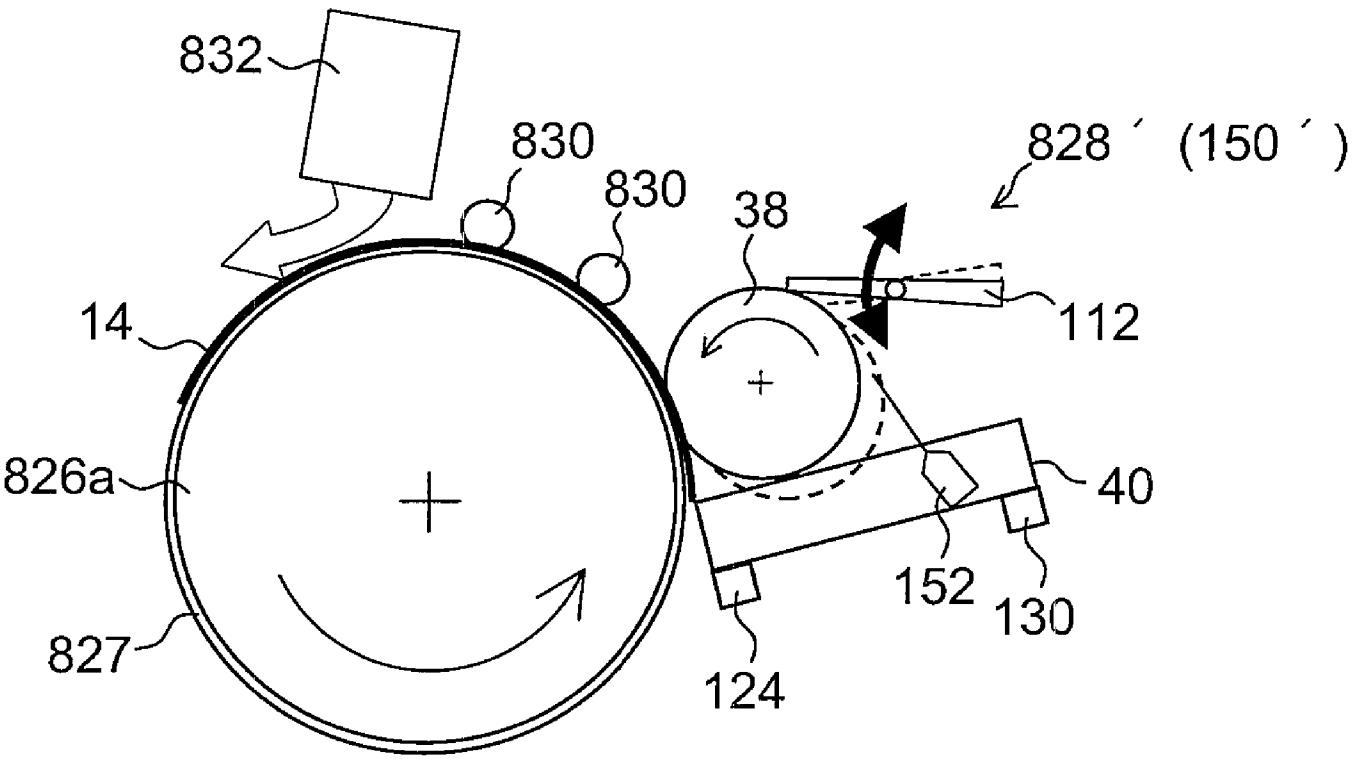
FIG. 49 is a schematic drawing of a permeation suppression processing unit which controls application by means of a main blade only (by means of one blade only)

Furthermore, as illustrated in FIG. 49, it is also possible to conceive a liquid application apparatus 828' in which the biasing force of the main blade 112 is switchable and application is controlled by means of the main blade 112 only (one blade only), without using a squeegee blade 110.

Moreover, although not illustrated in the drawings, similarly to the liquid application apparatuses 100 and 100' (see FIG. 7 and FIG. 14), it is also possible to deposit permeation suppression agent onto the outer circumferential surface of the spiral roller 38 by omitting the liquid spraying unit 152 and immersing the spiral roller 38 in permeation suppression agent that has been introduced into a treatment liquid container 40.

Furthermore, if using a recording medium 14 having a coating layer on the surface thereof or a recording medium 14 on which a liquid containing a smoothing component has been deposited, it is possible to reduce contact friction between the spiral roller 38 and the recording medium 14 in the non-application portion, and therefore stage application of high reliability can be achieved.

For the permeation suppression agent, it is desirable to use a latex solution formed by adding polymer particles of LX-1, LX-2 or the like, as described in Table 4, to water or a solvent. Of course, the permeation suppression agent is not limited to being a latex solution, and for example, it is also possible to use flat sheet-shaped particles (mica, or the like), or a hydrophobic agent (a fluorine coating agent), or the like.

The paper pressing member 830 is a roller for conveying the paper in the direction of rotation of the pressure drum 826*a* while pressing either end or the trailing end of the recording medium 14 which is supplied to the circumferential surface of the pressure drum 826*a*.

A heater of which the temperature is adjustable in the range of 50° C. through 130° C., and a fan for blowing an air flow in the downstream direction at a rate of 5 m/s through 50 m/s are provided in the permeation suppression agent drying unit 832. When the recording medium 14 held on the pressure drum 826*a*, which is an application drum, passes downstream from a position opposing the permeation suppression agent drying unit 832, a warm air flow heated to 50° C. through 130° C. by means of the heater is directed by the fan onto the recording medium 14, thereby heating the recording medium 14, and pre-drying the permeation suppression agent.

The treatment liquid deposition unit 806 is provided after the permeation suppression processing unit 804. A transfer drum 824*b* is provided between the pressure drum 826*a* of the permeation suppression processing unit 804 and the pressure drum 826*b* of the treatment liquid deposition unit 806, so as to make contact with same. By this means, after the recording medium 14 which is held on the pressure drum 826*a* of the permeation suppression processing unit 804 has been subjected to permeation suppression processing, the recording medium 14 is transferred via the transfer drum 824*b* to the pressure drum 826*b* of the treatment liquid deposition unit 806 by means of a gripper (not illustrated).

The permeation suppression agent is heated and dried in a range of 40° C. through 60° C. on the transfer drum 824*b*, the polymer particles added to the permeation suppression agent form a film, and a permeation suppression agent layer of 0.2 μm through 2 μm is formed on the recording medium 14. By altering the heating and drying conditions in accordance with the thickness and permeability of the recording medium 14 and the image pattern, and the like, it is possible to adjust the molten state and film formation defects (void ratio) of the polymer particles and to control the dried volume and permeated volume of the solvent, thereby stabilizing the image quality and fixing quality.

In the treatment liquid deposition unit 806, a treatment liquid head 836 and a treatment liquid drying unit 838 are provided respectively at positions opposing the circumferential surface of the pressure drum 826*b*, in this order from the upstream side in terms of the direction of rotation of the pressure drum 826*b* (the counter-clockwise direction in FIG. 47).

The treatment liquid head 836 ejects droplets of treatment liquid onto a recording medium 14 which is held on the pressure drum 826*b* and adopts a composition similar to the head 80 (see FIGS. 3A and 3B, or the like), but it is also possible to adjust the shape and surface treatment of the nozzles, and the drive waveform, and the like, in accordance with the viscosity or surface tension of the treatment liquid (aggregating treatment agent), and the pH (hydrogen ion concentration), and so on.

The treatment liquid drying unit 838 employs a similar composition to the permeation suppression agent drying unit 832 of the permeation suppression processing unit 804 described above. A heater (not illustrated) of which the temperature is adjustable in the range of 50° C. through 130° C., and a fan (not illustrated) for blowing an air flow in the downstream direction at a rate of 5 m/s through 50 m/s are provided in the treatment liquid drying unit 838. When the recording medium 14 held on the pressure drum 826*b* of the treatment liquid deposition unit 806 passes downstream from a position opposing the treatment liquid drying unit 838, a warm air flow heated to 50° C. through 130° C. by means of the heater is directed by the fan onto the recording medium 14, thereby heating the recording medium 14, and pre-drying the treatment liquid.

The treatment liquid used in the present embodiment is an acidic liquid which has the action of aggregating the coloring material contained in the inks which are ejected onto the recording medium 14 from respective ink heads 840K, 840C, 840M, 840Y disposed in the print unit 808, which are provided at a downstream stage. More specifically, it may be one of the treatment liquids described in Table 1 or Table 2 given below, or a treatment liquid having an added acid, such as citric acid, phosphoric acid, succinic acid, malonic acid, or the like.

It is also possible to obviate the need for the permeation suppression layer by suppressing the permeation of the treatment liquid by adding a small amount of high-boiling-point solvent, such as glycerine, or polymer particles such as LX-1, LX-2, or the like, as described in Table 4. Consequently, by applying a treatment liquid having a permeation suppressing effect of this kind by means of the liquid application apparatus 828, then the pressure drum 826*b*, the treatment liquid head 836 and the treatment liquid drying unit 838, and the like, of the treatment liquid deposition unit 806 all become unnecessary.

The print unit 808 is provided after the treatment liquid deposition unit 806. A transfer drum 824*c* is provided between the pressure drum 826*b* of the treatment liquid deposition unit 806 and the pressure drum 826*c* of the print unit 808, so as to make contact with same. By this means, treatment liquid is deposited onto the recording medium 14 held on the pressure drum 826*b* of the treatment liquid deposition unit 806, thereby forming a layer of aggregating treatment agent, whereupon the recording medium 14 is transferred via the transfer drum 824*c* to the pressure drum 826*c* of the print unit 808 by the grippers (not illustrated).

The printed surface is heated and dried in the range of 40° C. through 60° C. by the transfer drum 824*c*, and an aggregating treatment agent in a solid or semi-solid state (a thin layer of dried treatment liquid) is formed on the recording medium 14. Reference here to "aggregating treatment agent layer in a solid state or a semi-solid state" includes a layer having a liquid content of 0% through 70% as defined in (Expression 1) above.

Ink heads 840K, 840C, 840M and 840Y which respectively correspond to inks of four colors of K, C, M and Y are provided in the print unit 808 at positions opposing the circumferential surface of the pressure drum 826*c*, in this order from the upstream side in terms of the direction of rotation of the pressure drum 826*c* which has been adjusted to a temperature of 30° C. through 50° C. (the counter-clockwise direction in FIG. 47).

Similarly to the head 80 (see FIGS. 3A and 3B, or the like) and the treatment liquid head 836, the ink heads 840K, 840C, 840M and 840Y employ recording heads of an inkjet type (inkjet heads). In other words, the ink heads 840K, 840C, 840M and 840Y eject liquid droplets of the respectively corresponding color inks toward the recording medium 14 onto the recording medium 14 which is held by vacuum suctioning or electrostatic attraction onto the pressure drum 826*c*.

The solvent drying unit 810 is provided after the print unit 808. A transfer drum 824*d* is provided between the pressure drum 826*c* of the print unit 808 and the pressure drum 826*d* of the solvent drying unit 810, so as to make contact with same. By this means, after the respective colored inks have been deposited on the recording medium 14 which is held on the pressure drum 826*c* of the print unit 808, the recording medium 14 is transferred via the transfer drum 824*d* to the pressure drum 826*d* of the solvent drying unit 810.

The printed surface is heated to the range of 40° C. through 60° C. by the transfer drum 824*d*, a wet air layer is formed on the surface thereof, and of the water contained in the ejected droplets of ink, the water present on the surface is principally evaporated off.

Furthermore, if a check pattern which has been printed onto a non-image portion of the recording medium 14 is read in by a sensor, on the transfer drum 824*d*, and the droplet ejection positions are corrected accordingly in real time, then it is also possible to reduce color bleeding or magnification errors. Furthermore, it is also possible to measure the temperature and moisture of the printed surface of the recording medium 14 and to correct the heating and drying conditions in real time.

On the pressure drum 826*d* of the solvent drying unit 810, by irradiation of infrared energy or blowing a heated air flow by means of the solvent drying unit 852, the printed surface of the recording medium 14 is heated to 40° C. through 80° C., thereby sufficiently removing the water content, and lowering the viscosity of the high-boiling-point solvent, such as glycerine or diethylene glycol, which is contained in the ink for the purpose of preventing drying and adjusting the viscosity. Furthermore, by melting and forming a film of the polymer particles contained in the ink, it is also possible to improve the fixing properties.

The heat and pressure fixing unit 812 is provided after the solvent drying unit 810. A transfer drum 824*e* is provided between the pressure drum 826*d* of the solvent drying unit 810 and the pressure drum 826*e* of the heat and pressure fixing unit 812, so as to make contact with same. By this means, the water content of the inks of respective colors is removed from the recording medium 14 held on the pressure drum 826*d* of the solvent drying unit 810 and the viscosity of the high-boiling-point solvent is lowered, whereupon the recording medium 14 is transferred to the pressure drum 824*e* of the heat and pressure fixing unit 812 via the transfer drum 826*e*.

The heat and pressure fixing unit 812 comprises heat rollers (fixing rollers) 842*a*, 842*b*, 842*c* which are adjusted to a temperature of 60° C. through 120° C., provided opposing the pressure drum 826*e* which is adjusted to a temperature of 40° C. through 80° C. Desirably, the heat rollers 842*a*, 842*b* and 842*c* are formed by coating a lyophobic material, such as PFA or fluorine elastomer, onto the surface of rubber, or the like, or applying a hard chrome plating to a rigid member. Furthermore, a cleaning unit 858 which has the function of applying a separating agent is abutted against the heat rollers 842*a*, 842*b* and 842*c*. For the separating agent, apart from silicon oil, which is generally used for separation purposes, it is also possible to use a high-boiling-point solvent which is permeable in the paper, and from the viewpoint of separating properties and glossiness, it is desirable to apply the separating agent to a thickness of 30 nm through 1 μm.

A stamp die member 854 using a wound nonwoven cloth, or the like, is provided in the transfer drum 824*e* and this stamp die member 854 absorbs the high-boiling-point solvent that has not permeated completely into the recording medium 14 during conveyance on the pressure drum 826*d* and the transfer drum 824*e*.

The printed surface is heated to the range of 40° C. through 60° C. on the transfer drum 824*e*, thereby stabilizing the planar temperature distribution and the film of polymer particles on the recording medium 14 which has been heated to a high temperature by the solvent drying unit 852.

Consequently, by applying heat and pressure to the recording medium 14 which is transferred to the pressure drum 826*e* heated by the heating device (not illustrated), by means of the heat rollers 842*a*, 842*b* and 842*c*, the latex particles added to the ink are formed sufficiently into a film, thereby making the image permanent and fixing same to the recording medium 14.

Figure 50:
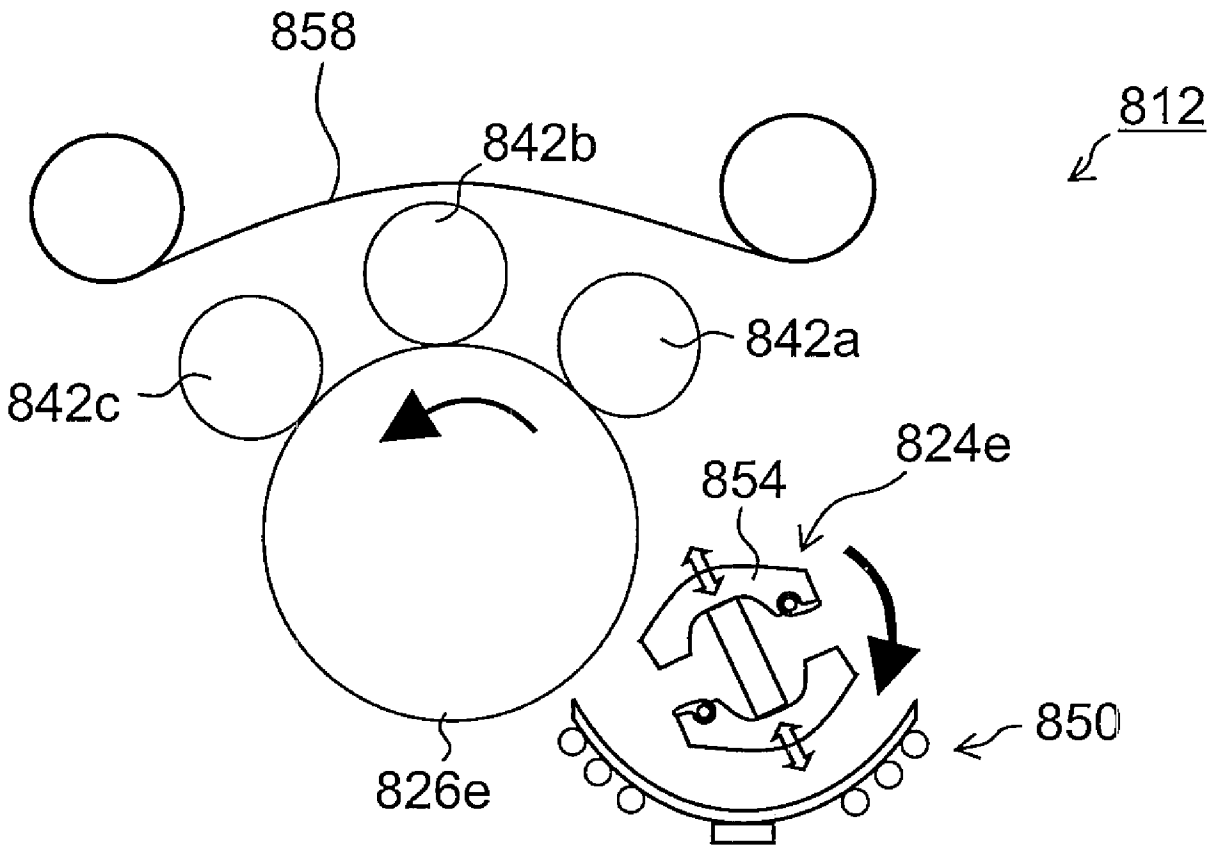
FIG. 50 is an enlarged diagram of a heat and pressure fixing unit.

FIG. 50 is an enlarged diagram of the heat and pressure fixing unit 812 and illustrates an overview of a switching roller type of heat and pressure fixing unit 812. By means of this switching roller type of heat and pressure fixing unit 812, it is possible to obtain a suitable surface glossiness in accordance with the recording medium 14.

More specifically, a heat roller 842*a* having a concavo-convex surface formed by a matt-finish blasting process, a heat roller 842*b* having a smooth surface formed by PFA, or the like, coated onto a rubber surface, and furthermore a heat roller 842*c* having a smooth surface formed by PFA, or the like, coated onto a metal surface, are provided at positions opposing the circumferential surface of the pressure drum 826*e*, in this order, from the upstream side in terms of the direction of rotation of the pressure drum 826*e* (the counter-clockwise direction in FIG. 50).

Furthermore, the nip pressure of the heat rollers is set to 0.5 MPa through 1.5 MPa in the case of the heat rollers 842*a* and 842*b* and 1 MPa to 2 MPa in the case of the heat roller 842*c*.

Table 8 illustrates examples of combinations of nip (on) of the heat rollers 842*a*, 842*b* and 842*c* against the pressure drum 826*e* and separation (release) (off) of the rollers from the pressure drum 826*e*.

TABLE 8

| Combination No. | Heater roller 842a | Heater roller 842b | Heater roller 842c | Use |
|---|---|---|---|---|
| 1 | off | off | off | Maintenance, error processing |
| 2 | off | off | on | Fixing to gloss coated paper |
| 3 | off | on | off | Fixing to matt gloss paper |
| 4 | off | on | on | Fixing to thick gloss coated paper Solid printing |
| 5 | on | off | off | Fixing to matt coated paper |
| 6 | on | off | on | Special finish |
| 7 | on | on | off | Special finish |
| 8 | on | on | on | Special finish |

As illustrated in Table 8, if the recording medium 14 is matt coated paper (combination No. 5), then only the heat roller

842*a* is nipped and the heat rollers 842*b* and 842*c* are separated from the pressure drum 826*e* by means of a release mechanism (not illustrated). By conveying the recording medium 14 in this state, a matt finish is applied to the surface and the image can be fixed reliably to the recording medium 14 by heat and pressure.

Furthermore, if the recording medium 14 is gloss coated paper (combination No. 2 in Table 8), then only the heat roller 842*c* is nipped and the heat rollers 842*a* and 842*b* are separated from the pressure drum 826*e* by means of a release mechanism (not illustrated). By conveying the recording medium 14 in this state, a gloss finish is applied to the surface and the image can be fixed reliably to the recording medium 14 by heat and pressure.

Furthermore, if the recording medium 14 is between matt coated paper and gloss coated paper (combination No. 3 in Table 8), then only the heat roller 842*b* is nipped and the heat rollers 842*a* and 842*c* are separated from the pressure drum 826*e* by means of a release mechanism (not illustrated). By conveying the recording medium 14 in this state, an intermediate finish is applied to the surface and the image can be fixed reliably to the recording medium 14 by heat and pressure.

Furthermore, if the recording medium 14 is thick gloss coated paper and solid printing is carried out (combination No. 4 in Table 8), then only the heat rollers 842*b* and 842*c* are nipped and the heat roller 842*a* is separated from the pressure drum 826*e* by means of a release mechanism (not illustrated).

Furthermore, in the event of maintenance of the apparatus, or error processing such as an application error or droplet ejection error on the recording medium 14, or a drying error (combination No. 1 in Table 8), then all of the heat rollers 842*a*, 842*b* and 842*c* are separated from the pressure drum 826*e*.

Furthermore, apart from this, if the paper has a special finish (Combinations Nos. 6, 7 and 8 in Table 8), then the heat rollers 842*a*, 842*b* and 842*c* are respectively nipped against the pressure drum 826*e* or separated from the pressure drum 826*e* as illustrated in Table 8.

Since the heat roller 842*a* positioned on the upstream side has a concavoconvex surface, then even if the solvent is in the process of permeating into the recording medium 14, the adherence of ink to the roller is light. The heat roller 842*b* which is disposed to the downstream side has a smooth surface, but since the permeation of the solvent progresses during passage over the heat roller 842*a*, then the adherence of ink can be reduced, similarly to the heat roller 842*a*.

Furthermore, the heat roller 842*c* disposed on the downstream side has a smooth surface and a greater nip pressure, but since the permeation of solvent progresses during passage over the heat rollers 842*a* and 842*b*, then similarly to the heat rollers 842*a* and 842*b*, the adherence of ink can be reduced and reliable fixing can also be achieved.

Furthermore, the heat rollers 842*a*, 842*b* and 842*c* may combine the use of a plurality of rollers, and in this case, even more stable glossiness and fixing properties can be ensured, by setting the rollers in accordance with the thickness and permeation rate of the recording medium 14, the ink droplet ejection volume corresponding to the image, and other factors.

As illustrated in Table 8, in the event of maintenance of the apparatus, or error processing such as an application error or droplet ejection error on the recording medium 14, or a drying error, all of the heat rollers 842*a*, 842*b* and 842*c* are separated from the pressure drum 826*e*.

The output unit 814 is provided after the heat and pressure fixing unit 812. A transfer drum 824*f* is provided between the pressure drum 826*e* of the heat and pressure fixing unit 812 and an output tray 844 of the output unit 814 so as to lie in contact with both. By this means, the image on the recording medium 14 held on the pressure drum 826*e* of the heat and pressure fixing unit 812 is made permanent by the heat and pressure fixing unit 812, and the recording medium 14 is then transferred to the output tray 844 via the transfer drum 824*f* and output to the exterior of the machine.

The transfer drum 824*f* is heated by a heating device (which is not illustrated) and promotes further permeation of the high-boiling-point solvent and correction of curl in the recording medium 14.

Furthermore, an in-line sensor 846 for measuring the check pattern, the amount of moisture, surface temperature, glossiness, and the like, of the recording medium 14, is disposed in the output unit 814. By monitoring the non-image portion by means of the in-line sensor 846, the dried volume or permeated volume of the permeation suppression agent or treatment liquid is adjusted in real time, and by monitoring the ink droplet ejection portion, then the ink liquid volume, the droplet ejection positions, and the surface temperature are adjusted in real time, thus making it possible to maintain stable glossiness of the solid white regions, image density and image magnification, distortion and positional deviation, and the like.

If the paper used for the recording medium 14 is a paper obtained by applying an absorbing layer with a pigment to binder ratio of about 5 through 20 at a thickness of 10 μm through 50 μm onto a base material, such as normal paper, and then applying and drying an aggregating component, such as an acid, before use, then the deposition of liquid by the permeation suppression processing unit 804 and the treatment liquid deposition unit 806 and the drying on the transfer drums 824*b* and 824*c* become unnecessary, and ink droplets are ejected directly onto the recording medium 14 which is transferred to the print unit 808.

If only paper of this kind is to be used, then the composition from the permeation suppression processing unit 804 to the transfer drum 824*c* can be omitted, and since the paper has an absorbing layer, then it is able to absorb the high-boiling-point solvent stably and the print quality can be improved yet further in comparison with generic papers.

Figure 51:
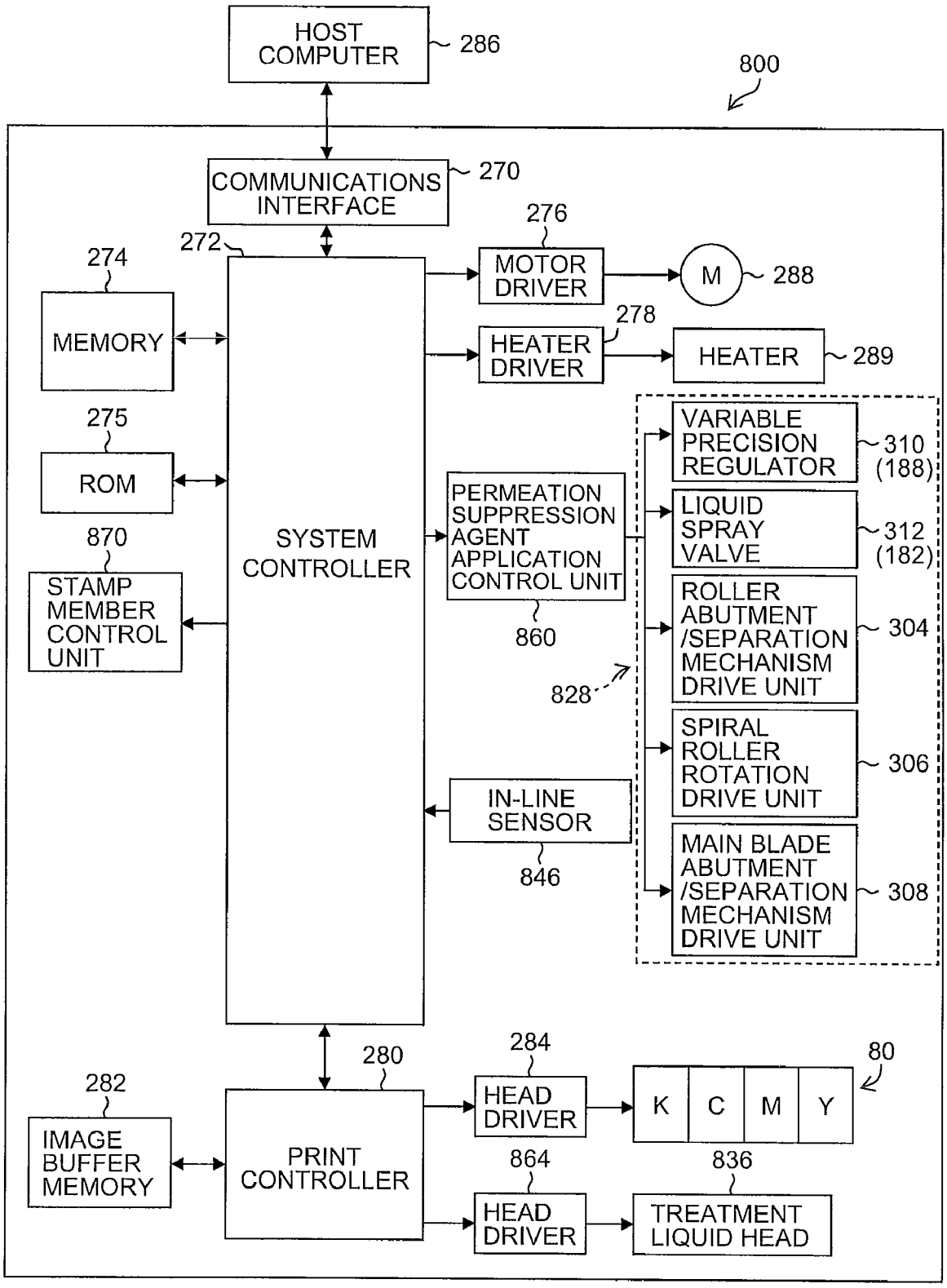
FIG. 51 is a block diagram illustrating the system configuration of the inkjet recording apparatus according to a third embodiment.

FIG. 51 is a principal block diagram illustrating the system composition of the inkjet recording apparatus 800. In FIG. 51, elements which are the same as or similar to those of the example in FIG. 40 are labelled with the same reference numerals and description thereof is omitted here.

The inkjet recording apparatus 800 comprises: a communications interface 270, a system controller 272, a memory 274, a ROM 275, a motor driver 276, a heater driver 278, a print controller 280, an image buffer memory 282, a head driver 284, permeation suppression agent application control unit 860, a head driver 864, a stamp member control unit 870, and the like.

The permeation suppression agent application control unit 860 illustrated in FIG. 51 controls the operation of the liquid application apparatus 828 in accordance with the instructions from the system controller 272. If the liquid application apparatus 150 or 150' illustrated in FIG. 15 or FIG. 20 is used for the liquid application apparatus 828, then as illustrated in FIG. 51, the permeation suppression agent application control unit 860 controls the variable precision regulator 310, the liquid spray valve 312, the roller abutment/separation mechanism drive unit 304 relating to the spiral roller 38, the spiral roller rotational drive unit 306, the main blade abutment/separation mechanism drive unit 308, and the like.

The variable precision regulator 310, the liquid spray valve 312, the roller abutment/separation mechanism drive unit 304, the spiral roller rotational drive unit 306 and the main blade abutment/separation mechanism drive unit 308 have similar functions to the contents described in FIG. 40 and FIG. 41 above, apart from the fact that the application receiving medium is taken to be a recording medium 14.

Furthermore, when liquid is not being applied, for instance, during a standby state of the inkjet recording apparatus 800, the system controller 272 may also issue an instruction to the permeation suppression agent application control unit 860 so that the spiral roller 38 is separated from the pressure drum 826*a* by the roller abutment/separation mechanism drive unit 304, and is fixed and supported by the push latch 508 (see FIG. 11).

In the treatment liquid application unit 16, if a liquid application apparatus 100 or 100' as illustrated in FIG. 7 or FIG. 14 is used, then instead of the composition involving the variable precision regulator 310 and the liquid spray valve 312 illustrated in FIG. 51, the liquid discharge valve 302 and the liquid supply pump 104 are controlled, as illustrated in FIG. 40.

In FIG. 51, the motors (actuators) disposed in the respective sections of the apparatus are represented by the reference numeral 288. For example, the motor 288 illustrated in FIG. 51 includes motors for driving the adhesive roller 848 in FIG. 47, the pressure drums 826*a* through 826*e*, the transfer drums 824*a* through 824*f*, the paper pressing member 830, the heat rollers 842*a*, 842*b*, 842*c*, or the like.

In FIG. 51, the plurality of heaters which are provided in the inkjet recording apparatus 800 are represented by the reference numeral 289. For example, the heater 289 illustrated in FIG. 51 includes the heaters of the conveyance guide 850 illustrated in FIG. 47, the permeation suppression agent drying unit 832, the treatment liquid drying unit 838, the solvent drying unit 852, and the like.

In the inkjet recording apparatus 800 illustrated in FIG. 51, a treatment liquid head 836 and a head driver 864 which drives this head are provided as devices for depositing treatment liquid. The head driver 864 generates drive signals to be applied to the actuators 88 of the treatment liquid head 836, on the basis of image data supplied from the print controller 280, and also comprises drive circuits which drive the actuators 88 (see FIG. 5) by applying the drive signals to the actuators 88. In this way, a desirable mode is one in which a composition for ejecting droplets of treatment liquid in accordance with the image data is adopted, and droplets of treatment liquid are ejected selectively onto the positions where droplets of ink have been ejected by the print unit 808, but it is also possible to adopt a mode in which the aggregating liquid is deposited in a uniform fashion by using a spray nozzle.

The stamp die member control unit 870 controls the operation of the stamp die member 854 which is disposed in the transfer drum 824*e*.

Furthermore, the measurement result data relating to the check pattern, moisture content, surface temperature, glossiness, and the like, are input to the system controller 272 from the in-line sensor 846 which is disposed in the output unit 814.

The action of the image forming apparatus 800 which is composed in this way will now be described.

The recording medium 14 which has been supplied from the paper supply tray 820 is supplied via the transfer drum 824*a* to the circumferential surface of the pressure drum 826*a* of the permeation suppression processing unit 804 by a gripper (not illustrated).

Before being conveyed to the paper supply tray 820, the recording medium 14 is previously stacked in a paper supply unit (not illustrated) which is preheated to 40° C. through 50° C. The recording medium 14 is supplied to the transfer drum 824*a* while making contact with an adhesive roller 848 which is provided at a position opposing the paper supply surface of the paper supply tray 820. In this way, the recording medium 14 is heated and dried by preheating the paper supply unit, and it becomes possible to remove foreign material, such as paper dust, or other dust and dirt, by means of the recording medium 14 making contact with the adhesive roller 848, and faster and more stable drying after the application of permeation suppression agent can be achieved.

The recording medium 14 is held on the pressure drum 826*a* of the permeation suppression processing unit 804, via the transfer drum 824*a*, and permeation suppression agent is applied selectively to a desired region by the liquid application apparatus 828. Thereupon, the recording medium 14 held on the pressure drum 826*a* is heated by the permeation suppression agent drying unit 832 while being guided by the paper pressing member 830 and conveyed in the direction of rotation of the pressure drum 826*a*, whereby the solvent component (liquid component) of the permeation suppression agent is evaporated off and thereby dried.

The recording medium 14 which has been subjected to permeation suppression processing in this way is transferred from the pressure drum 826*a* of the permeation suppression processing unit 804 and via the transfer drum 824*b* to the pressure drum 826*b* of the treatment liquid deposition unit 806. On the transfer drum 824*b*, the permeation suppression agent is heated and dried by the non-contact drying of the printed surface by the conveyance guide 850. Droplets of treatment liquid are ejected by the treatment liquid head 836 onto the recording medium 14 which is held on the pressure drum 826*b*. Thereupon, the recording medium 14 which is held on the pressure drum 826*b* is heated by the treatment liquid drying unit 838, and the solvent component (liquid component) of the treatment liquid is evaporated and dried. By this means, a layer of aggregating treatment agent in a solid state or semi-solid state is formed on the recording medium 14.

The recording medium 14 on which a solid or semi-solid layer of aggregating treatment agent has been formed is transferred from the pressure drum 826*b* of the treatment liquid deposition unit 806 via the transfer drum 824*c* to the pressure drum 826*c* of the print unit 808. On the transfer drum 824*c*, acid is left on the permeation suppression layer by the non-contact drying of the printed surface by the conveyance guide 850. Droplets of corresponding colored inks are ejected respectively from the ink heads 840K, 840C, 840M and 840Y, onto the recording medium 14 held on the pressure drum 126*b*, in accordance with the input image data.

When ink droplets are deposited onto the aggregating treatment agent layer, then the contact surface between the ink droplets and the aggregating treatment agent layer is a prescribed surface area when the ink lands, due to a balance between the propulsion energy and the surface energy. An aggregating reaction starts immediately after the ink droplets have landed on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 14.

The recording medium 14 onto which ink has been deposited is transferred from the pressure drum 826*c* of the print unit 808, via the transfer drum 824*d*, to the pressure drum 826*d* of the solvent drying unit 810. On the transfer drum 824*d*, the printed surface of the recording medium 14 is dried by a non-contact method, by the conveyance guide 850. On the pressure drum 826*d*, the water content is removed sufficiently by irradiation of infrared energy and blowing of a heated air flow by the solvent drying unit 852.

Thereupon, the recording medium 14 is transferred to the pressure drum 826*e* of the heat and pressure fixing unit 812 from the pressure drum 826*d* of the solvent drying unit 810 and via the transfer drum 824*e*. A stamp die member 854 is disposed on the transfer drum 824*e*, and this stamp die member 854 absorbs the high-boiling-point solvent and causes same to permeate into the paper via the treatment liquid and the voids in the permeation suppression layer which have been increased by the heating and drying process. On the transfer drum 824*e*, the printed surface of the recording medium 14 is dried by a non-contact method, by the conveyance guide 850. The image is fixed to the recording medium 14 by applying heat and pressure by means of the heat rollers 842*a*, 842*b*, 842*c* to the recording medium 14 that has been transferred to the pressure drum 826*e*, which is heated by a heating device (not illustrated).

Thereupon, the recording medium 14 is transferred to an output tray 844 of the output unit 814 from the pressure drum 826*e* of the heat and pressure fixing unit 812 via the transfer drum 824*f*, and is output to the exterior of the machine. The transfer drum 824*f* is heated by a heating device (which is not illustrated) and promotes further permeation of the high-boiling-point solvent and correction of curl in the recording medium 14.

Liquid application methods, liquid application apparatuses and image forming apparatuses according to embodiments of the present invention has been described in detail above, but the present invention is not limited to the aforementioned examples, and it is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid application method comprising:

an application liquid supplying step of supplying an application liquid to an outer circumferential surface of a roller member which is driven to rotate;

a blade abutting step of abutting a blade member against the outer circumferential surface of the roller member so as to remove the application liquid supplied in the application liquid supplying step;

and a blade abutment and separation control step of controlling an operation of abutting and an operation of separating the blade member in the blade abutting step;

wherein in the blade abutting step, the roller member is separated from an application receiving medium by a biasing force of the blade member.

2. The liquid application method as defined in claim 1, wherein the outer circumferential surface of the roller member comprises a groove formed approximately in a direction in which the roller member rotates, and the blade member is made of an elastic body.

3. The liquid application method as defined in claim 1, wherein in the blade abutment and separation control step, control is performed for switching, in at least two stages, a biasing force of the blade member against the outer circumferential surface of the roller member during abutment of the blade member.

4. The liquid application method as defined in claim 1, comprising a squeegee step of scraping, by the blade member, a surplus of the application liquid which has been deposited on the outer circumferential surface of the roller member in the application liquid supplying step.

5. The liquid application method as defined in claim 1, wherein in the application liquid supplying step, a width of the outer circumferential surface of the roller member at which the application liquid is supplied is controlled by a supply width control device which controls the width of the outer circumferential surface of the roller member at which the application liquid is supplied.

6. The liquid application method as defined in claim 1, wherein an intermediate transfer body of an intermediate transfer type of inkjet recording apparatus is employed as an application receiving medium, and tension of the intermediate transfer body is adjusted by a tensioner member provided in a vicinity of the roller member.

7. The liquid application method as defined in claim 1, wherein at least one of an intermediate transfer body which has undergone liquid cleaning, a recording medium having a coating layer formed on the surface thereof and a recording medium on which a liquid containing a lubricating component has been deposited is employed as an application receiving medium.

8. The liquid application method as defined in claim 1, wherein an intermediate transfer body of an intermediate transfer type of inkjet recording apparatus is employed as an application receiving medium, and hardness of a surface of the intermediate transfer body is 20° to 80°, and surface energy of the surface of the intermediate transfer body is 10 mN/m to 40 mN/m.

9. The liquid application method as defined in claim 1, wherein a recording medium for a direct drawing type of inkjet recording apparatus is employed as an application receiving medium, and hardness of the surface of a conveyance device of the recording medium is 20° to 80°, and surface energy of the surface of the conveyance device for the recording medium is 10 mN/m to 40 mN/m.

* * * * *